US007554462B2

(12) United States Patent
Mori

(10) Patent No.: US 7,554,462 B2
(45) Date of Patent: Jun. 30, 2009

(54) INFORMATION UPDATING DEVICE, ITS METHOD, ITS PROGRAM AND STORING MEDIUM STORING THE PROGRAM

(75) Inventor: Kouji Mori, Tokyo (JP)

(73) Assignees: Pioneer Corporation, Tokyo (JP); Increment P Corporation, Tokyo (JP)

( * ) Notice: Subject to any disclaimer, the term of this patent is extended or adjusted under 35 U.S.C. 154(b) by 606 days.

(21) Appl. No.: 11/438,137

(22) Filed: May 22, 2006

(65) Prior Publication Data

US 2006/0284738 A1 Dec. 21, 2006

(30) Foreign Application Priority Data

May 23, 2005 (JP) ..... 2005-150173

(51) Int. Cl.
*G08G 1/123* (2006.01)

(52) U.S. Cl. ..... 340/995.14; 340/995.15; 701/300; 701/212; 701/208

(58) Field of Classification Search ..... 340/990, 340/995.14, 995.15; 701/300, 212, 211, 701/208, 2, 209, 200, 117; 702/150
See application file for complete search history.

(56) References Cited

U.S. PATENT DOCUMENTS 6,321,158 B1 * 11/2001 DeLorme et al. ..... 701/201
6,845,319 B2 * 1/2005 Uchida ..... 701/208
6,906,643 B2 * 6/2005 Samadani et al. ..... 340/995.18
7,136,744 B2 * 11/2006 Maeda ..... 701/200
7,428,460 B2 * 9/2008 Atarashi et al. ..... 701/208
7,430,473 B2 * 9/2008 Foo et al. ..... 701/212
7,451,040 B2 * 11/2008 Miyahara ..... 701/200
2003/0204308 A1 * 10/2003 Uchida ..... 701/209
2004/0070602 A1 * 4/2004 Kobuya et al. ..... 345/738
2004/0196163 A1 * 10/2004 Takenaga et al. ..... 340/995.12
2005/0096839 A1 * 5/2005 Nakano et al. ..... 701/200
2006/0161344 A1 * 7/2006 Iwahori et al. ..... 701/211
2006/0279432 A1 * 12/2006 Mori ..... 340/990

(Continued)

FOREIGN PATENT DOCUMENTS

JP 8-63575 3/1996

(Continued)

*Primary Examiner*—Davetta W Goins
*Assistant Examiner*—Hoi C Lau
(74) *Attorney, Agent, or Firm*—Kratz, Quintos & Hanson, LLP

(57) ABSTRACT

A processor (150) of a map information generating device (100) acquires annotation data for displaying a location adjusting annotation about, for instance, a feature that is newly built and set a locatable position of a location-adjusting-annotation character string of the location adjusting annotation at a position substantially corresponding to a position where the feature of the location-adjusting-annotation character string exists but not overlapping with an existing annotation. Then, the processor (150) updates the annotation data based on the location state of the location-adjusting-annotation character string and stores it in the storage section (130). When determining that that all annotations cannot be located so as not to overlap with each other only by adjusting the locatable position of the location-adjusting-annotation character string, the processor (150) sets the location-adjusting-annotation character string at a predetermined position, while performing location adjusting processing of an overlapped-existing-annotation character string that overlaps with the location-adjusting-annotation character string to be located at the predetermined position.

21 Claims, 35 Drawing Sheets

U.S. PATENT DOCUMENTS

2006/0284738 A1* 12/2006 Mori ..... 340/995.14

FOREIGN PATENT DOCUMENTS

JP 8-255256 10/1996
JP 8-292715 11/1996
JP 9-146529 6/1997
JP 11-45262 2/1999
JP 3541854 4/2004

* cited by examiner

INFORMATION UPDATING DEVICE, ITS METHOD, ITS PROGRAM AND STORING MEDIUM STORING THE PROGRAM

BACKGROUND OF THE INVENTION

1. Field of the Invention

The present information is related to: an information updating device for updating target object map information for displaying detail information for a plurality of target objects located in a predetermined position, the detail information being about a detail of each of the target objects and being displayed in a manner substantially corresponding to a positional relationship of each of the target objects; a method thereof; a program thereof; and a storing medium storing the program.

2. Description of Related Art

There have been conventionally known arrangements for properly adjusting locatable positions of symbols, characters etc. for showing buildings and the like in displaying a map. Such arrangements are disclosed in, for instance, Document 1: JP-A-9-146529, left column of page 4 to right column of page 9, Document 2: JP-A-11-45262, right column of page 3 to right column of page 5, Document 3: JP-A-8-255256, right column of page 2 to left column of page 3, and Document 4: JP-A-8 292715, right column of page 6 to right column of page 13. Also, there have been known arrangements for generating map data that is used for displaying a map on a display unit or the like. Such arrangements are disclosed in, for instance, Document 5: Japanese Patent No. 3541854, pages 4 to 7, and Document 6: JP-A 8-63575, right column of page 3 to left column of page 4.

In the arrangement disclosed in Document 1, in a state with map data, a symbol, characters, etc. being displayed, when a new symbol and a character pertaining to the new symbol is desired to be displayed, a display area is divided into meshes of a predetermined size. Then, based on an azimuth of the character relative to the symbol, a distance between the symbol and the character, a positional relationship with other graphics, an overlapping degree with other characters, a difference in display color and the like, a fitness for a display position is obtained for each of the meshes, so that an area with the best fitness for display position is selected and displayed as a character display position.

The arrangement disclosed in Document 2 performs a retrieval based on a retrieval criteria set by a user, and map data for a subjected region is inputs. Then, an object to be displayed is selected for the map data. A link and a node each adjacent to the selected object are extracted to determine an intersecting point of an area of the input map data and the link. Then, a node that is closest to the determined intersecting point is obtained, and when the object to be displayed is located at the same position as the node, the object is displayed hierarchically. When the object is desired to be displayed as an icon and the icon cannot be located so as not to overlap with the link and the node having already been displayed, positions of the adjacent node and link are moved.

The arrangement disclosed in Document 3 obtains, when an operation is performed for specifying a graphical element (segment pattern) for locating a character string in a map being displayed, an angle of the segment pattern based on a upper-right coordinate and a lower-left coordinate of the specified segment pattern. Then, the character string is located and output in a direction of the obtained angle.

The arrangement disclosed in Document 4 selects a character string with a predetermined attribute that should be displayed when displaying a bird's-eye view. In a case where, for instance, a symbol attribute formed of a symbol such as a double circle is displayed in preference to a character-string attribute formed of a character string, when a symbol and a character are overlapped, the symbol is displayed. For character strings that have been determined to have the same attribute, the character strings are sorted in a depth direction, and the one located closer to a current position is displayed.

The arrangement disclosed in Document 5 obtains an annotation rectangle to be contained in a subjected building graphic when generating a map drawing. In addition, a morphologic analysis is performed on an annotation character string to extract a word unit having a meaning and a candidate break point is determined. Then, the annotation rectangle and the annotation character string with the candidate break point are compared to determine an annotation location condition including whether to write vertically or horizontally, an inclination of the character string, the number of lines, a line spacing, a character size and the like, and the annotation character string is located in the building graphic.

The arrangement disclosed in Document 6 selects, when generating display map data, shape data and character symbol data that are required to be displayed from a map database, formats of which are then converted to shape data and character symbol data. Then, based on preset priority of types, the pieces of character symbol data are sorted by symbols and names and listed. Display positions of the pieces of character symbol data are determined in the descending order of the priority, and character symbol data that is overlapped with character symbol data with its display position having been determined is judged to be non-displayable and deleted.

However, in the arrangements of Documents 1 to 4 described above, since locatable positions of a symbol and a character are adjusted by performing computation based on symbol information for displaying the symbol and character information for displaying the character, the arrangements possibly become complicated. Further, in the arrangement of Document 5, when the number of characters to be located is large relative to the size of the building graphic for instance, the size of the characters is set so set small that a user might have difficulty to read. Still further, in the arrangement of Document 6, since, for instance, character information that overlaps with character information with its display position having been determined is deleted, when the deleted character information contains a detail that is helpful for a user, proper map information cannot be generated.

SUMMARY OF THE INVENTION

An object of the present invention is to provide: an information updating device capable of appropriately updating target object map information for displaying detail information for a plurality of target objects located in a predetermined position, the detail information displayed in a manner substantially corresponding to a positional relationship of each of the target objects; a method thereof; a program thereof; and a storing medium storing the program.

An information updating device according to an aspect of the present invention updates target object map information for displaying detail information about details of a plurality of target objects located in a predetermined position such that the detail information corresponds to a positional relationship of the plurality of the target objects includes. The information updating device includes: a new detail information acquirer for acquiring the detail information about the new target object; a new target object position recognizer for recognizing a position where the new target object exists; a target object map information acquirer for acquiring the target object map information; an existing detail position recognizer for recognizing, based on the target object map information acquired by the target object map information acquirer, a display position for detail information of an existing target object that is different from the new target object, the detail information of the existing target object possibly visually interfering with the detail information of the new target object; a detail position setting section for setting a display position for the detail information of the new target object at a position corresponding to the position of the new target object but not overlapping with the detail information of the existing target object; and an update processor for updating the target object map information such that the detail information of the new target object is displayed at the display position that is set by the detail position setting section.

An information updating method according to another aspect of the present invention for updating target object map information for displaying detail information about details of a plurality of target objects located in a predetermined position such that the detail information corresponds to a positional relationship of the plurality of the target objects is performed by a computing unit. The method includes: acquiring the detail information about the new target object; recognizing a position where the new target object exists; acquiring the target object map information; recognizing a display position for detail information of a target object that is different from the new target object based on the acquired target object map information; setting a display position for the detail information of the new target object at a position corresponding to the position of the new target object but not overlapping with the detail information of the existing target object; and updating the target object map information for displaying the detail information of the new target object at the set display position.

An information update program according to still another aspect of the present invention operates a computing unit as the above-described information updating device of the present invention.

An information processing program according to yet another aspect of the present invention operates a computing unit to execute the above-described information processing method of the present invention.

A storing medium according to a further aspect of the present invention stores the above-described information update program of the present invention in a manner readable by a computing unit.

DETAILED DESCRIPTION OF PREFERRED EMBODIMENT(S)

First Embodiment

Figure 1:
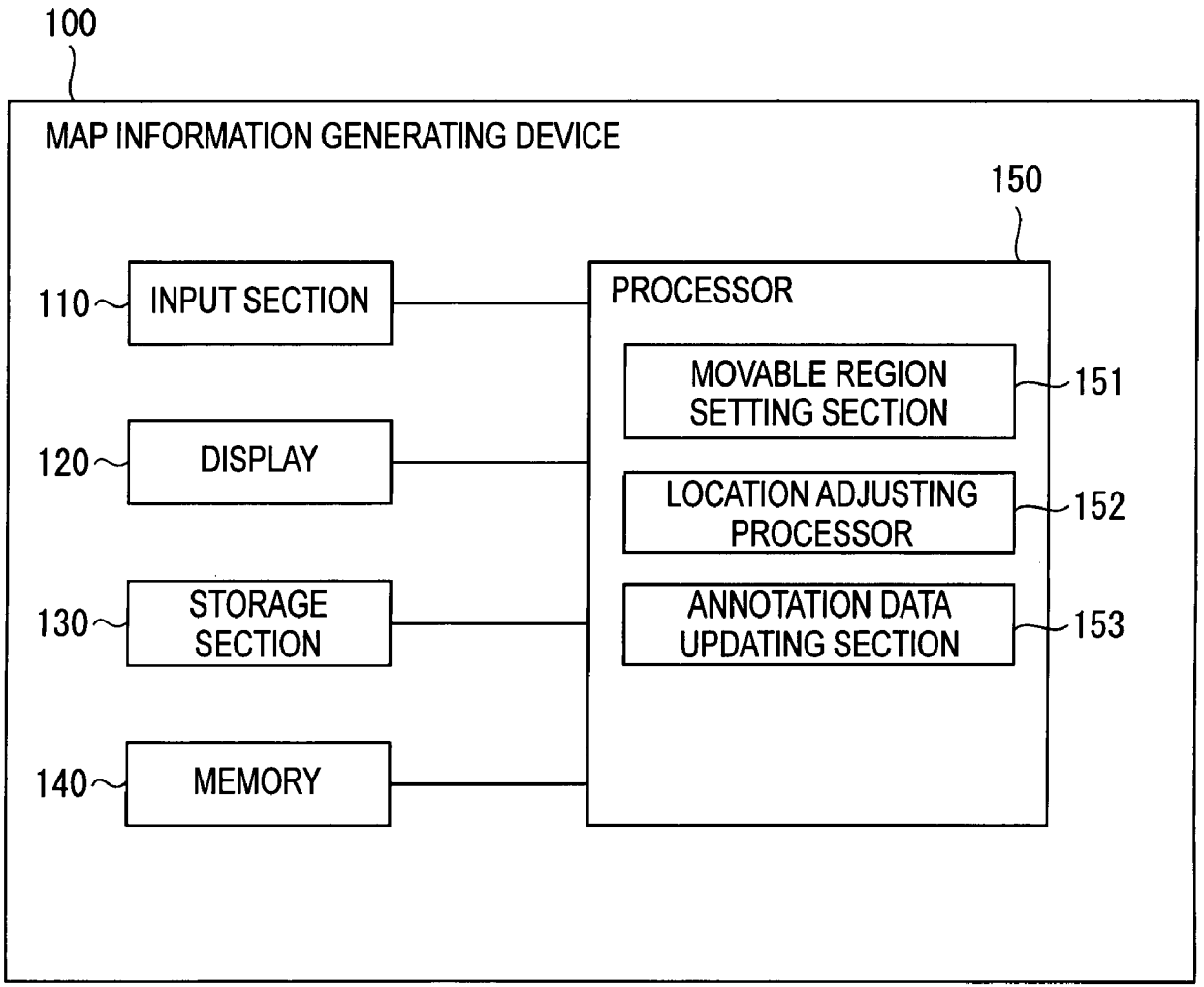
FIG. 1 is a block diagram showing an outline of a map information generating device according to a first embodiment of the present invention.
Figure 2:
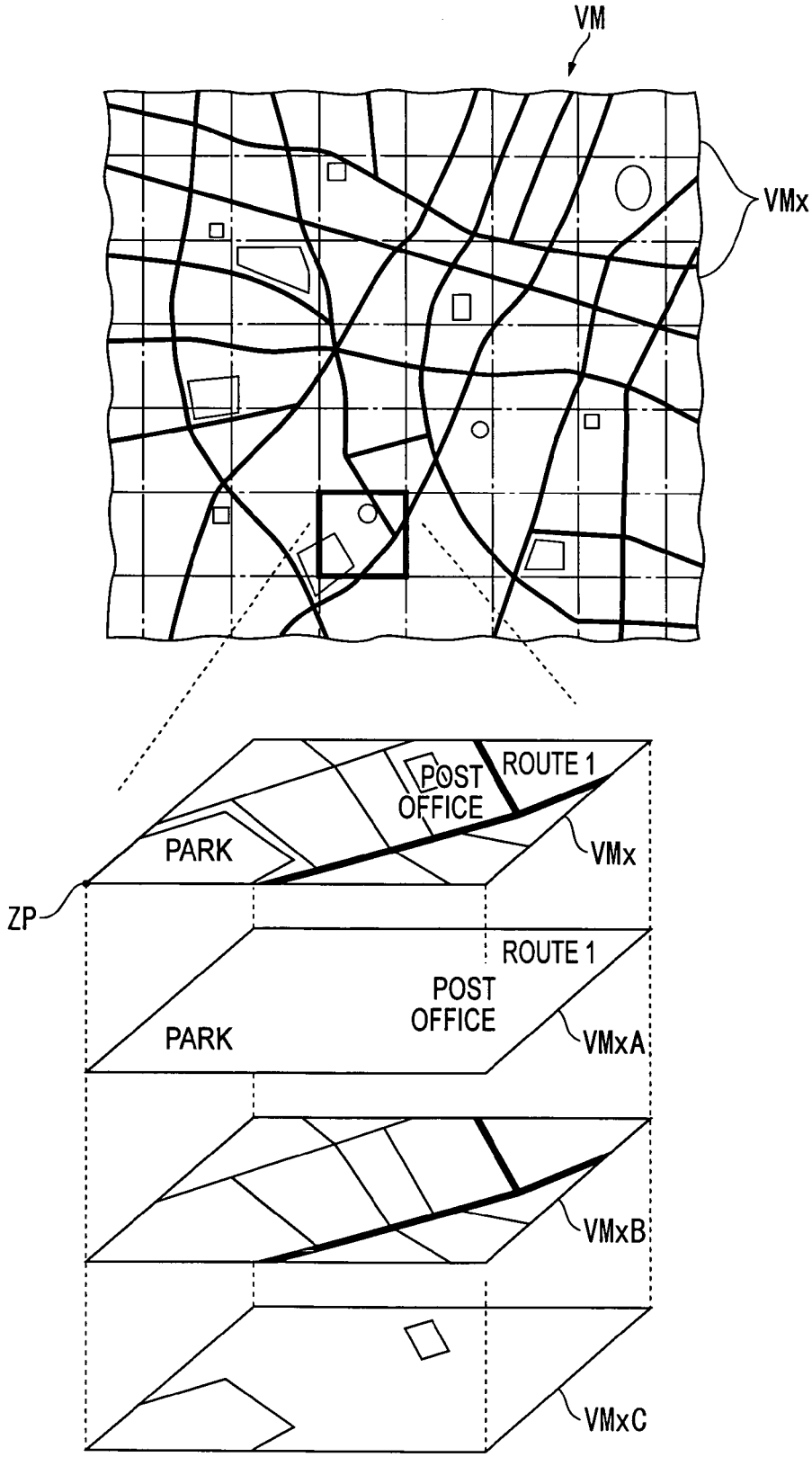
FIG. 2 is a conceptual diagram schematically showing a table structure of display data constituting map information of the first embodiment.
Figure 3:
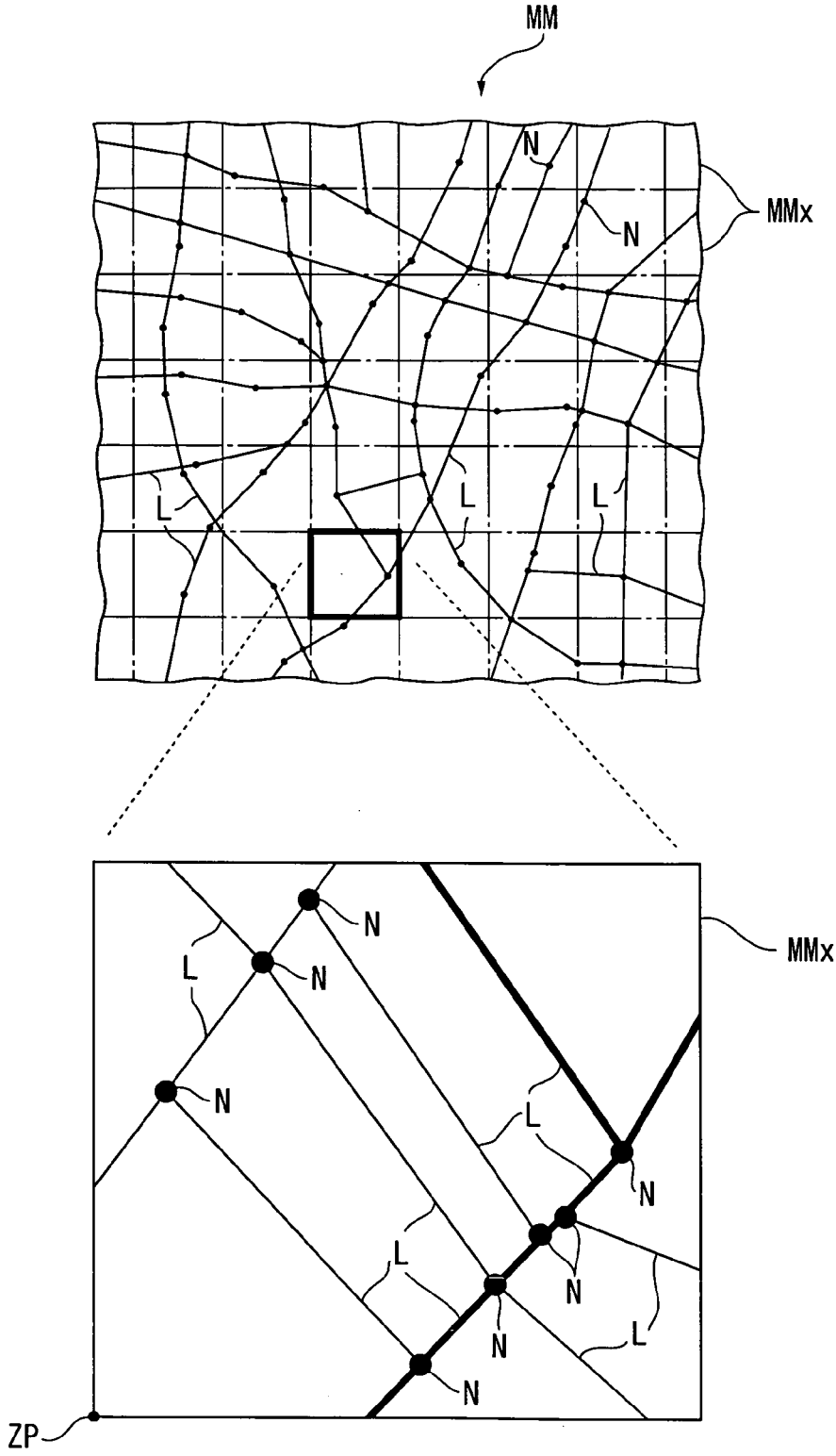
FIG. 3 is a conceptual diagram schematically showing a table structure of matching data constituting the map information of the first embodiment.
Figure 4:
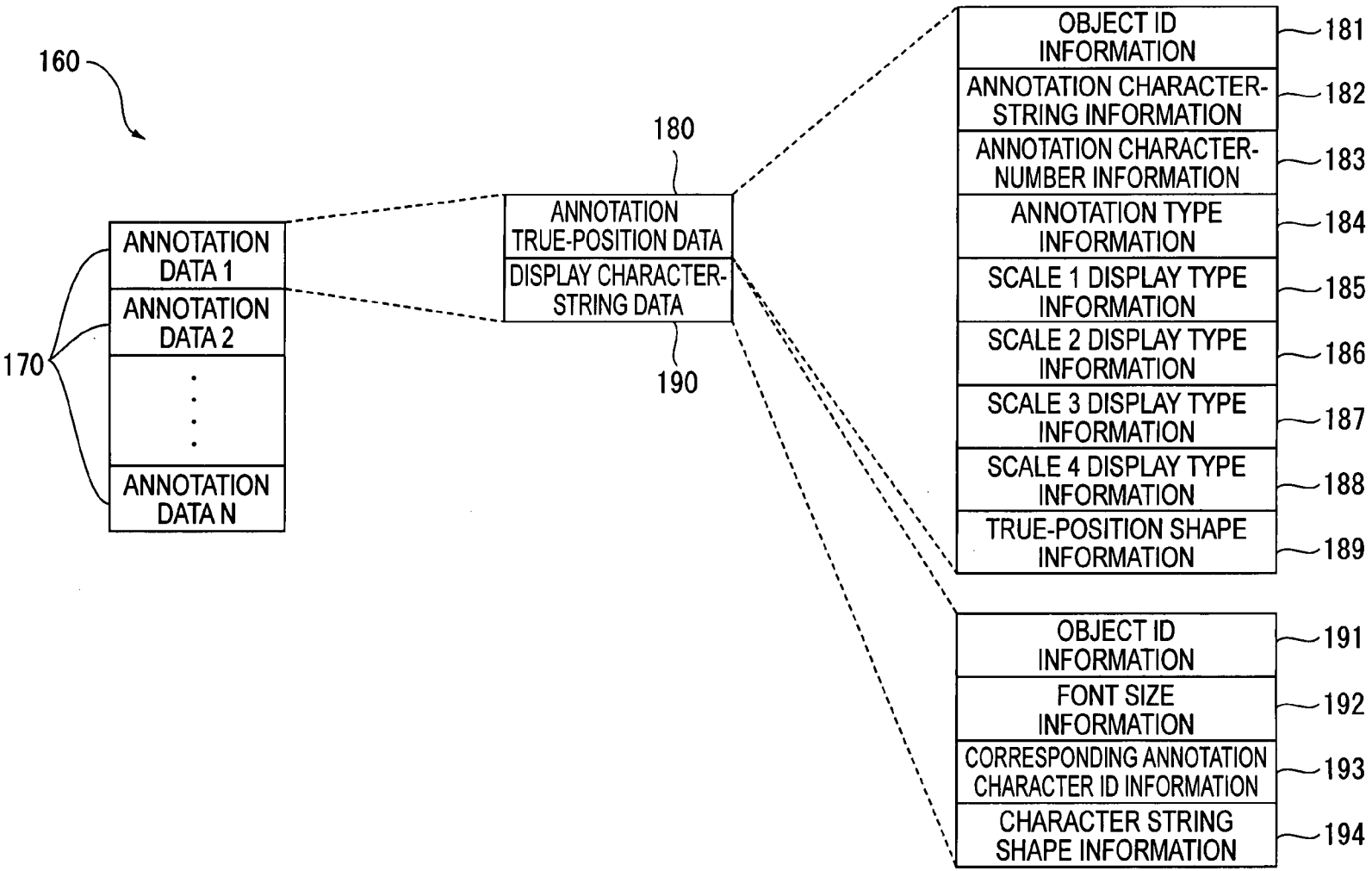
FIG. 4 is a schematic diagram showing a brief arrangement of annotation data in the first embodiment.
Figure 5:
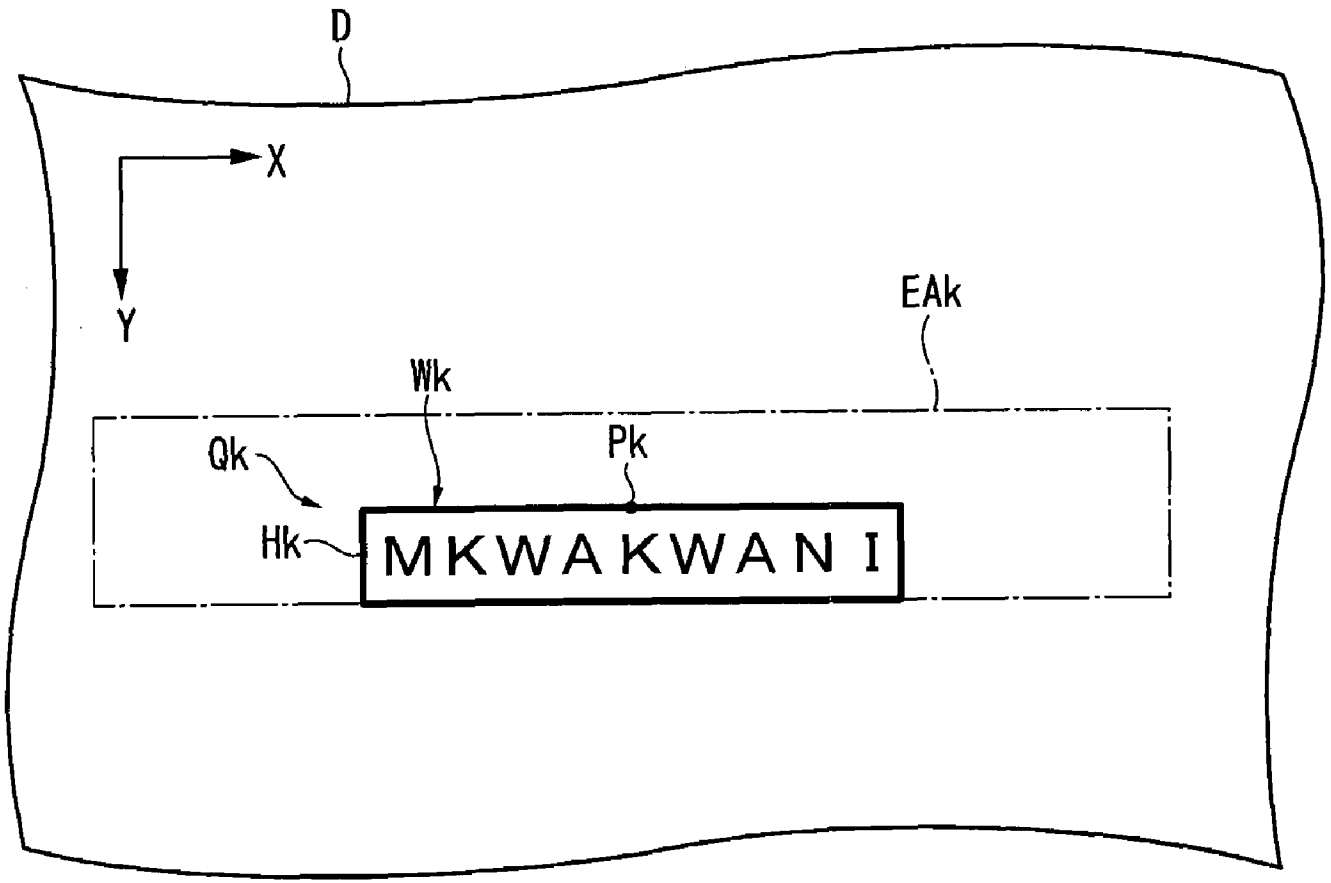
FIG. 5 is a schematic diagram showing a movable region of a character display type in the first embodiment.
Figure 6:
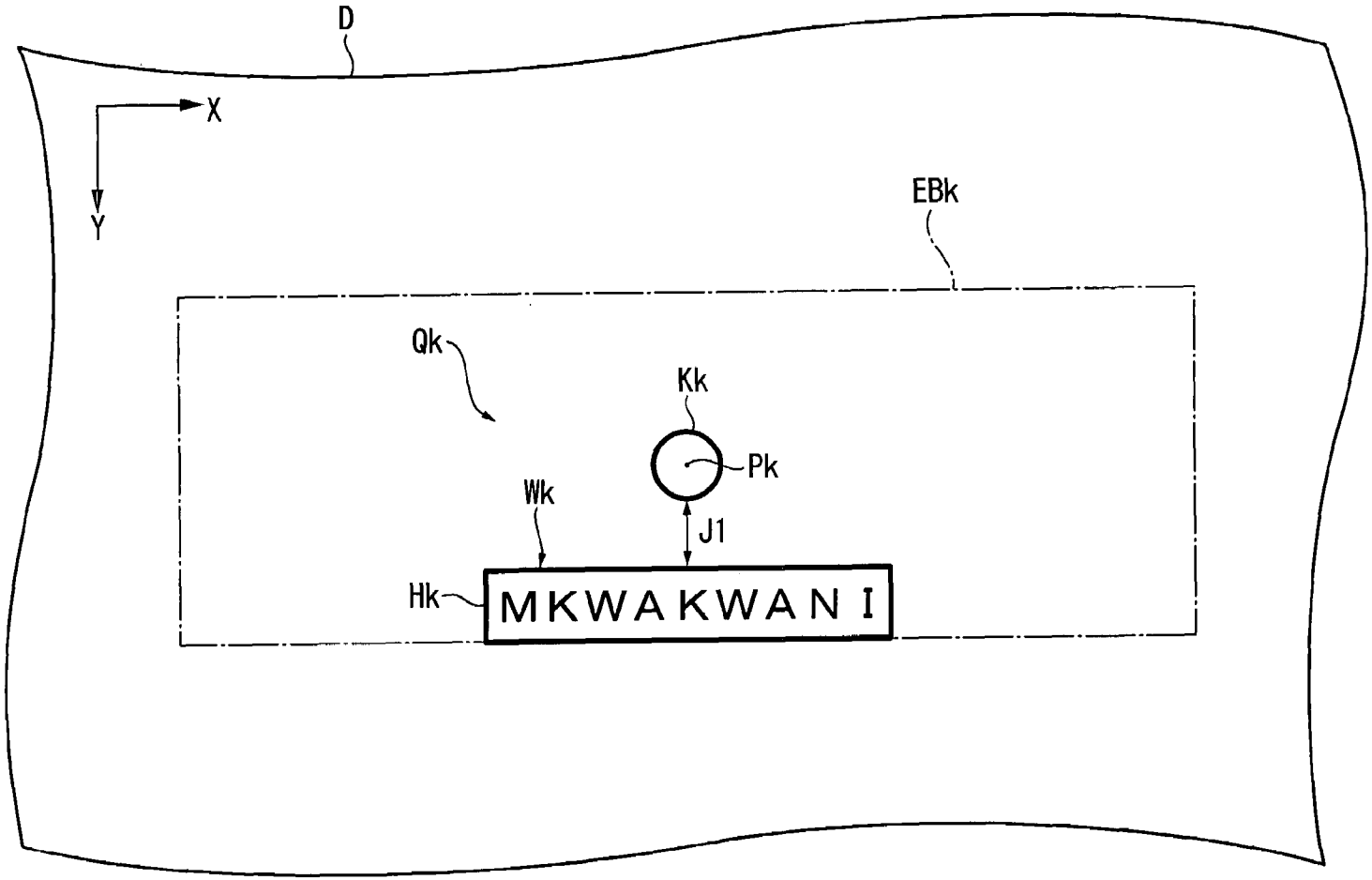
FIG. 6 is a schematic diagram showing a movable region of a symbol-character display type in the first embodiment.
Figure 7:
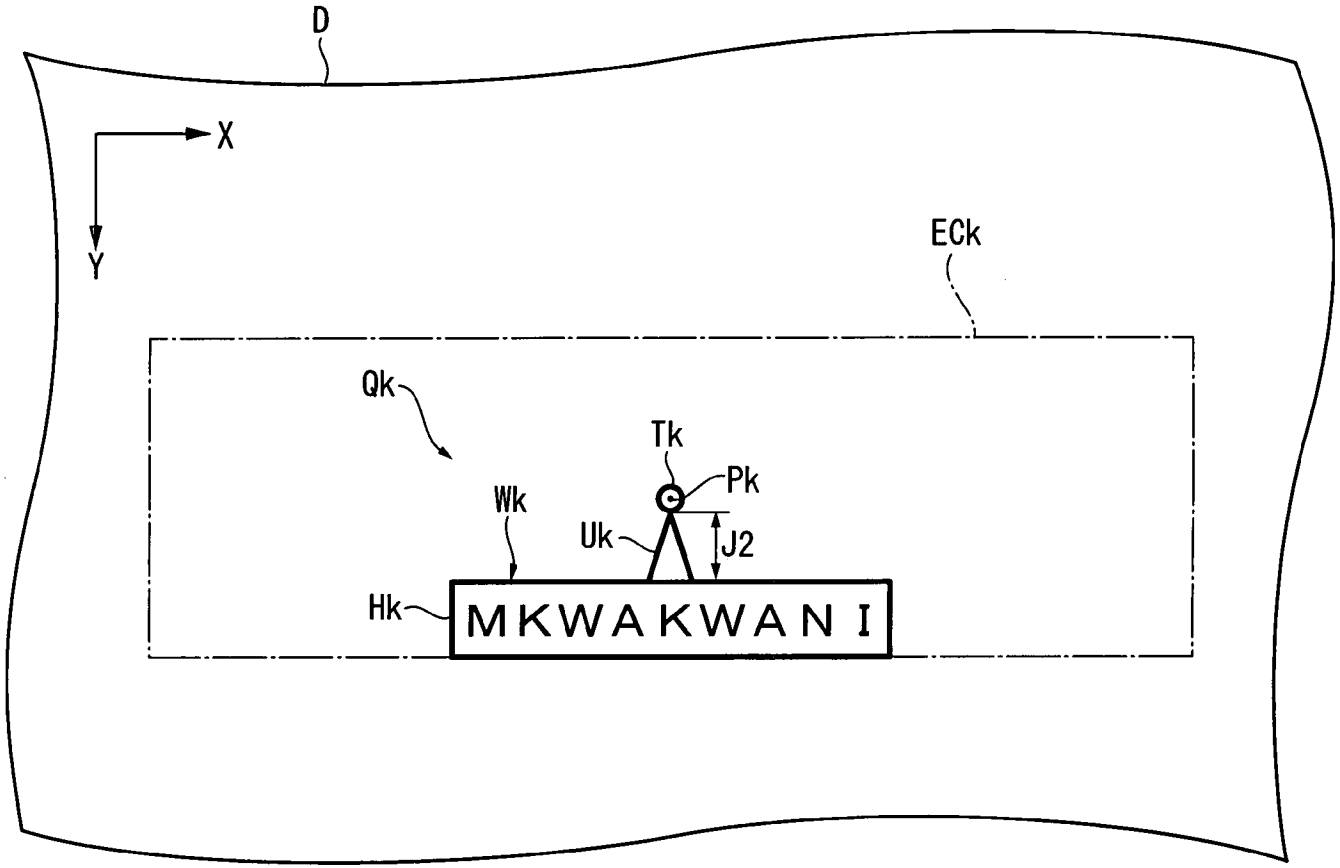
FIG. 7 is a schematic diagram showing a movable region of a leader-character display type in the first embodiment.

A first embodiment of the present invention will be described below with attached drawings. In the present embodiment, an information processing device of the present invention will be described by exemplifying a map information generating device that updates map information for displaying, on a display unit installed on a mobile body (e.g., a vehicle), various information about a feature (a target object) is displayed on a map in a manner substantially corresponding to a positional relationship of the feature. FIG. 1 is a block diagram showing an outline of the map information generating device. FIG. 2 is a conceptual diagram schematically showing a table structure of display data constituting the map information. FIG. 3 is a conceptual diagram schematically showing a table structure of matching data constituting the map information. FIG. 4 is a schematic illustration showing a brief arrangement of annotation data. FIG. 5 is a schematic illustration showing a movable region of a character display type. FIG. 6 is a schematic illustration showing a movable region of a symbol-character display type. FIG. 7 is a schematic illustration showing a movable region of a leader-character display type.

[Arrangement of Map Information Generating Device]

In FIG. 1, the reference numeral 100 denotes a map information generating device. The map information generating device 100 generates map information for displaying, on a display unit (not shown), a map showing various information about features such as facilities, plants and shops with roads and the like. In addition, when a new feature (e.g., a facility) is built at a predetermined place, the map information generating device sets a position for displaying information of the new feature so as not to overlap with information of an existing feature and the like. The map information generating device 100 includes an input section 110, a display 120, a storage section 130, a memory 140, a processor 150 as a computing unit and so on.

The input section 110 has various operation buttons and operation knobs (each not shown) used for input operation. Input operation with the operation buttons and knobs includes, for instance, settings of operations of the map information generating device 100. Specifically, for instance, the input operation may include generation or acquisition of information about the new feature and retrieval of various information. Through the input operation of the settings, the input section 110 appropriately outputs a predetermined signal to the processor 150.

The display 120 displays a signal of image data sent from the processor 150 under the control of the processor 150. The display 120 may be a liquid crystal panel, an organic EL (Electro Luminescence) panel, a PDP (Plasma Display Panel), a CRT (Cathode-Ray Tube), an FED (Field Emission Display) and an electrophoretic display panel. The image data displayed on the display 120 may be those of the information about the new feature, a map based on the map information stored in the storage section 130, etc.

The storage section 130 readably stores, for instance, the map information as shown in FIGS. 2 and 3. The storage section 130 may include a drive or a driver that can readably store data in a storing medium such as an HD (Hard Disk), a DVD (Digital Versatile Disc), an optical disc and a memory card.

Herein, the map information may include display data VM that is a so-called POI (Point Of Interest) data as shown in FIG. 2, matching data MM as shown in FIG. 3, symbol related information (not shown) and the like.

The display data VM has plural pieces of display mesh information VMx, each display mesh information having a specific number. To be more specific, the display data VM is divided into plural pieces of display mesh information VMx, each relating to an area. The display data VM is constituted from the plural pieces of display mesh information VMx continuously arranged in a matrix form. The display mesh information VMx may be further divided into plural pieces of display mesh information VMx to be contained in a lower layer, each relating to a smaller area. Each display mesh information VMx has a rectangular shape with each side thereof having a predetermined length, which is reduced relative to the actual geographic length according to the map scale. A predetermined corner thereof contains absolute coordinates ZP in the whole map information, e.g., a global map.

The display mesh information VMx is, for instance, constituted from name information VMxA, road information VMxB and background information VMxC. The name information VMxA is structured in a table for arranging and displaying miscellaneous element data such as intersection name and town name, namely an annotation Qi about a feature (i represents a natural number, see, for instance, FIG. 5), contained in an area at a predetermined position with reference to the positional relationship based on the absolute coordinates ZP. Herein, the annotation Qi includes: a symbol Ki (i represents a natural number, see for instance FIG. 6) located around a position of a feature (hereinafter referred to as a true position) Pi (i represents a natural number, see for instance FIG. 6), an annotation character string Wi (i represents a natural number, see for instance FIG. 5) for showing a description, a name or a detail of the feature, the annotation character string Wi located at the true position Pi or a position spaced from the true position Pi; an instruction point Ti (i represents a natural number, see for instance FIG. 7) located around the true position Pi; a leader line Ui (i represents a natural number, see for instance FIG. 7) as a graphic for connecting the instruction point Ti and the annotation character string Wi; and the like. Incidentally, the annotation character string Wi corresponds to a character of the present invention. As shown in FIG. 4, the name information VMxA includes annotation list data 160 (target object map information) having plural pieces of annotation data 170.

The annotation data 170 is information for displaying the annotation Qi. The annotation data 170 includes annotation true-position data 180, display character-string data 190 and the like.

The annotation true-position data 180 is data for appropriately displaying the annotation Qi. The annotation true-position data 180 has a single data structure that includes object ID (Identification) information 181, annotation character-string information 182 (character information), annotation character-number information 183, annotation type information 184, scale 1 display type information 185, scale 2 display type information 186, scale 3 display type information 187, scale 4 display type information 188, true-position shape information 189 (target object existing position information) also functioning as graphic information, etc.

The object ID information 181 is specific information for identifying the annotation true-position data 180. The annotation character-string information 182 is information for displaying the annotation character string Wi on the map. Specifically, the annotation character-string information 182 contains character information for displaying characters such as a place name like "MKWAKWANI", an intersection name like "Block C, Town AB" and a building name like "Hospital CD".

The annotation character-number information 183 is information showing the number of characters of the annotation character string Wi that is displayed based on the annotation character-string information 182. The annotation type information 184 is information showing a type (or a class) of an annotation Qi corresponding to the annotation true-position data 180. Specifically, the annotation type information 184 contains information showing a type of the annotation Qi such as an airport, a police station, a university, a shrine, a subway line name, a major intersection, a road number, road names of a high way, a local road and a national road, etc.

The scale 1 display type information 185 is information showing a display type of the annotation Qi in a case with a map scale of, for instance, 1:100000 (hereinafter, referred to as a scale 1) Specifically, the scale 1 display type information 185 contains information indicating which display type is employed: a non-display type, a character display type, a symbol-character display type, a leader-character display type or a symbol display type. The non-display type is a type for not displaying the annotation Qi. The character display type is a type for displaying only the annotation character string Wi. The symbol-character display type is a type for displaying the symbol Ki and the annotation character string Wi. The leader-character display type is a type for displaying the annotation character string Wi, the instruction point Ti and the leader line Ui. The symbol display type is a type for displaying only the symbol Ki. Incidentally, in the description below, when the display type for not displaying the annotation character string Wi (i.e., non-display type) and the symbol display type are expressed collectively, it will be referred to as a non-character display type. The scale 2 display type information 186 is information showing a display type of the annotation Qi in a case with a map scale of, for instance, 1:50000 (hereinafter, referred to as a scale 2) The scale 3 display type information 187 is information showing a display type of the annotation Qi in a case with a map scale of, for instance, 1:25000 (hereinafter, referred to as a scale 3) The scale 4 display type information 188 is information showing a display type of the annotation Qi in a case with a map scale of, for instance, 1:2500 (hereinafter, referred to as a scale 4)

Here, the display types shown by the scale 1 display type information 185, the scale 2 display type information 186, the scale 3 display type information 187 and the scale 4 display type information 188 are set in accordance with the type of the annotation type information 184. Specifically, when, for instance, the type indicated by the annotation type information 184 is an airport, the display type is set to the symbol-character display type in the scales 1 to 4. Specifically, when, for instance, the type indicated by the annotation type information 184 is a police box, the display type is set to the non-display type in scale 1 and the symbol display type in the scales 2 to 4. Incidentally, the scales of scales 1 to 4 may be other ones than those described above.

The true-position shape information 189 shows the true position Pi on the map. Specifically, the true-position shape information 189 contains information showing a latitude and a longitude corresponding to the true position Pi with, for instance, an X-coordinate and a Y-coordinate.

The display character-string data 190 is data for locating and displaying the annotation Qi at a predetermined position. The display character-string data 190 is updated by the processor 150. The display character-string data 190 has a single data structure containing object ID information 191, font size information 192, corresponding annotation character ID information 193, character string shape information (detail position information) and the like.

The object ID information 191 is specific information for identifying the display character-string data 190. The font size information 192 is information showing a font size of the annotation character string Wi when displayed on the map. Incidentally, when all the display types in scales 1 to 4 are set so as not to display the annotation character string Wi, namely when the non-display type or the symbol display type are selected, the font size information 192 may not be included in the display character-string data 190. The corresponding annotation character ID information 193 is specific information of the annotation true-position data 180 corresponding to the display character-string data 190, namely the same information as that contained in the object ID information 181.

The character string shape information 194 shows a position of a character area Hi (i represents a natural number, see for instance FIG. 5) of the annotation character string Wi with the font size thereof having been set by the font size information 192 and a position of the leader line Ui. Specifically, the character string shape information 194 contains information for showing coordinates of apices of the character area Hi and the leader line Ui. More specifically, when the character area Hi has a rectangular shape, coordinates of four apices are contained. When the character area Hi has a triangular shape, coordinates of three apices are contained. In addition, the character string shape information 194 contains coordinates of the character area Hi for each of the scales 1 to 4 that have been set to any display type of the character display type, the symbol-character display type and the leader-character display type. Specifically, for instance, when the scale 1 is set to the non-display type and the scales 2 to 4 are set to the character display type, the character string shape information 194 contains coordinates of the character areas Hi corresponding to scales 2 to 4. In addition, the character string shape information 194 contains coordinates of leader lines Ui that correspond to scales 1 to 4 with the display types having been set to the leader-character display type. The character string shape information 194 is updated by the processor 150. Note that when the character area Hi or the leader line Ui has a rectangular shape, the character string shape information 194 may contain only two coordinates of two apices on both ends of a diagonal line.

The road information VMxB is data structured in a table for locating and displaying road element data (e.g. a road) contained in an area at a predetermined position with reference to the positional relationship based on the absolute coordinates ZP. The background information VMxC is data structured in a table for locating and displaying miscellaneous element data (e.g. a mark and image information representing famous spots and buildings) at a predetermined position with reference to the positional relationship based on the absolute coordinates ZP.

The matching data MM, just like the display data VM, is divided into plural pieces of matching mesh information MMx, each having a specific number and relating to an area. The matching data MM is constituted from the plural pieces of matching mesh information MMx continuously arranged in a matrix form. The matching mesh information MMx may be further divided into plural pieces of matching mesh information MMx to be contained in a lower layer, each relating to a smaller area. Each matching mesh information MMx has a rectangular shape with each side thereof having a predetermined length, which is reduced relative to the actual geographic length according to the map scale. A predetermined corner thereof contains absolute coordinates ZP in the whole map information, e.g., a global map. The matching mesh information MMx and the display mesh information VMx may not necessarily represent the same area. That is, they may be divided according to different scales. If the same scale is used, specific number information may be used for associating the data. If different scales are used, the absolute coordinates may be used for associating the data. The matching data MM has plural pieces of link string block information.

As shown in FIG. 3, the link string block information is data structured in a table so that a plurality of links L are mutually associated according to a predetermined rule. The link L as segment information represents a road and connects nodes N as the point information. Specifically, the links L each corresponding to a predetermined length of a road are mutually connected to form polygonal lines (i.e. link strings), which represent continuous roads such as Koshu street and Ome street. Each link L has segment-specific information as a specific number assigned to each link L and node information as a specific number indicating two nodes N connected by the link L.

Each node N represents a joint point such as an intersection, a corner, a fork, a junction or the like of each road. Information about the node N has point-specific information as a specific number assigned to each node N in the link string block information, coordinate information of the position where each node N is located, and flag information as branching information describing whether or not the node N represents a branching position (e.g. intersection, fork) where a plurality of links are crossed. Some nodes N only have the point-specific information and the coordinate information without the flag information for simply representing the shape of a road, and some nodes N additionally have attribute information representing the road structure such as width of a tunnel or a road.

The symbol related information is information about the symbol Ki. The symbol related information has a single data structure containing symbol information, symbol type information, symbol shape size information and the like. Note that the symbol related information may not contain the symbol information. Here, the annotation character-string information 182 and the symbol information constitute detail information of the present invention. The annotation data 170 and the symbol information constitute target object association information of the present invention.

The symbol information is information for displaying the symbol Ki. The symbol type information shows a type (or a class) of a feature that is shown by the symbol information. Specifically, the symbol type information contains similar information to the annotation type information 184 of the annotation true-position data 180. The symbol shape size information is information for showing a shape size of the symbol Ki when it is displayed. Specifically, the symbol shape size information contains the shape size of the symbol Ki using a point as a typical unit showing a size of a letter.

The memory 140 readably stores the settings that are input at the input section 110. The memory 140 readably stores various programs and the like that run on an OS (Operating System) for entirely controlling the map information generating device 100. The memory 140 may preferably be a CMOS (Complementary Metal-Oxide Semiconductor) memory that retains the stored data even in the case of a sudden power interruption caused by a blackout. The memory 140 may include drives or drivers for readably storing data in a storing medium such as a HD, a DVD, and an optical disc.

The processor 150 has various input/output ports (not shown) such as a key input port connected to the input section 110, a display control port connected to the display 120, a storage port connected to the storage section 130, a memory port connected to the memory 140 and the like. As shown in FIG. 1, the processor 150 includes as various programs a movable region setting section (a region setting section) 151 also functioning as a new detail information acquirer and a new target object position recognizer, a location adjusting processor (a detail position setting section) 152 also functioning as a target map information acquirer and an existing detail position recognizer, an annotation data updating section (an update processor) 153 also functioning as a detail position information generator, and so on. Note that, in the description below, an annotation Qi with its locatable position being subjected to adjustment is referred to as a location adjusting annotation Qk (k represents a natural number) while an annotation Qi with its locatable position not being subjected to adjustment is referred to as an existing annotation Qj (j represents a natural number other than k).

As shown in FIGS. 5 to 7, the movable region setting section 151 sets movable regions EAk, EBk and ECk (k respectively represents a natural number) as a region in which an annotation character string (hereinafter, referred to as a location-adjusting-annotation character string) of the location adjusting annotation Qk of a feature in a predetermined area D shown by the name information VMxA. Specifically, the movable region setting section 151 acquires the annotation data 170 for displaying the location adjusting annotation Qk about a feature that is newly built. Here, the movable region setting section 151 acquires annotation data 170 with its character string shape information 194 containing no information. Incidentally, the annotation data 170 may be generated based on the input operation at the input section 110 or may be generated by an annotation data generator (not shown). Based on the true-position shape information 189 of the annotation true-position data 180 of the acquired annotation data 170, the movable region setting section 151 recognizes a true position Pk of a location-adjusting-annotation character string Wk of the location adjusting annotation Qk. The movable region setting section 151 then computes and recognizes a shape of a character area Hk (hereinafter, referred to as an adjustment character area) of the location-adjusting-annotation character string Wk based on the annotation character-number information 183 and the font size information 192 of the display character-string data 190.

Then, when, for instance, recognizing that the display type of the location adjusting annotation Qk is the character display type based on the scale 1 display type information 185, the movable region setting section 151 sets the movable region EAk for the character display type as shown in FIG. 5. Here, in FIG. 5, a rightward direction corresponds to a plus direction of the X-coordinate, a leftward direction corresponds to a minus direction of the X-coordinate, a downward direction corresponds to a plus direction of the Y-coordinate and an upward direction corresponds to a minus direction of the Y-coordinate. The movable region EAk has a rectangle shape having lengths in a right-left direction and an up-down direction respectively twice as long as those of the adjustment character area Hk. Further, the movable region EAk is so set that the true position Pk is positioned at the center thereof.

When recognizing that the display type of the location adjusting annotation Qk is the symbol-character display type, the movable region setting section 151 sets a movable region EBk for the symbol-character display type as shown in FIG. 6. The movable region EBk has a rectangle shape having a length in a right-left direction thereof twice as long as a length including the right-left direction of the adjustment character area Hk, the radius length of a symbol Kk and a predetermined distance J1, while having a length in an up-down direction thereof twice as long as a length including a length in the up-down direction of the adjustment character area Hk, the radius length of the symbol Kk and the predetermined distance J1. Further, the movable region EBk is so set that the true position Pk is positioned at the center thereof.

When recognizing that the display type of the location adjusting annotation Qk is the leader-character display type, the movable region setting section 151 sets a movable region ECk for the leader-character display type as shown in FIG. 7. The movable region ECk has a rectangle shape having lengths in a right-left direction thereof twice as long as a length including a length in the right-left direction of the adjustment character area Hk, the radius length of an instruction point Tk and a predetermined distance J2, while having the up-down direction thereof twice as long as a length including the up-down direction of the adjustment character area Hk, the radius length of the instruction point Tk and the predetermined distance J2. Further, the movable region ECk is so set that the true position Pk is positioned at the center thereof.

Shapes of the movable regions EAk, EBk and ECk may not be a rectangle but may be a circle, an ellipse and other polygons. The movable region EBk has a rectangular shape with the distance J1 being 0. The movable regions EBk and ECk may also have rectangular shapes each having a length in the right-left direction thereof twice as long as a length including the length in the right-left direction of the adjustment character area Hk, the radius length of a symbol Kk and the predetermined distance J1, while having a length in the up-down direction thereof twice as long as a length including the length in the up-down direction of the adjustment character area Hk, the radius length of the symbol Kk and a predetermined distance J3.

The location adjusting processor 152 locates the location-adjusting-annotation character string Wk of the character display type in such manners that the true position Pk is positioned at the center of the adjustment character area Hk and that an existing annotation (hereinafter, referred to as an overlapped existing annotation) Qj that overlaps with the adjustment character area Hk does not exist. Further, the location adjusting processor 152 locates the location-adjusting-annotation character strings Wk of the character display type and the symbol-character display type such that one or two sides of the adjustment character area Hk are overlapped with corresponding sides of the movable regions EAk and EBk and that the overlapped existing annotation Qj that overlaps with the adjustment character area Hk does not exist. In other words, the location-adjusting-annotation character string Wk is located such that the entire adjustment character area Hk is positioned in the movable regions HAk and HBk and that the overlapped existing annotation Qj does not exist. Further, the location adjusting processor 152 locates the location-adjusting-annotation character strings Wk of the leader-character display type such that one or two sides of the adjustment character area Hk are overlapped with corresponding sides of the movable region ECk and that the overlapped existing annotation Qj that overlaps with the adjustment character area Hk and a leader line Uk does not exist. In the description below, the state where the location-adjusting-annotation character string Wk is located in the movable region EAk, EBk or ECk will be referred to as an in-region location state.

Specifically, when recognizing that the location adjusting annotation Qk is the character display type, the location adjusting processor 152 locates the location-adjusting-annotation character string Wk so that the true position Pk is positioned at the center of the adjustment character area Hk Then, the location adjusting processor 152 locates the existing annotation Qj at a position based on the annotation data 170 of the existing annotation Qj. When recognizing that the overlapped existing annotation Qj that overlaps with the adjustment character area Hk does not exist, the location adjusting processor 152 sends a location completion signal to the annotation data updating section 153. On the other hand, when recognizing that the overlapped existing annotation exists, the location adjusting processor 152 determines whether or not the location-adjusting-annotation character string Wk can be located in the movable region EAk for the character display type. When recognizing that the location-adjusting-annotation character string Wk can be located in the in-region location state, the location adjusting processor 152 outputs the location completion signal. Further, when recognizing that the location adjusting annotation Qk is the symbol-character display type, the location adjusting processor 152 determines whether or not the location-adjusting-annotation character string Wk can be located in the movable region EBk for the symbol-character display type. When recognizing that the location-adjusting-annotation character string Wk can be located in the in-region location state, the location adjusting processor 152 outputs the location completion signal. Still further, when recognizing that the location adjusting annotation Qk is the leader-character display type, the location adjusting processor 152 determines whether or not the location-adjusting-annotation character string Wk can be located in the movable region ECk for the leader-character display type. When recognizing that the location-adjusting-annotation character string Wk can be located in the in-region location state, the location adjusting processor 152 outputs the location completion signal.

When recognizing that the location-adjusting-annotation character string Wk cannot be located in the movable region EAk, the location adjusting processor 152 determines that it cannot locate all annotations Qi so as not to overlap with each other by adjusting the location-adjusting-annotation character string Wk. Then, the location adjusting processor 152 locates the location-adjusting-annotation character string Wk at a predetermined position in the movable region EAk and outputs the location completion signal. At the same time, the location adjusting processor 152 recognizes an annotation character string Wj (hereinafter, referred to as an overlapped-existing-annotation character string) that overlaps with the located location-adjusting-annotation character string Wk. The location adjusting processor 152 operates the movable region setting section 151 to set movable regions EAj, EBj and ECj for the overlapped-existing-annotation character string Wj. The location adjusting processor 152 then performs relocation processing for locating the overlapped-existing-annotation character string Wj in the movable regions EAj, EBj and ECj, and when recognizing that the overlapped-existing-annotation character string Wj can be located in the in-region location state, outputs the location completion signal. The location adjusting processor 152 repeats the above-described processing until all of the annotations Qj are located so as not to overlap with each other. Meanwhile, when recognizing that the location-adjusting-annotation character string Wk cannot be located in the movable regions EBk and ECk, the location adjusting processor 152 performs the relocation processing of the overlapped-existing-annotation character string Wj described above. Incidentally, since a symbol Kj and an instruction point Tj of the overlapped existing annotation Qj represents a position of the feature, they are not subjected to the relocation.

The annotation data updating section 153 updates the annotation data 170 so as to reflect the location states of the location-adjusting-annotation character string Wk and the overlapped-existing-annotation character string Wj having been located by the location adjusting processor 152. In other words, the annotation data updating section 153 updates the annotation data 170 so as to display the map in which all of the annotations Qi are not overlapped with each other. Specifically, upon acquiring from the location adjusting processor 152 the location completion signal indicating that the location-adjusting-annotation character string Wk has been located, the annotation data updating section 153 recognizes the coordinate of the adjustment character area Hk at this time. Then, by recognizing a scale for displaying the location-adjusting-annotation character string Wk, the annotation data updating section 153 associates information about the scale with the coordinate of the adjustment character area Hk, which is then recorded in the character string shape information 194. Upon acquisition of the location completion signal indicating that the overlapped-existing-annotation character string Wj is located, the annotation data updating section 153 records the information about the scale and the coordinate of a character area Hj in the character string shape information 194. Then, the annotation data updating section 153 recognizes coordinates of leader lines Uk and Uj corresponding to the location states of the location-adjusting-annotation character string Wk and the overlapped-existing-annotation character string Wj, which is then recorded in the character string shape information 194 of this overlapped-existing-annotation character string Wj. The annotation data 170 with the character string shape information 194 having been updated is stored in the storage section 130.

[Operation of Map Information Generating Device]

Figure 8:
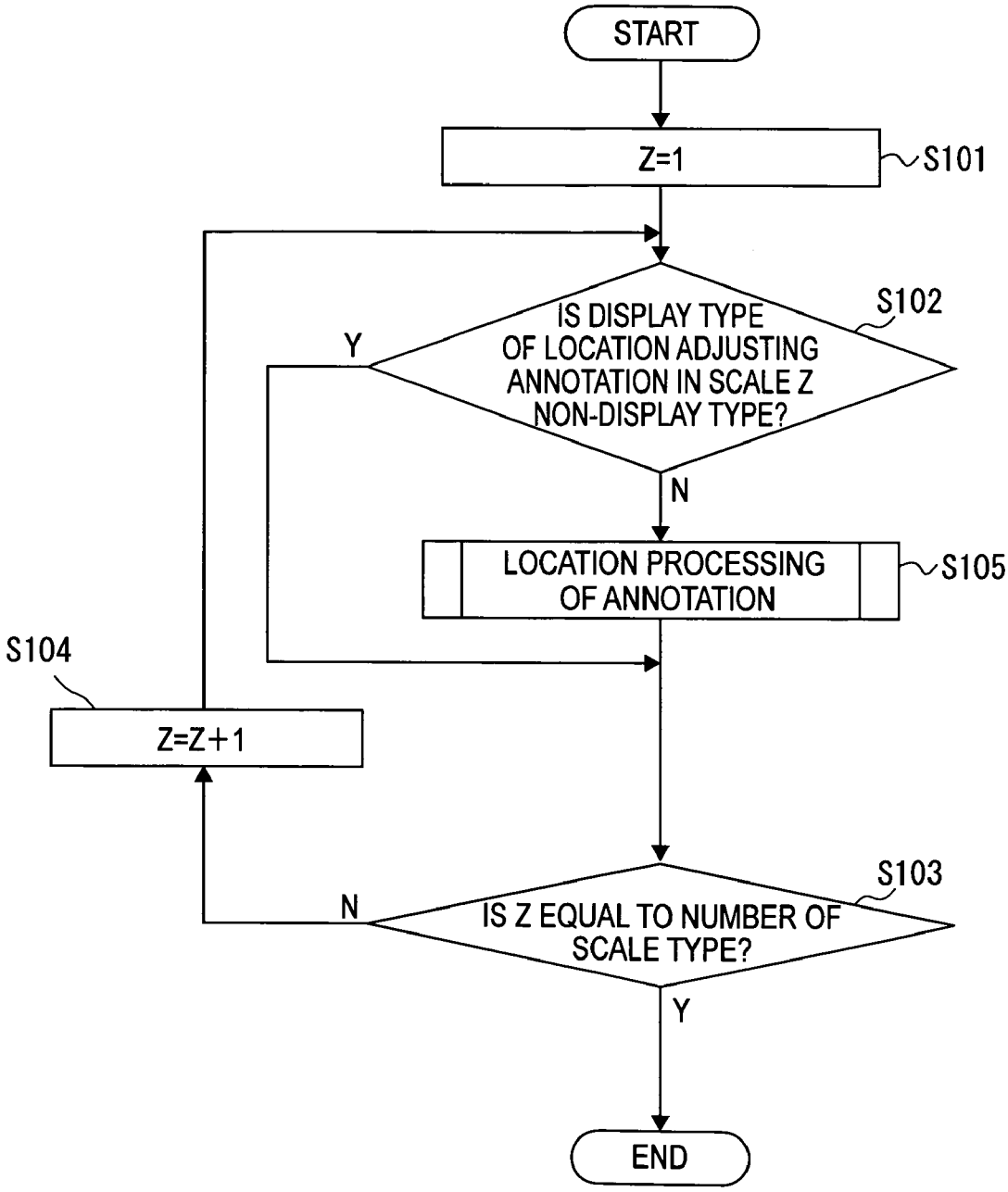
FIG. 8 is a flowchart showing update processing of annotation data in accordance with an additional location of a location adjusting annotation in the first embodiment.
Figure 9:
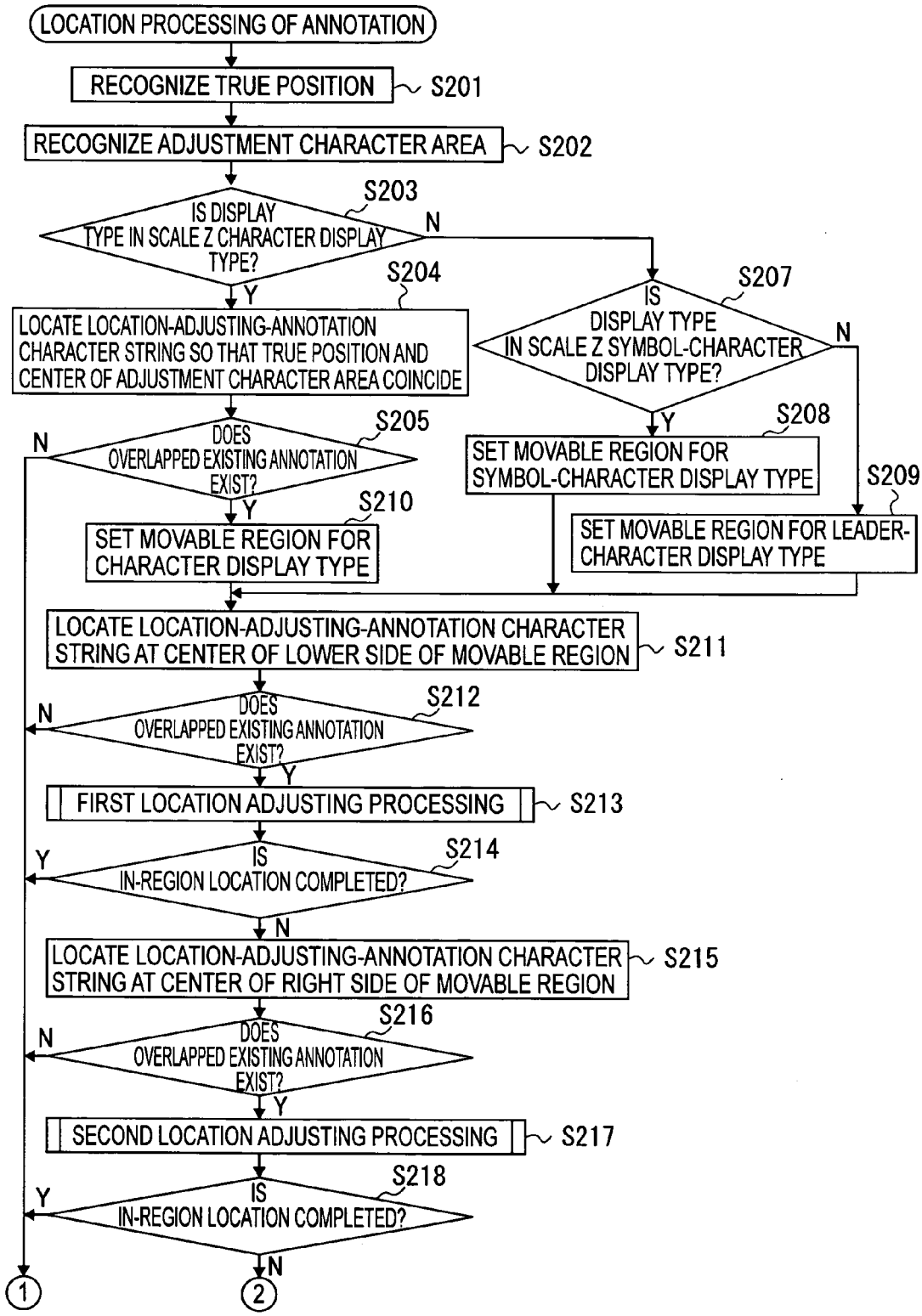
FIG. 9 is a flowchart showing location processing of an annotation in the first embodiment.
Figure 10:
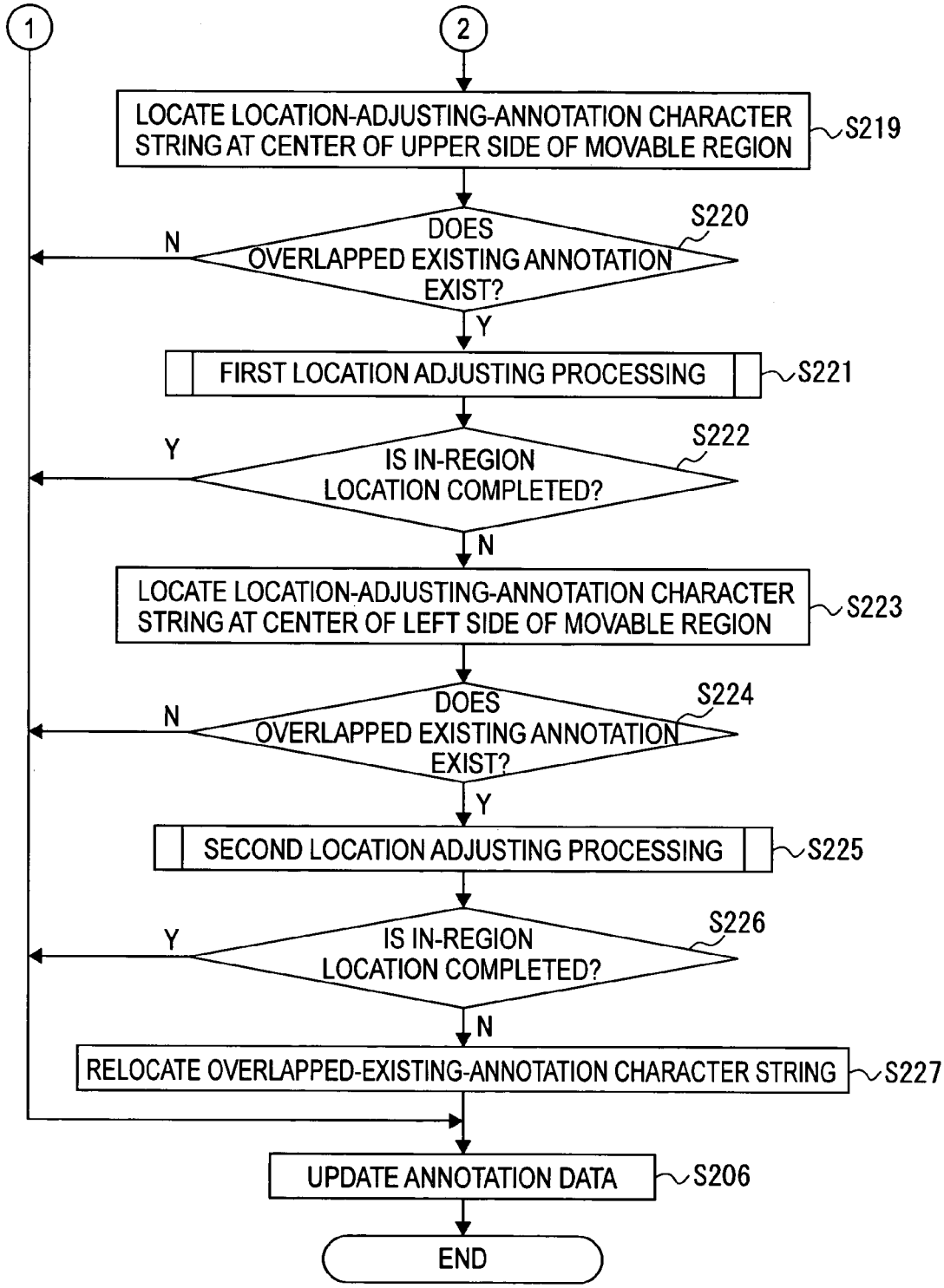
FIG. 10 is another flowchart showing the location processing of an annotation in the first embodiment.
Figure 11:
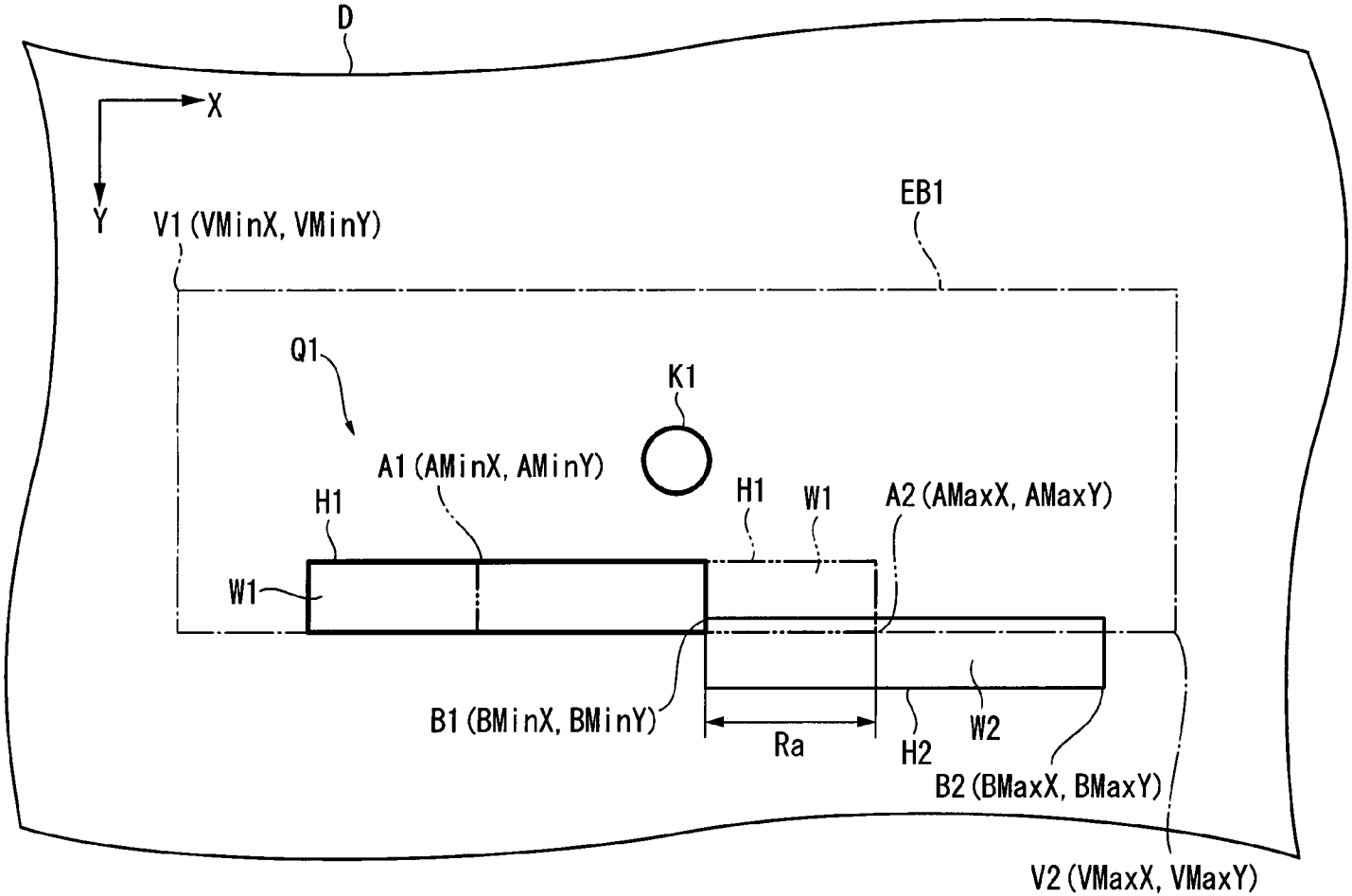
FIG. 11 is a schematic diagram showing a state where a location-adjusting-annotation character string of a symbol-character display type in a right position state is located in a in-region location state by first location adjusting processing in the first embodiment.
Figure 12:
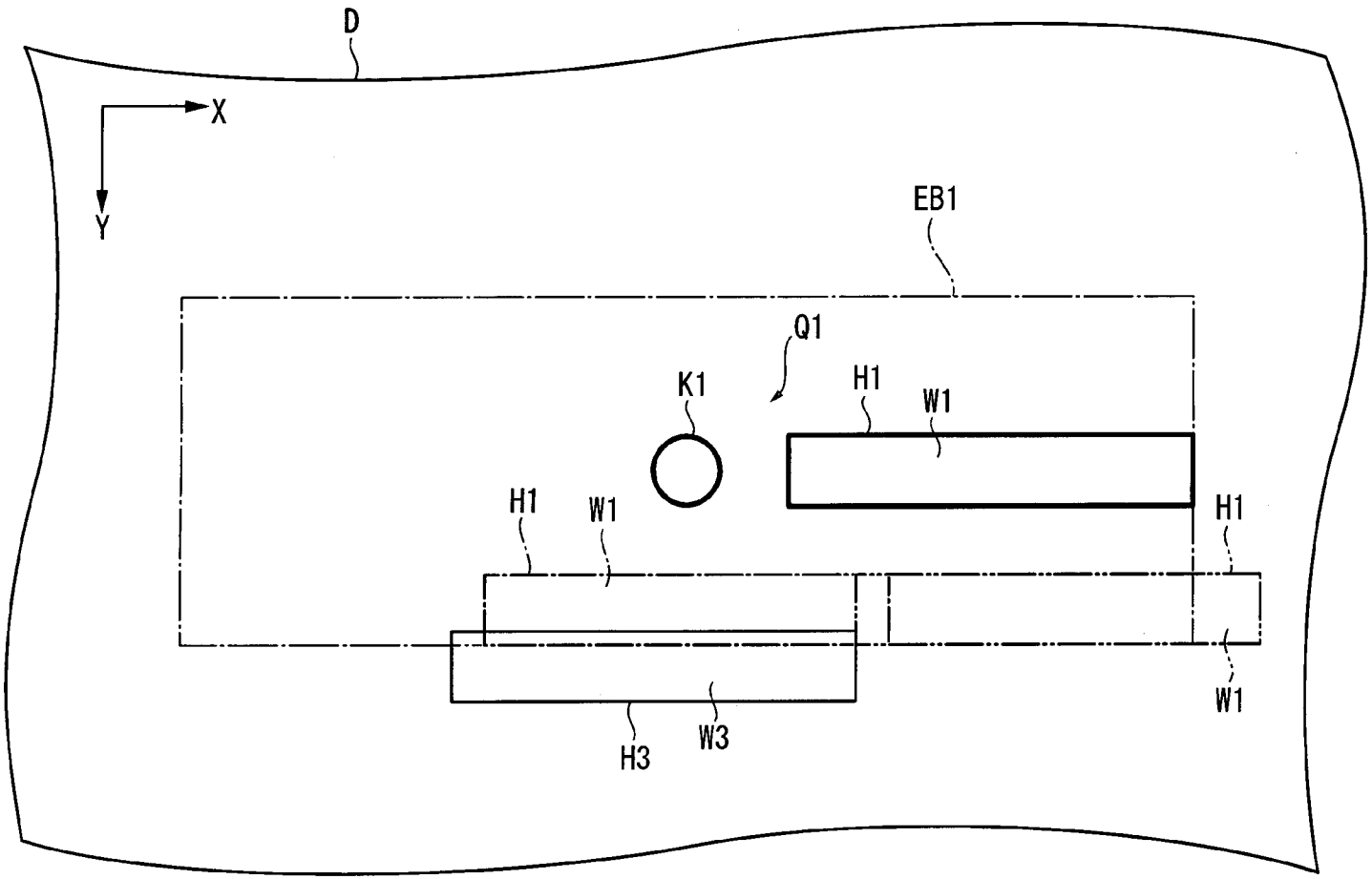
FIG. 12 is a schematic diagram showing a state where the location-adjusting-annotation character string of a symbol-character display type in a left position state is located in the in-region location state at the center of a right side of the movable region in the first embodiment.
Figure 13:
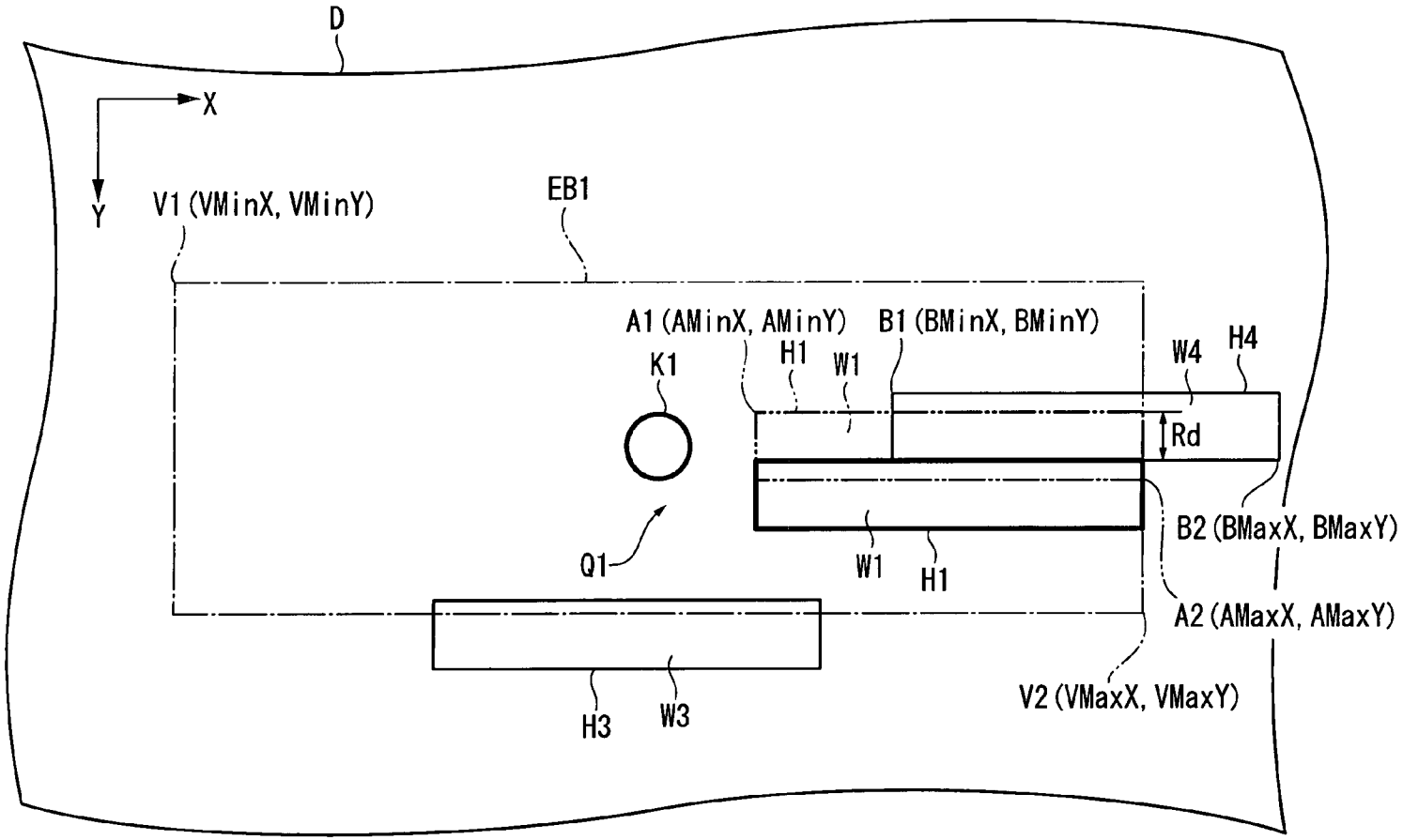
FIG. 13 is a schematic diagram showing a state where the location-adjusting-annotation character string of the symbol-character display type in an upper position state is located in the in-region location state by a second location adjusting processing in the first embodiment.
Figure 14:
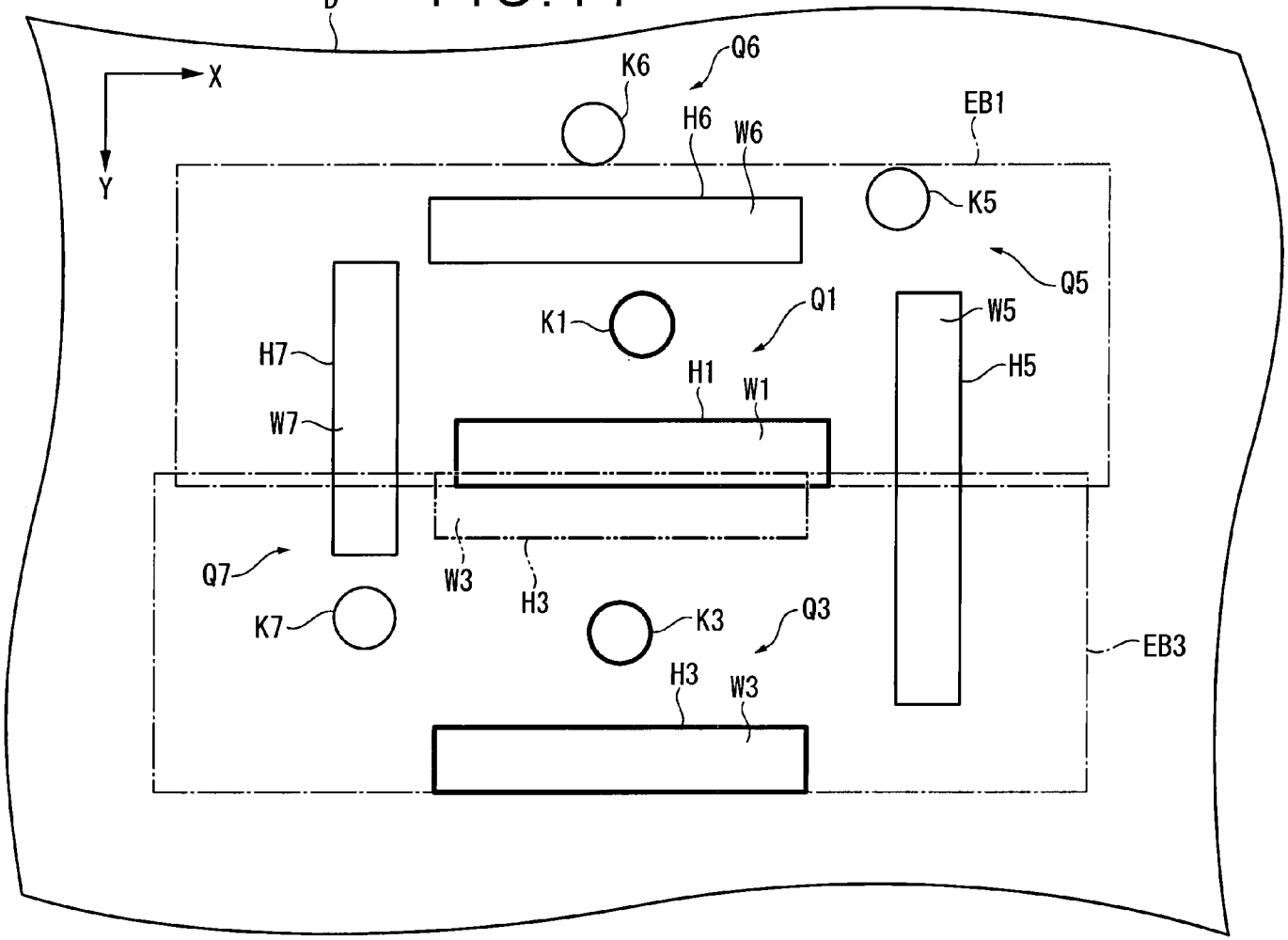
FIG. 14 is a schematic diagram showing a state where an overlapped-existing-annotation character string is relocated in the first embodiment.
Figure 15:
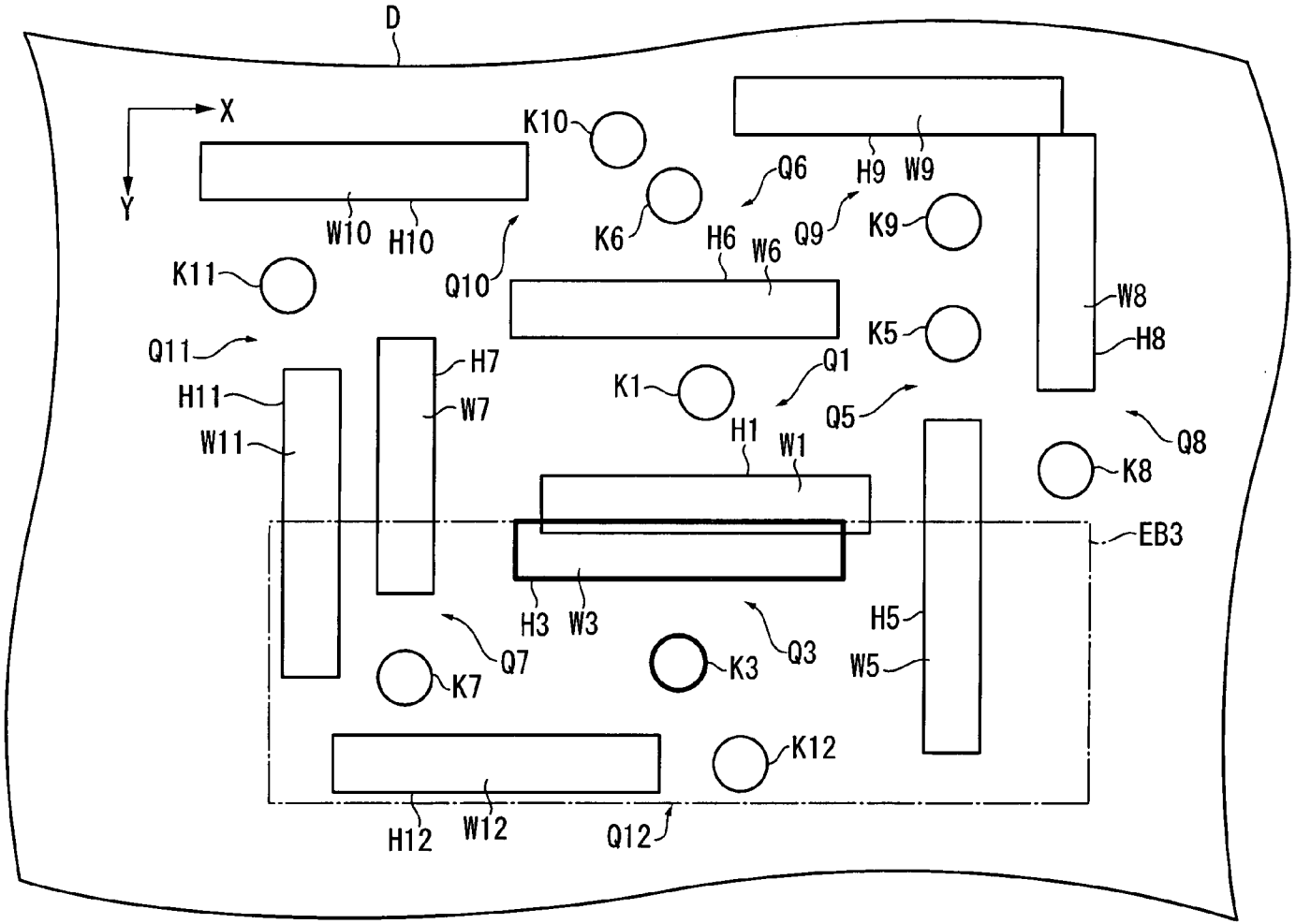
FIG. 15 is a schematic diagram showing a state before the overlapped-existing-annotation character string is relocated in the first embodiment.
Figure 16:
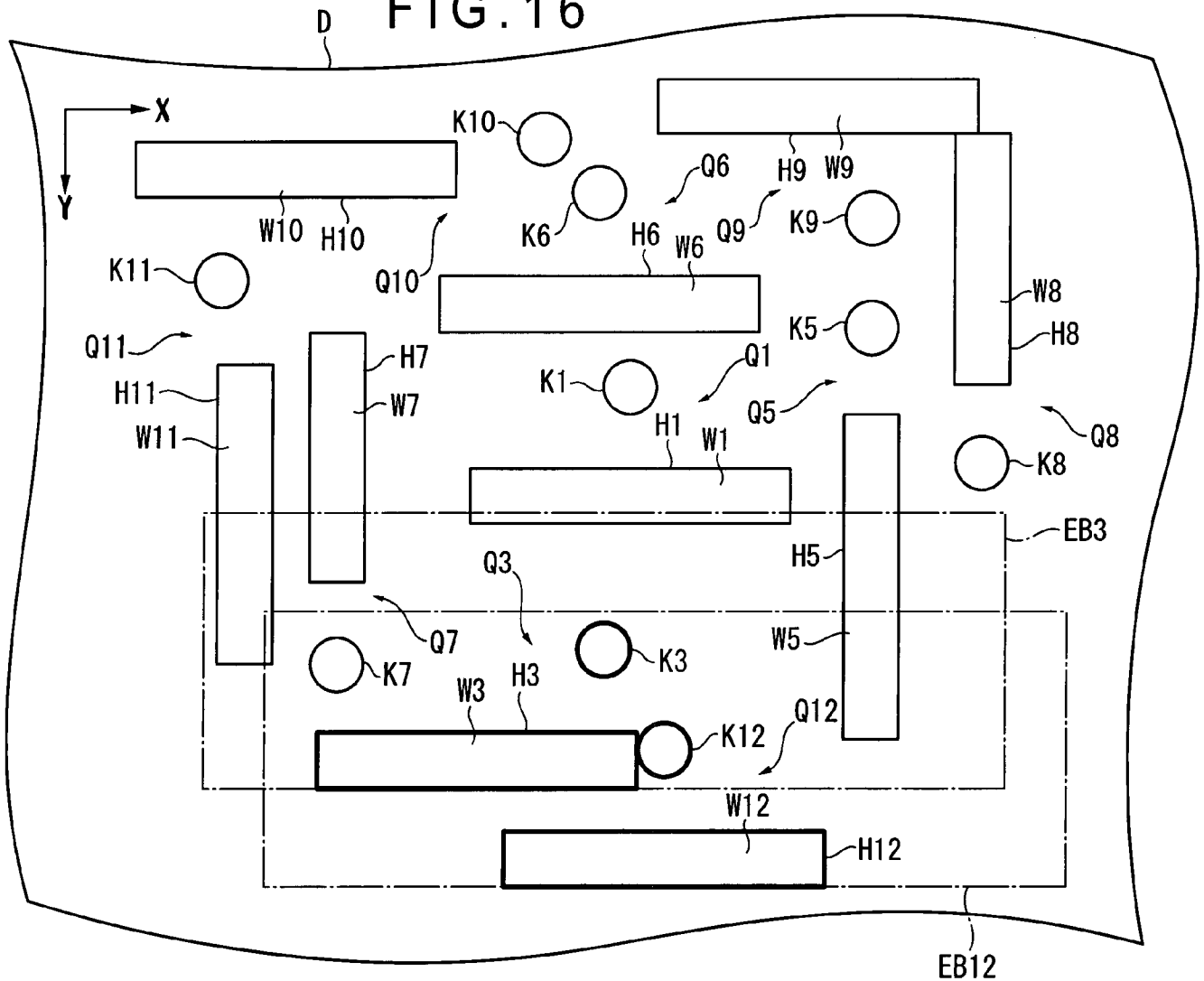
FIG. 16 is a schematic diagram showing a state where the overlapped-existing-annotation character string is relocated from the state shown in FIG. 15 in the first embodiment.
Figure 17:
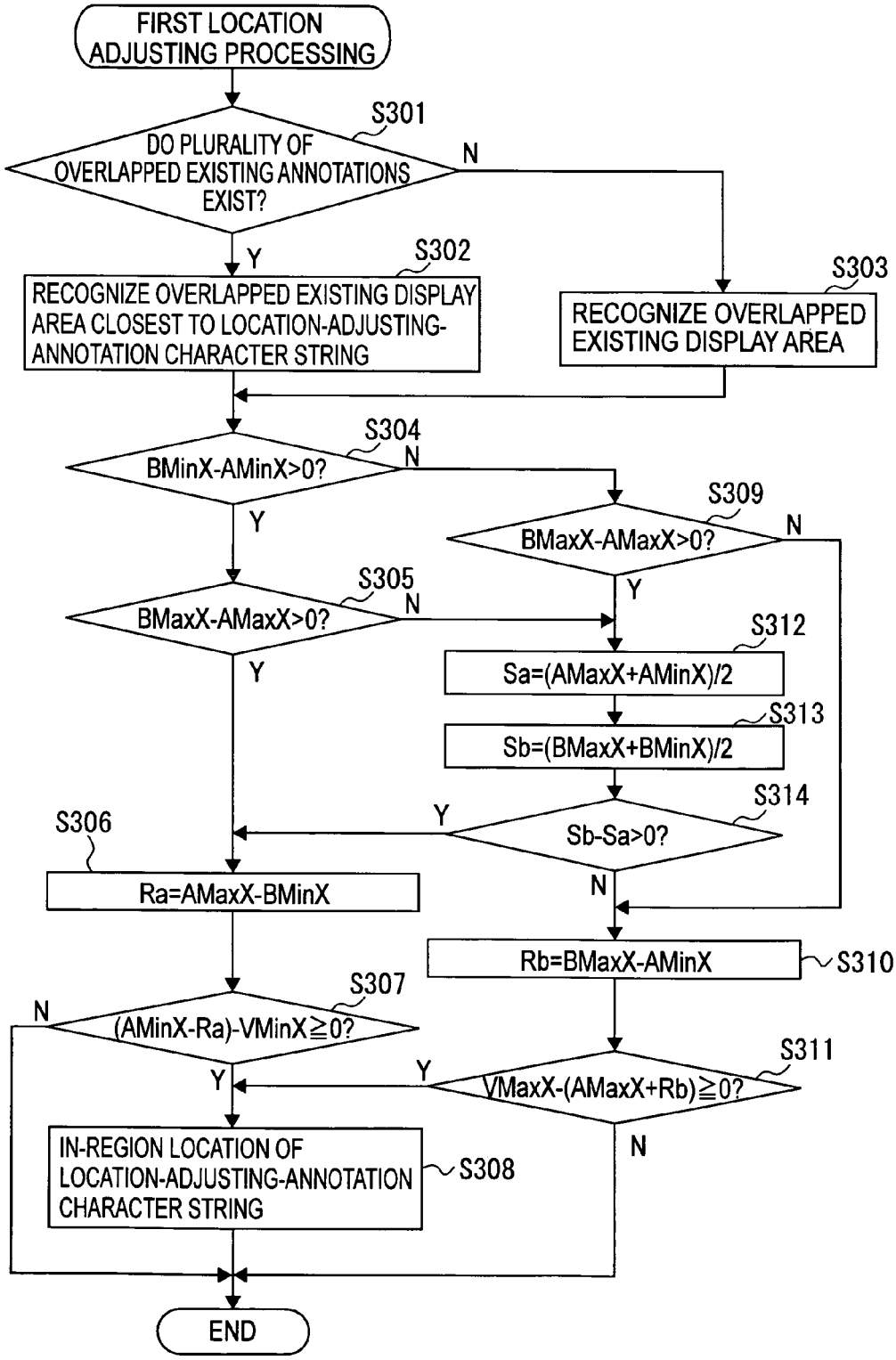
FIG. 17 is a flowchart showing the first location adjusting processing in the first embodiment.
Figure 18:
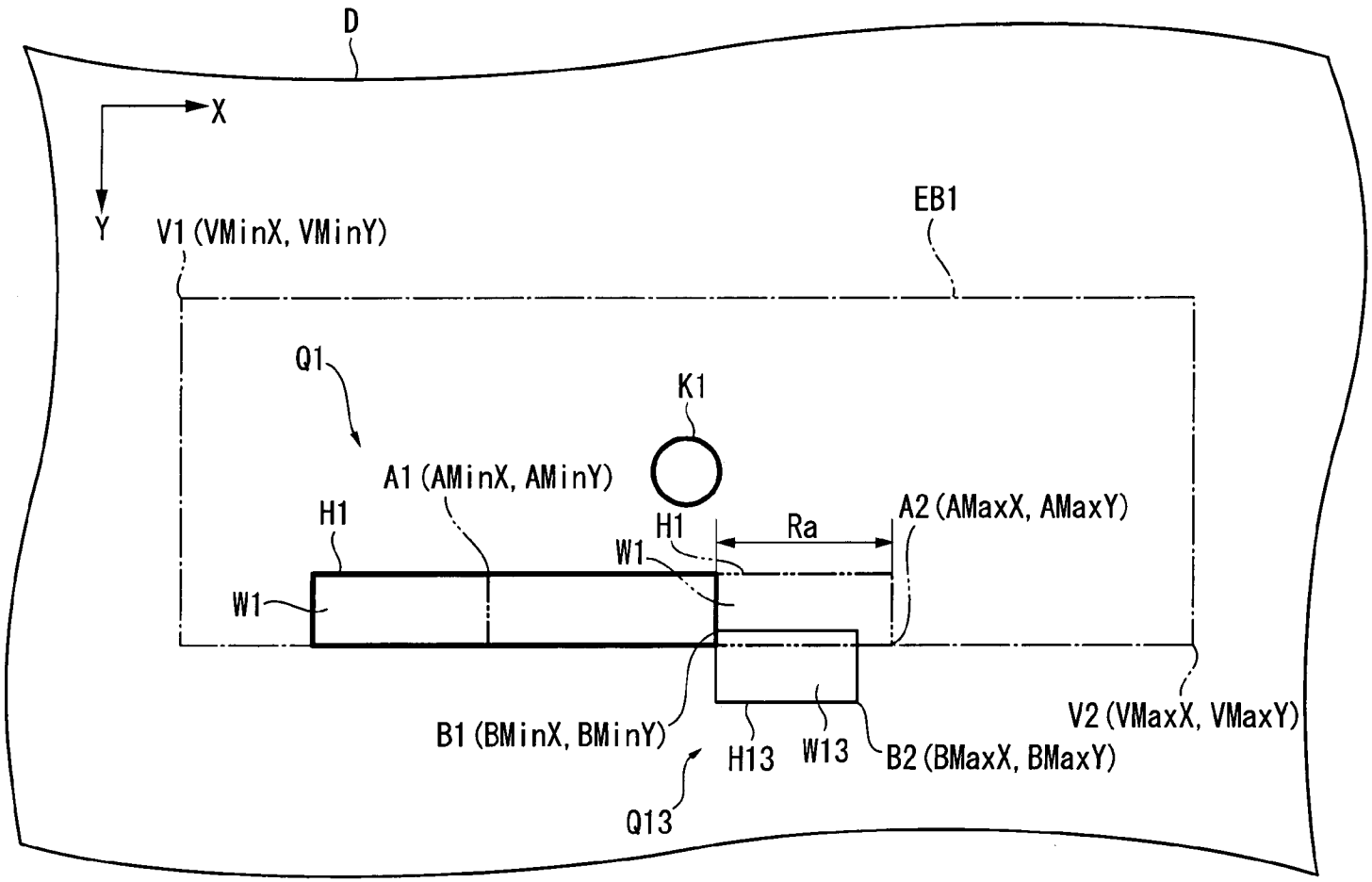
FIG. 18 is a schematic diagram showing a state where the location-adjusting-annotation character string of the symbol-character display type in an a right/left inner position state is located in the in-region location state by the first location adjusting processing in the first embodiment.
Figure 19:
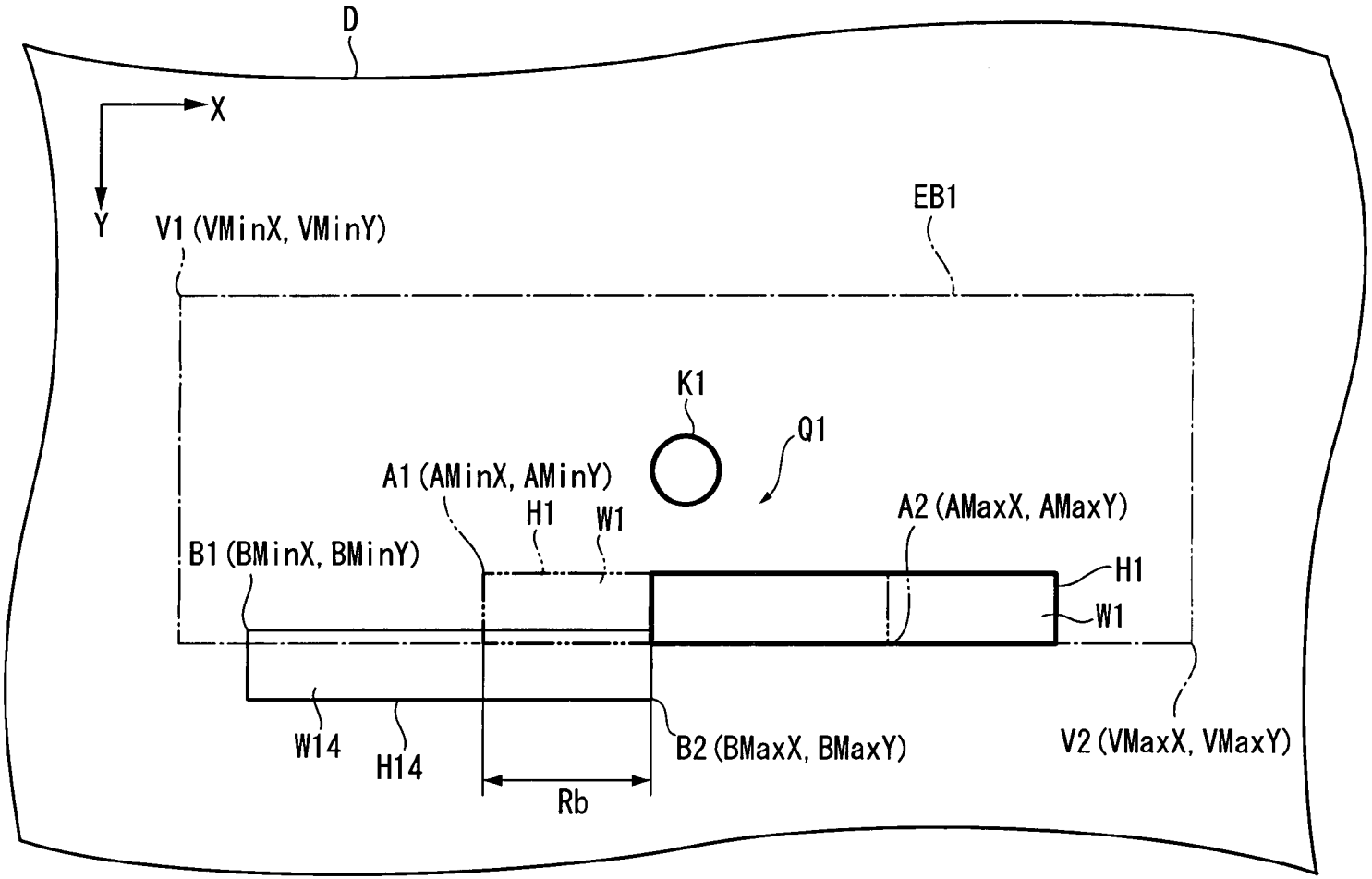
FIG. 19 is a schematic diagram showing a state where the location-adjusting-annotation character string of the symbol-character display type in a left position state is located in the in-region location state by the first location adjusting processing in the first embodiment.
Figure 20:
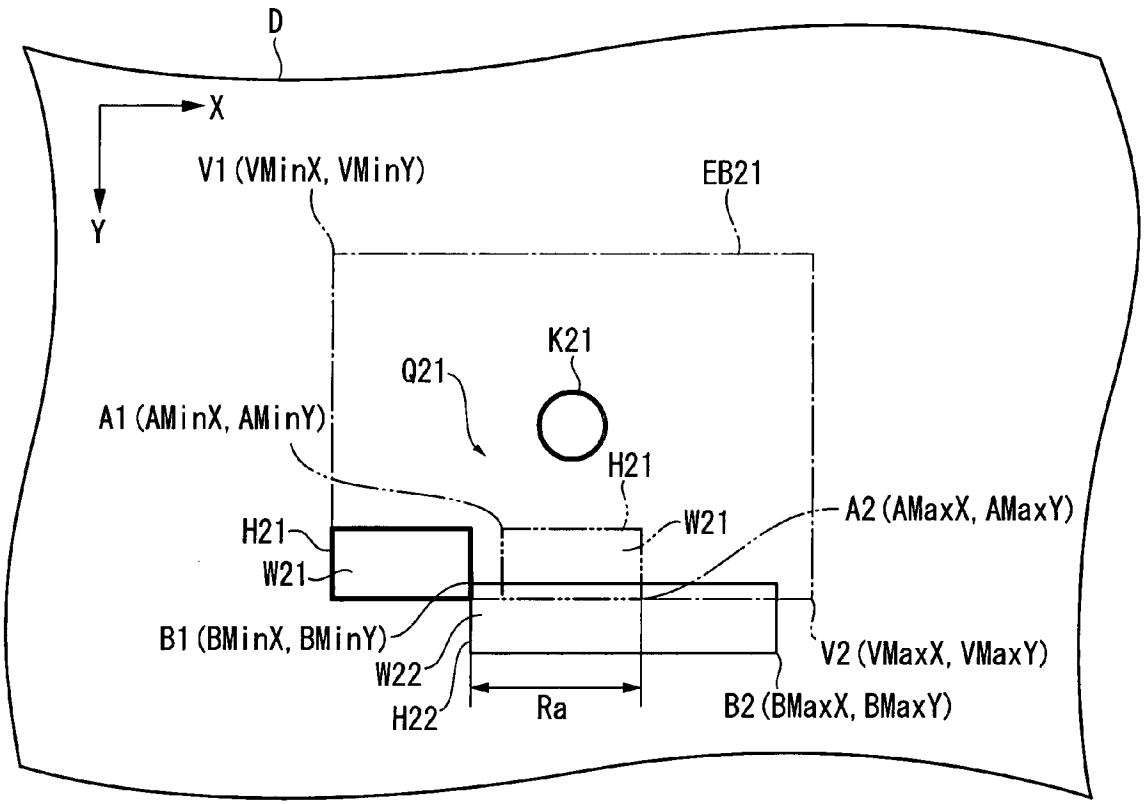
FIG. 20 is a schematic diagram showing a state where the location-adjusting-annotation character string of the symbol-character display type in a right/left outer position state is located in the in-region location state by the first location adjusting processing in the first embodiment.
Figure 21:
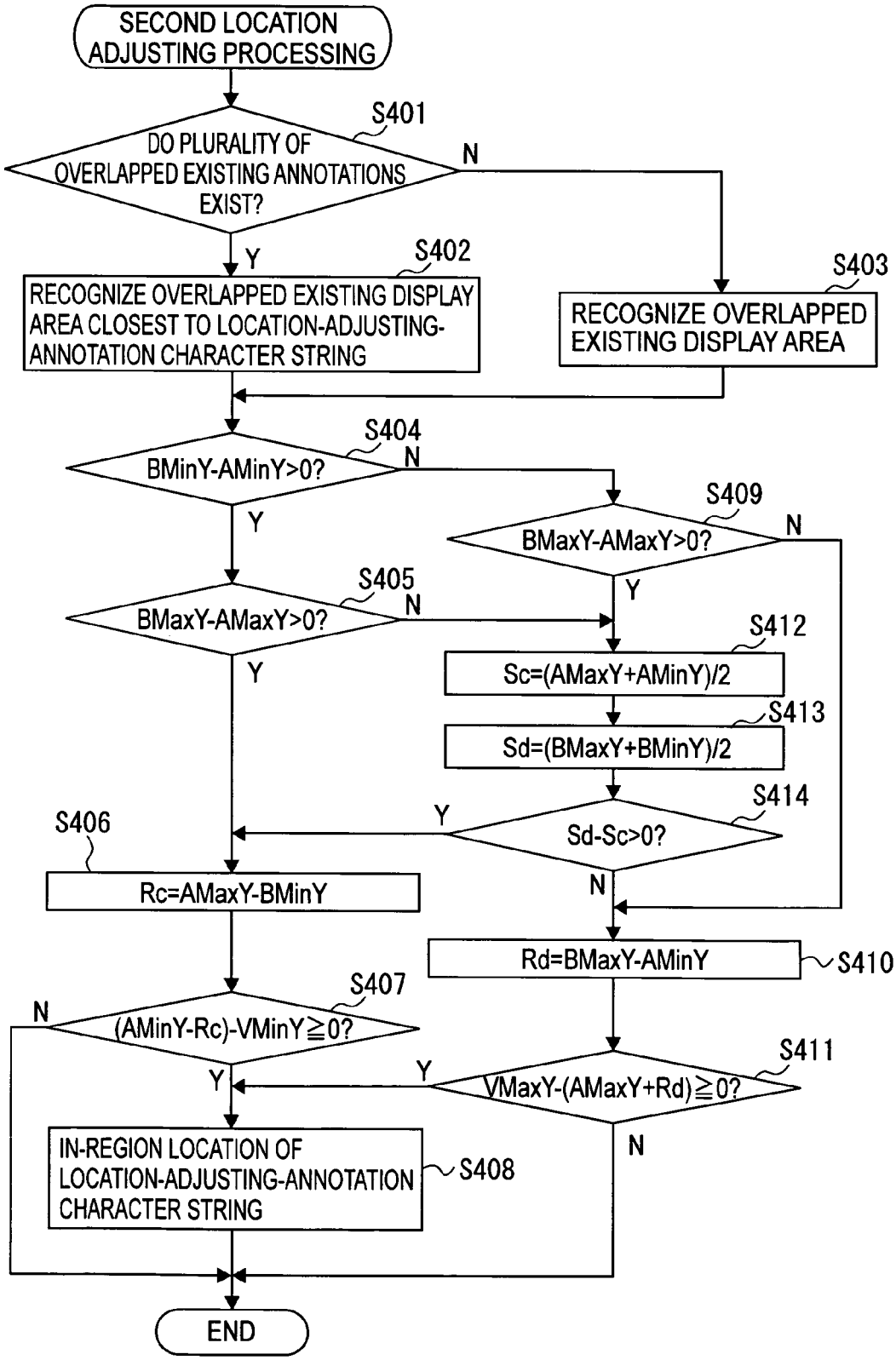
FIG. 21 is a flowchart showing second positioning adjustment processing of an annotation in the first embodiment.
Figure 22:
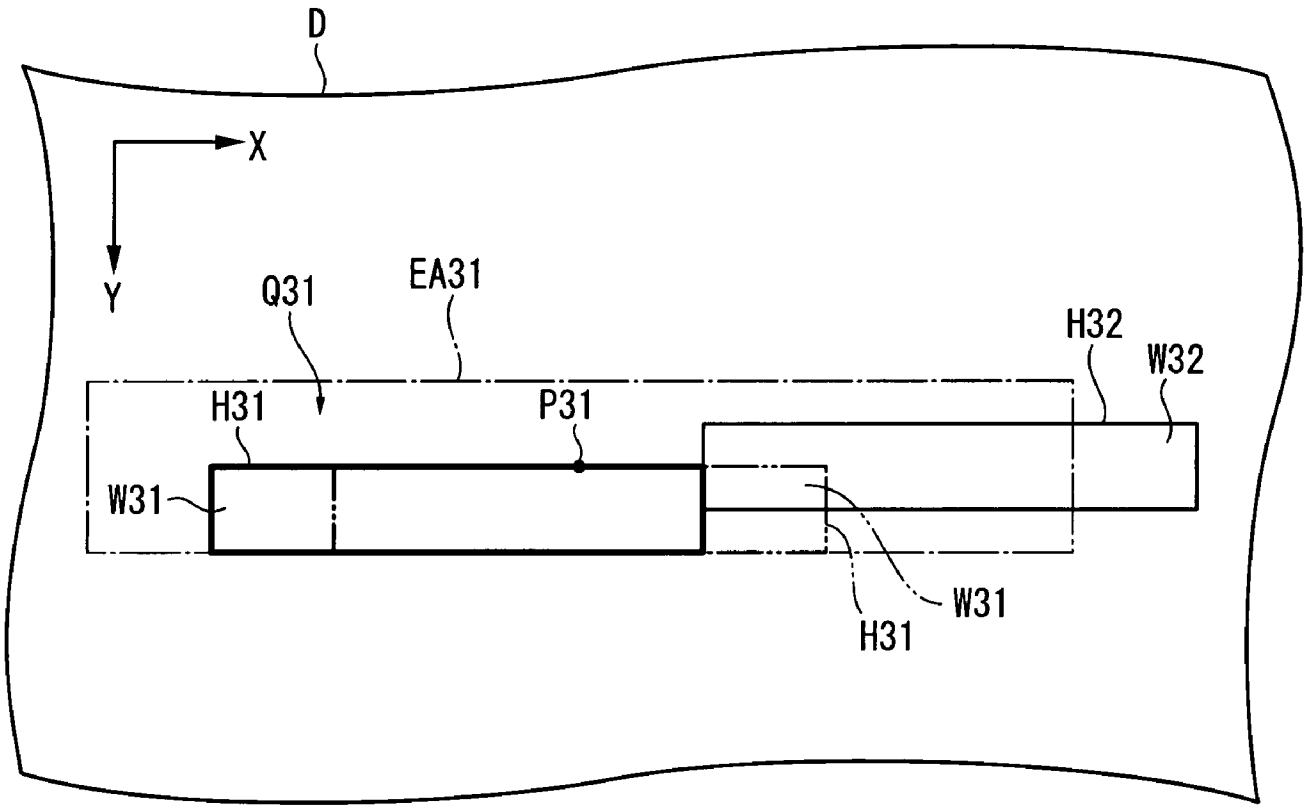
FIG. 22 is a schematic diagram showing a state where the location-adjusting-annotation character string of the character display type in a right position state is located in the in-region location state by the first location adjusting processing in the first embodiment.
Figure 23:
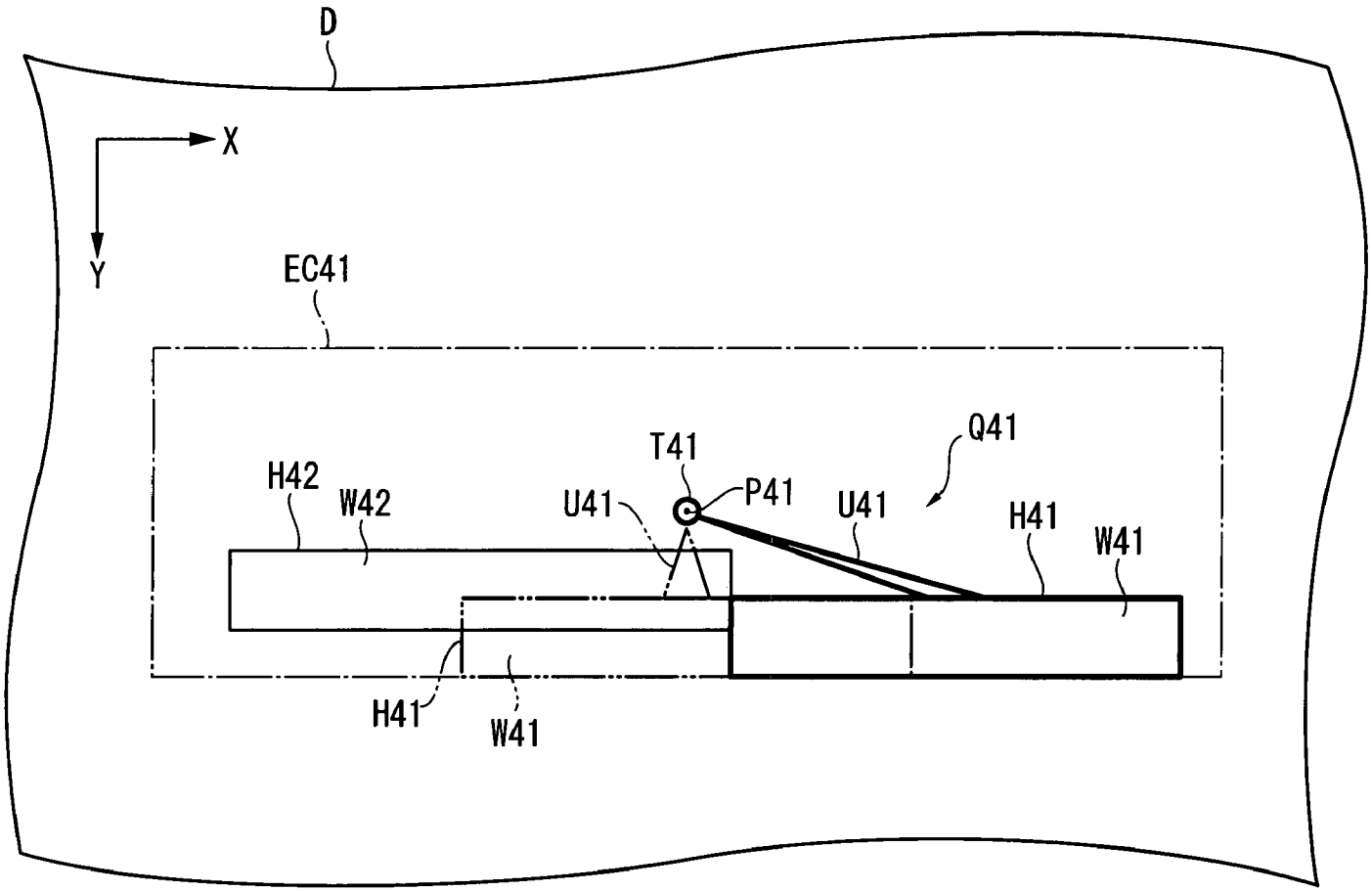
FIG. 23 is a schematic diagram showing a state where a location-adjusting-annotation character string of a leader-character display type in a right position state is located in the in-region location state by the first location adjusting processing in the first embodiment.

Next, as an operation of the map information generating device 100, update processing of annotation data in accordance with an additional location of a location adjusting annotation Qk will be described with reference to the drawings. FIG. 8 is a flowchart showing the update processing of the annotation data in accordance with the additional location of the location adjusting annotation. FIGS. 9 and 10 are flowcharts each showing the location processing of the annotation. FIG. 11 is a schematic diagram showing a state where the location-adjusting-annotation character string of the symbol-character display type in a right position state is located in the in-region location state by a first location adjusting processing. FIG. 12 is a schematic diagram showing a state where the location-adjusting-annotation character string of the symbol-character display type in a left position state is located in the in-region location state at the center of a right side of the movable region. FIG. 13 is a schematic diagram showing a state where the location-adjusting-annotation character string of the symbol-character display type in an upper position state is located in the in-region location state by a second location adjusting processing. FIG. 14 is a schematic diagram showing a state where the overlapped-existing-annotation character string is relocated. FIG. 15 is a schematic diagram showing a state before the overlapped-existing-annotation character string is relocated. FIG. 16 is a schematic diagram showing a state where the overlapped-existing-annotation character string is relocated from the state shown in FIG. 15. FIG. 17 is a flowchart showing the first location adjusting processing. FIG. 18 is a schematic diagram showing a state where the location-adjusting-annotation character string of the symbol-character display type in a right/left inner position state is located in the in-region location state by the first location adjusting processing. FIG. 19 is a schematic diagram showing a state where the location-adjusting-annotation character string of the symbol-character display type in a left position state is located in the in-region location state by the first location adjusting processing. FIG. 20 is a schematic diagram showing a state where the location-adjusting-annotation character string of the symbol-character display type in a right/left outer position state is located in the in-region location state by the first location adjusting processing. FIG. 21 is a flowchart showing the second location adjusting processing. FIG. 22 is a schematic diagram showing a state where the location-adjusting-annotation character string of the character display type in a right position state is located in the in-region location state by the first location adjusting processing. FIG. 23 is a schematic diagram showing a state where the location-adjusting-annotation character string of the leader-character display type in a right position state is located in the in-region location state by the first location adjusting processing. Incidentally, processing in a case where the display type of the location adjusting annotation Qk is the symbol-character display type will be described in detail below, while processing in the cases with the character display type and the leader-character display type will be described only simply. In FIGS. 11 to 16, 18 to 20, 22 and 23, lines representing the location adjusting annotation Qk are shown with thicker lines than those representing the existing annotation Qj.

When the movable region setting section 151 acquires the annotation data 170 about the location adjusting annotation Qk generated by, for instance, the input operation at the input section 110 as shown in FIG. 8 (Step S101), the processor 150 of the map information generating device 100 sets a variable Z to 1 (Step S102). The movable region setting section 151 then determines, based on the annotation true-position data 180 of the annotation data 170, whether or not the display type of the location adjusting annotation Qk in a scale Z is the non-display type (Step S103). In Step S103, when determining that the display type is the non-display type, the movable region setting section 151 determines whether or not the variable Z is 4, namely, whether or not the variable Z is a number equal to the number of scale types that are available on the map (Step S104). Then, in Step S104, when determining that the variable Z is the number equal to the number of scale types, the movable region setting section 151 stores the annotation data 170 in the storage section 130, and the processing is terminated. On the other hand, when determining that the variable Z is a number different from the number of scale types, the movable region setting section 151 adds 1 to the variable Z (Step S105) and returns to Step S103. In Step S103, when determining that the display type is not the non-display type, the movable region setting section 151 performs location processing of the annotation Qi (Step S106) After performing the location processing of the annotation Qi in Step S106, the movable region setting section 151 performs processing of Step S104.

In location processing of the annotation Qi, the movable region setting section 151 recognizes the true position Pk of the location adjusting annotation Qk based on the annotation data 170 of the location adjusting annotation Qk as shown in FIG. 9 (Step S201), and recognizes the shape of the adjustment character area Hk (Step S202). Thereafter, the movable region setting section 151 determines whether or not the display type of the location adjusting annotation Qk in the scale Z is the character display type (Step S203). In Step S203, when it is determined that the display type is the character display type, the location adjusting processor 152 locates the location-adjusting-annotation character string Wk in such that the true position Pk coincides with the center of the adjustment character area Hk (Step S204), and determines whether or not the overlapped existing annotation Qj exists (Step S205). In Step S205, when it is determined that the overlapped existing annotation Qj does not exist, the annotation data updating section 153 performs the update processing of the annotation data 170 with the location state of the location-adjusting-annotation character string Wk reflected as shown in FIG. 10 (Step S206), and the location processing of the annotation Qi is terminated.

In Step S203, when determining that the display type is not the character display type, the movable region setting section 151 determines whether or not the display type in the scale Z is the symbol-character display type (Step S207). In Step S207, when determining that the display type is the symbol-character display type, the movable region setting section 151 sets the movable region EBk for the symbol-character display type on the area D (Step S208). In Step S207, when determining that the display type is not the symbol-character display type but the leader-character display type, the movable region setting section 151 sets the movable region ECk for the leader-character display type (Step S209). In Step S205, when determining that the overlapped existing annotation Qj does not exist, the movable region setting section 151 sets the movable region EAk for the character display type (Step S210).

Then, after the setting processing of the movable regions EBk, ECk and EAk in Steps 208 to 210, the location adjusting processor 152 locates the location-adjusting-annotation character string Wk such that the adjustment character area Hk is positioned at the center of lower sides of the movable regions EBk, ECk and EAk (Step S211), and determines whether or not the overlapped existing annotation Qj exists (Step S212). As shown by an imaginary line in FIG. 11 for instance, the location adjusting processor 152 locates the location-adjusting-annotation character string Wk such that the adjustment character area Hk is positioned at the center of the lower side of the movable region EBk, and determines whether or not the overlapped existing annotation Qj exists.

In Step S212, when it is determined that the overlapped existing annotation Qj does not exist, the processing of Step S206 is performed. On the other hand, in Step S212, when it is determined that the overlapped existing annotation Qj exists, namely when, for instance, a character area H2 of an overlapped-existing-annotation character string W2 that overlaps with an adjustment character area H1 exists as shown in FIG. 11, the location adjusting processor 152 performs the first location adjusting processing for moving a location-adjusting-annotation character string W1 in the right-left direction to locate it in the in-region location state (Step S213). Here, the first location adjusting processing in Step S213 is processing for moving the location-adjusting-annotation character string Wk in the right-left direction along the lower sides of the movable regions EAk, EBk and ECk. Then, the annotation data updating section 153 determines whether or not the in-region location of the location-adjusting-annotation character string Wk is completed by the first location adjusting processing (Step S214). In Step S214, when it is determined that the in-region location is completed, namely, for instance, when the in-region location of the location-adjusting-annotation character string W1 is completed as shown by the solid line in FIG. 11, the processing of Step S206 is performed. On the other hand, in Step S214, when it is determined that the in-region location is not completed, the location adjusting processor 152 locates the location-adjusting-annotation character string Wk such that the adjustment character area Hk is positioned at the center of the right sides of the movable regions EAk, EBk and ECk (Step S215), and determines whether or not the overlapped existing annotation Qj exists (Step S216). For instance, when the location-adjusting-annotation character string W1 cannot be located in the in-region location state so as not to overlap with a character area H3 of an overlapped-existing-annotation character string W3 as shown by the imaginary line in FIG. 12, the location adjusting processor 152 locates the location-adjusting-annotation character string W1 such that the adjustment character area H1 is positioned at the center of the right side of the movable region EB1 as shown by the solid line in FIG. 12, and determines whether or not the overlapped existing annotation Qj exists.

Then, in Step S216, when it is determined that the overlapped existing annotation Qj does not exist (i.e., the state shown in FIG. 12, for instance), the processing of Step S206 is performed. On the other hand, in Step S216, when it is determined that the overlapped existing annotation Qj exists, namely when, for instance, a character area H4 of an overlapped-existing-annotation character string W4 that overlaps with the adjustment character area H1 exists as shown in FIG. 13, the location adjusting processor 152 performs the second location adjusting processing for moving the location-adjusting-annotation character string Wk in the up-down direction for the in-region location (Step S217.). Here, the second location adjusting processing in Step S217 is processing for moving the location-adjusting-annotation character string Wk in the up-down direction along the right sides of the movable regions EAk, EBk and ECk. Then, the annotation data updating section 153 determines whether or not the in-region location of the location-adjusting-annotation character string Wk by the second location adjusting processing is completed (Step S218). In Step S218, when it is determined that the in-region location is completed, namely, for instance, when the in-region location of the location-adjusting-annotation character string W1 is completed as shown by the solid line in FIG. 13, the processing of Step S206 is performed. On the other hand, in Step S218, when it is determined that in-region location is not completed, the location adjusting processor 152 locates the location-adjusting-annotation character string Wk such that the adjustment character area Hk is positioned at the center of the upper sides of the movable regions EAk, EBk and ECk (Step S219), and determines whether or not the overlapped existing annotation Qj exists (Step S220).

In Step S220, when it is determined that the overlapped existing annotation Qj does not exist, the processing of Step S206 is performed. On the other hand, in Step S220, when it is determined that the overlapped existing annotation Qj exists, the first location adjusting processing is performed (Step S221). Here, the first location adjusting processing in Step S221 is processing for moving the location-adjusting-annotation character string Wk in the right-left direction along the upper sides of the movable regions EAk, EBk and ECk. Then, the annotation data updating section 153 determines whether or not the in-region location of the location-adjusting-annotation character string Wk by the first location adjusting processing is completed (Step S222). In Step S222, when it is determined that the in-region location is completed, the processing of Step S206 is performed. On the other hand, in Step S222, when it is determined that the in-region location is not completed, the location adjusting processor 152 locates the location-adjusting-annotation character string Wk such that the adjustment character area Hk is positioned at the center of the left sides of the movable regions EAk, EBk and ECk (Step S223), and determines whether or not the overlapped existing annotation Qj exists (Step S224).

Then, in Step S224, when it is determined that the overlapped existing annotation Qj does not exist, the processing of Step S206 is performed. On the other hand, in Step S224, when it is determined that the overlapped existing annotation Qj exists, the second location adjusting processing is performed (Step S225). Here, the second location adjusting processing in Step S225 is processing for moving the location-adjusting-annotation character string Wk in the up-down direction along the left sides of the movable regions EAk, EBk and ECk. Then, the annotation data updating section 153 determines whether or not the in-region location of the location-adjusting-annotation character string Wk by the second location adjusting processing is completed (Step S226). In Step S226, when it is determined that the in-region location is completed, the processing of Step S206 is performed. On the other hand, in Step S226, when it is determined that the in-region location is not completed, the location adjusting processor 152 performs relocation processing of the overlapped-existing-annotation character string Wj (Step S227), and performs the processing of Step S206. The processing of Step S206 that is performed after the processing of Step S227 is the update processing of the annotation data 170 corresponding to the location-adjusting-annotation character string Wk and relocated overlapped-existing-annotation character string Wj.

Now, the relocation processing of the overlapped-existing-annotation character string Wj in Step S227 will be described. When, for instance, existing annotations Q3 and Q5 to Q7 exist against a location adjusting annotation Q1 as shown in FIG. 14, the location adjusting processor 152 locates the location-adjusting-annotation character string W1 at the center of the lower side of the movable region EB1 Then, the location adjusting processor 152 operates the movable region setting section 151 to set a movable region EB3 of the overlapped-existing-annotation character string W3 (shown by the imaginary line) that overlaps with the location-adjusting-annotation character string W1, and performs the same processing as the location processing for the location-adjusting-annotation character string W1 described above. Then, when the overlapped-existing-annotation character string W3 is located on the lower side of the movable region EB3 as shown by the solid line, the location adjusting processor 152 recognizes that the in-region location of the overlapped-existing-annotation character string W3 is completed, and outputs the location completion signal. In addition, when determining that the overlapped-existing-annotation character string W3 cannot be relocated such that the overlapped existing annotation Qj does not exist, the location adjusting processor 152 sequentially locates the location-adjusting-annotation character string W1 at the center of the right side, the center of the upper side and the center of the left side of the movable region EB1, and performs the relocation processing of overlapped-existing-annotation character strings W5, W6 and W7 that overlap with the location-adjusting-annotation character string W1 that is located on each of the positions.

When, for instance, existing annotations Q3 and Q5 to Q 12 as shown in FIG. 15 exist against a location adjusting annotation Q1, the location adjusting processor 152 determines that the overlapped-existing-annotation character strings W3 and W5 to W7 positioned around the location adjusting annotation Q1 cannot be relocated such that they do not overlap with the overlapped-existing-annotation character string Qj. Then, as shown in FIG. 16, the location adjusting processor 152 locates the overlapped-existing-annotation character string W3 along the lower side of the movable region EB3 so as not to overlap with a symbol K12, while relocating the overlapped-existing-annotation character string W12 along the lower side of the movable region EB12.

In the first location adjusting processing, the location adjusting processor 152 determines whether or not there are a plurality of the overlapped existing annotations Qj as shown in FIG. 17 (Step S301). In Step S301, when determining that there are the plurality of overlapped existing annotations Qj exist, the location adjusting processor 152 recognizes display areas of the character area Hj, the symbol Kj, the instruction point Tj or the leader line Uj (hereinafter, referred to as an overlapped existing display area) of an overlapped existing annotation Qj with its center or periphery being closest to the location-adjusting-annotation character string Wk. On the other hand, in Step S301, when determining that there is only one overlapped existing annotation Qj, the location adjusting processor 152 recognizes the overlapped existing display area of the overlapped existing annotation Qj (Step S303). For instance, in case with the state shown in FIG. 11, the character area H2 is recognized as the overlapped existing display area.

Upon recognition of the overlapped existing display area in Steps S302 or S303, the location adjusting processor 152 recognizes coordinates V1 (VMinX, VMinY) of upper left apices and coordinates V2 (VMaxX, VMaxY) of lower right apices of the movable regions EAk, EBk and ECk. Further, the location adjusting processor 152 recognizes a coordinate A1 (AMinX, AMinY) of an upper left apex and a coordinate A2 (AMaxX, AMaxY) of a lower right apex of the adjustment character area Hk. Still further, the location adjusting processor 152 recognizes a coordinate B1 (BMinX, BMinY) of an upper left apex and a coordinate B2 (BMaxX, BMaxY) of a lower right apex of the overlapped existing display area. For instance, when the annotation Qi as shown in FIG. 11 exists, the location adjusting processor 152 recognizes the coordinates A1, A2 of the adjustment character area H1, the coordinates V1, V2 of the movable region EB1 and the coordinates B1, B2 of the character area H2 as the overlapped existing display area. Here, when the overlapped existing display area has a shape other than the quadrangle, namely, a circle, a triangle and the like, the coordinates B1 and B2 are coordinates of an upper left apex and a lower right apex of a circumscribing quadrangle of the overlapped existing display area.

Then, the location adjusting processor 152 determines whether or not a left side of the overlapped existing display area is on the right of a left side of the adjustment character area Hk of the location-adjusting-annotation character string Wk, namely whether or not a value obtained by subtracting AMinX from BMinX is greater than 0 (Step S304). In Step S304, when determining that the value is greater than 0, the location adjusting processor 152 determines whether or not the right side of the overlapped existing display area is on the right of a right side of the adjustment character area Hk, namely whether or not a value obtained by subtracting AMaxX from BMaxX is greater than 0 (Step S305). For example, when the overlapped-existing-annotation character string W2 exists against the location-adjusting-annotation character string W1 that is shown by the imaginary line in FIG. 11, or when an overlapped-existing-annotation character string W13 exists against the location-adjusting-annotation character string W1 shown by the imaginary line in FIG. 18, the location adjusting processor 152 determines that the value obtained by subtracting AMinX from BMinX is greater than 0 and performs the processing of S305. When determining that the value is greater than 0 in Step S305, the location adjusting processor 152 recognizes that the left side of the overlapped existing display area is on the right of the left side of the adjustment character area Hk and the right side of the overlapped existing display area is on the right of the right side of the adjustment character area Hk, namely the overlapped existing display area exists on the right of the adjustment character area Hk, which is hereinafter referred to as a right position state. Then, the location adjusting processor 152 recognizes to perform processing for moving leftward the location-adjusting-annotation character string Wk and obtains the value by subtracting BMinX from AMaxX as an overlapped value Ra (Step S306). For example, when the overlapped existing display area is in the right position state as shown in FIG. 11, the location adjusting processor 152 recognizes that the value obtained by subtracting AMaxX from BMaxX is greater than 0 and performs the processing of Step S306.

Thereafter, the location adjusting processor 152 determines whether or not the in-region location of the location-adjusting-annotation character string Wk can be achieved by moving it leftward by a distance of the overlapped value Ra, namely whether or not a value obtained by subtracting Ra and VMinX from AMinX is 0 or greater (Step S307). When determining that the value is smaller than 0 in Step S307, the location adjusting processor 152 recognizes that the in-region location of the location-adjusting-annotation character string Wk cannot be achieved only by moving it leftward, and terminates the processing. On the other hand, when determining that the value is 0 or greater in Step S307, the location adjusting processor 152 performs the in-region location of the location-adjusting-annotation character string Wk by moving it leftward by the distance of the overlapped value Ra (Step S308), and terminates the processing. For example, in the right position state as shown in FIG. 11, the location adjusting processor 152 moves location-adjusting-annotation character string W1 leftward by the distance of the overlapped value Ra to a position shown by the solid line to achieve the in-region location thereof, and terminates the processing.

In Step S304, when determining that the value obtained by subtracting AMinX from BMinx is smaller than 0, the location adjusting processor 152 then determines whether or not the value obtained by subtracting AMaxX from BMaxX is greater than 0 as in the Step S305 (Step S309). For example, when an overlapped-existing-annotation character string W14 exists against the location-adjusting-annotation character string W1 that is shown by the imaginary line in FIG. 19, or when an overlapped-existing-annotation character string W22 exists against the location-adjusting-annotation character string W21 of a location adjusting annotation Q21 shown by the imaginary line in FIG. 20, the location adjusting processor 152 determines that the value obtained by subtracting AMinX from BMinX in Step S304 is smaller than 0, and performs the processing of S309. When determining that the value is smaller than 0 in Step S309, the location adjusting processor 152 recognizes that the left side of the overlapped existing display area is on the left of the left side of the adjustment character area Hk and the right side of the overlapped existing display area is on the left of the right side of the adjustment character area Hk, namely the overlapped existing display area exists on the left of the adjustment character area Hk, which is hereinafter referred to as a left position state. Then the location adjusting processor 152 recognizes to perform processing for moving rightward the location-adjusting-annotation character string Wk and obtains the value by subtracting AMinX from BMaxX as an overlapped value Rb (Step S310). For example, in the left position state as shown in FIG. 19, the location adjusting processor 152 determines that the value obtained by subtracting AMaxX from BMaxX is smaller than 0, and performs the processing of Step S310.

Thereafter, the location adjusting processor 152 determines whether or not the in-region location of the location-adjusting-annotation character string Wk can be achieved by moving it rightward by a distance of the overlapped value Rb, namely whether or not a value obtained by subtracting Rb and AMaxX from VMaxX is 0 or greater (Step S311). When determining that the value is smaller than 0 in Step S311, the location adjusting processor 152 recognizes that the in-region location of the location-adjusting-annotation character string Wk cannot be achieved only by moving it rightward, and terminates the processing. On the other hand, when determining that the value is 0 or greater in Step S311, the location adjusting processor 152 performs the in-region location of the location-adjusting-annotation character string Wk by moving it rightward by the distance of the overlapped value Rb, namely performs the processing of Step S308, and terminates the processing. For example, in the left position state as shown in FIG. 19, the location adjusting processor 152 moves the location-adjusting-annotation character string W1 rightward by the distance of the overlapped value Rb to a position shown by the solid line to achieve the in-region location thereof, and terminates the processing.

When determining that the value obtained by subtracting AMaxX from BMaxX is smaller than 0 in Step S305, the location adjusting processor 152 recognizes that the left side of the overlapped existing display area is on the right of the left side of the adjustment character area Hk and the right side of the overlapped existing display area is on the left of the right side of the adjustment character area Hk, namely, the overlapped existing display area exists on an inner side of the adjustment character area Hk, which is hereinafter referred to as a right/left inner position state. Then, the location adjusting processor 152 recognizes to determine a moving direction of the location-adjusting-annotation character string Wk in accordance with the position of the overlapped existing display area relative to the adjustment character area Hk, and obtains a value by calculating (AmaxX +AMinX)/2 as a center value Sa in the right-left direction of the location-adjusting-annotation character string Wk (Step S312). When determining that the value obtained by subtracting AMaxX from BMaxX is greater than 0 in Step S309, the location adjusting processor 152 recognizes that the left side of the overlapped existing display area is on the left of the left side of the adjustment character area Hk and the right side of the overlapped existing display area is on the right of the right side of the adjustment character area Hk, namely the overlapped existing display area exists on an outer side of the adjustment character area Hk, which is hereinafter referred to as a right/left outer position state. The location adjusting processor 152 then recognizes to determine a moving direction of the location-adjusting-annotation character string Wk in accordance with the position of the overlapped existing display area relative to the adjustment character area Hk, and performs the processing of Step S312. For example, in the right/left inner position state as shown in FIG. 18, the location adjusting processor 152 determines that the value obtained by subtracting AMaxX from BMaxX is smaller than 0 in Step S305, and performs the processing of Step S312. For example, when the overlapped existing display area is in the right/left outer position state as shown in FIG. 20 in Step S309, the location adjusting processor 152 determines that the value obtained by subtracting AMaxX from BMaxX is greater than 0, and performs the processing of Step S312.

Then, the location adjusting processor 152 obtains a value by calculating (BmaxX +BMinX)/2 as a center value Sb in the right-left direction of the overlapped existing display area (Step S313). Thereafter, the location adjusting processor 152 determines whether or not the center of the overlapped existing display area is on the right of the center of the location-adjusting-annotation character string Wk, namely whether or not a value obtained by subtracting the center value Sa from the center value Sb is greater than 0 (Step S314). When determining that the value is greater than 0 in Step S314, the location adjusting processor 152 recognizes that the center of the overlapped existing display area is on the right of the center of the location-adjusting-annotation character string Wk, and thus the in-region location thereof is performed by moving the location-adjusting-annotation character string Wk leftward, and performs the processing of Step S306. For example, in the states shown in FIGS. 18 and 20, the location adjusting processor 152 moves, by the processing of Steps S306 and S308 the location-adjusting-annotation character strings W1, W21 leftward by the distance of the overlapped value Ra along the lower sides of the movable regions EB1 and EB2 to the positions shown by the solid lines, so that the in-region location thereof is achieved. On the other hand, in Step S314, when determining that the value is smaller than 0, the location adjusting processor 152 recognizes to move the location-adjusting-annotation character string Wk rightward to achieve the in-region location, and performs the processing of Step S310.

In the second location adjusting processing, the location adjusting processor 152 determines whether or not there are a plurality of the overlapped existing annotations Qj as shown in FIG. 21 (Step S401). In Step S401, when determining that there are the plurality of overlapped existing annotations Qj, the location adjusting processor 152 recognizes the overlapped existing display area that is closest to the location-adjusting-annotation character string Wk (Step S403). On the other hand, in Step S401, when determining that there is only one overlapped existing annotation Qj, the location adjusting processor 152 recognizes the overlapped existing display area of the overlapped existing annotation Qj (Step S403). After recognizing the overlapped existing display area in Step S402 or S403, the location adjusting processor 152 determines whether or not the upper side of the overlapped existing display area is below an upper side of the location-adjusting-annotation character string Wk, namely a value obtained by subtracting AMinY from BMinY is greater than 0 (S404).

In Step S404, when determining that the value is greater than 0, the location adjusting processor 152 determines whether or not the lower side of the overlapped existing display area is below a lower side of the location-adjusting-annotation character string Wk, namely whether or not a value obtained by subtracting AMaxY from BMaxY is greater than 0 (Step S405). When determining that the value is greater than 0 in Step S405, the location adjusting processor 152 recognizes that the upper side of the overlapped existing display area is below the upper side of the adjustment character area Hk and the lower side of the overlapped existing display area is below the lower side of the adjustment character area Hk, namely the overlapped existing display area exists below the adjustment character area Hk, which is hereinafter referred to as a lower position state. Then, the location adjusting processor 152 recognizes to perform processing for moving the location-adjusting-annotation character string Wk upward and obtains the value by subtracting BMinY from AMaxY as an overlapped value Rc (Step S406). Thereafter, the location adjusting processor 152 determines whether or not the in-region location of the location-adjusting-annotation character string Wk can be achieved by moving it upward by a distance of the overlapped value Rc, namely whether or not a value obtained by subtracting Rc and VMinY from AMinY is 0 or greater (Step S407). When determining that the value is smaller than 0 in Step S407, the location adjusting processor 152 recognizes that the in-region location of the location-adjusting-annotation character string Wk cannot be achieved only by moving it upward, and terminates the processing. On the other hand, when determining that the value is 0 or greater in Step S407, the location adjusting processor 152 performs the in-region location of the location-adjusting-annotation character string Wk by moving it upward by the distance of the overlapped value Rc (Step S408), and terminates the processing.

In Step S404, when determining that the value obtained by subtracting AMinY from BMinY is smaller than 0, the location adjusting processor 152 then determines whether or not the value obtained by subtracting AMaxY from BMaxY is greater than 0 (Step S409). For example, when the overlapped-existing-annotation character string W4 exists against the location-adjusting-annotation character string W1 shown by the imaginary line in FIG. 13, the location adjusting processor 152 determines that the value obtained by subtracting AMinY from BMinY is smaller than 0, and performs the processing of Step S409. When determining that the value is smaller than 0 in Step S409, the location adjusting processor 152 recognizes that the upper side of the overlapped existing display area is above the upper side of the adjustment character area Hk and the lower side of the overlapped existing display area is above the lower side of the adjustment character area Hk, namely the overlapped existing display area exists above the adjustment character area Hk, which is hereinafter referred to as an upper position state. Then, the location adjusting processor 152 recognizes to perform processing for moving the location-adjusting-annotation character string Wk downward and obtains the value by subtracting AMinY from BMaxY as an overlapped value Rd (Step S410). For example, in the upper position state as shown in FIG. 13, the location adjusting processor 152 determines that the value obtained by subtracting AMaxY from BMaxY is smaller than 0, and performs the processing of Step S410.

Thereafter, the location adjusting processor 152 determines whether or not the in-region location of the location-adjusting-annotation character string Wk can be achieved by moving it downward by a distance of the overlapped value Rd, namely whether or not a value obtained by subtracting Ra and AMaxY from VMaxY is 0 or greater (Step S411). When determining that the value is smaller than 0 in Step S411, the location adjusting processor 152 recognizes that the in-region location of the location-adjusting-annotation character string Wk cannot be achieved only by moving it downward, and terminates the processing. On the other hand, when determining that the value is 0 or greater in Step S411, the location adjusting processor 152 performs the in-region location of the location-adjusting-annotation character string Wk by moving it downward by the distance of the overlapped value Rd, namely performs the processing of Step S408, and terminates the processing. For example, in the upper position state as shown in FIG. 13, the location adjusting processor 152 moves the location-adjusting-annotation character string W1 downward by the distance of the overlapped value Rd to a position shown by the solid line to achieve the in-region location thereof, and terminates the processing.

When determining that the value obtained by subtracting AMaxY from BMaxY is smaller than 0 in Step S405, the location adjusting processor 152 recognizes that the upper side of the overlapped existing display area is below the upper side of the adjustment character area Hk and the lower side of the overlapped existing display area is above the lower side of the adjustment character area Hk, namely the overlapped existing display area exists on an inner side of the adjustment character area Hk, which is hereinafter referred to as an upper/lower inner position state. Then, the location adjusting processor 152 recognizes to determine a moving direction of the location-adjusting-annotation character string Wk in accordance with the position of the overlapped existing display area relative to the adjustment character area Hk, and obtains a value by calculating (AmaxY +AMinY)/2 as a center value Sc in the up-down direction of the location-adjusting-annotation character string Wk (Step S412). When determining that the value obtained by subtracting AMaxY from BMaxY is greater than 0 in Step S409, the location adjusting processor 152 recognizes that the upper side of the overlapped existing display area is above the upper side of the adjustment character area Hk and the lower side of the overlapped existing display area is below the lower side of the adjustment character area Hk, namely, the overlapped existing display area exists on an outer side of the adjustment character area Hk, which is hereinafter referred to as an upper/lower outer position state. The location adjusting processor 152 then recognizes to determine a moving direction of the location-adjusting-annotation character string Wk in accordance with the position of the overlapped existing display area relative to the adjustment character area Hk, and performs the processing of Step S412. Then, the location adjusting processor 152 obtains a value by calculating (BmaxY +BMinY)/2 as a center value Sd in the up-down direction of the overlapped existing display area (Step S413).

Thereafter, the location adjusting processor 152 determines whether or not the center of the overlapped existing display area is below the center of the location-adjusting-annotation character string Wk, namely whether or not a value obtained by subtracting the center value Sc from the center value Sd is greater than 0 (Step S414). When determining that the value is greater than 0 in Step S414, the location adjusting processor 152 recognizes that the center of the overlapped existing display area is below the center of the location-adjusting-annotation character string Wk and that the in-region location thereof is performed by moving the location-adjusting-annotation character string Wk upward, and performs the processing of Step S406. On the other hand, when determining that the value is smaller than 0 in Step S414, the location adjusting processor 152 recognizes to move the location-adjusting-annotation character string Wk downward to achieve the in-region location, and performs the processing of Step S410.

Incidentally, when an overlapped existing annotation Qj against a location adjusting annotation Qk with its display type being the character display type exists, namely when an overlapped-existing-annotation character string W32 against a location-adjusting-annotation character string W31 of a location adjusting annotation Q31 exists, the above-described updating processing of the annotation data 170 is performed, and the location-adjusting-annotation character string W31 is moved leftward along the lower side of a movable region EA31 to a position shown by the solid line in FIG. 22 to achieve the in-region location state in a manner not overlapping with the character area H32. When an overlapped existing annotation Qj against a location adjusting annotation Qk with its display type being the leader-character display type exists, namely when an overlapped-existing-annotation character string W42 against a location-adjusting-annotation character string W41 and a leader line U41 of a location adjusting annotation Q41 exists, the above-described update processing of the annotation data 170 is performed, and the location-adjusting-annotation character string W41 is moved rightward along a lower side of a movable region EC41 to a position shown by the solid line in FIG. 23 to achieve the in-region location in a manner not overlapping with the character area H41 and the leader line U41. The annotation data 170 is performed based on the location states of the character areas H31 and H41 and the leader line U41.

[Advantages of First Embodiment]

As described above, in the first embodiment, the processor 150 of the map information generating device 100 operates the movable region setting section 151 to generate the annotation data 170 for displaying the location adjusting annotation Qk about a feature that is newly built. The location adjusting processor 152 of the processor 150 sets the location-adjusting-annotation character string Wk of the location adjusting annotation Qk at a locatable position close to the true position Pk but not overlapping with the existing annotation Qj. Specifically, the location adjusting processor 152 sets the locatable position of the location-adjusting-annotation character string Wk at a position substantially corresponding to a position where the feature locates but not overlapping with the existing annotation Qj. Then, the annotation data updating section 153 of the processor 150 updates, based on the location state of the location-adjusting-annotation character string Wk set by the location adjusting processor 152, the annotation data 170 of the location-adjusting-annotation character string Wk and stores it in the storage section 130. Thus, when adding a location-adjusting-annotation character string Wk of a new feature to the annotation list data 160 and updating the annotation list data 160, the map information generating device 100 can update the annotation list data 160 so that annotation character strings Wk that show details of features respectively corresponds to the positional relationships of the features, but do not overlap with each other. Accordingly, the display unit that displays the positional relationships of the features using the annotation list data 160 can display the annotation character strings Wk in a manner not overlapping with each other without providing a function for adjusting the locatable position of the annotation character strings Wk on the display unit. Since the size of characters constituting the annotation character string Wk is not adjusted, the user can recognize the details of the features more easily as compared to a conventional arrangement in which the size of the characters is adjusted depending on the number of characters constituting the annotation character string Wk. Since the map information generating device 100 does not delete an annotation character string Wk having existed previously, it dose not generate the annotation list data 160 that cannot express an annotation character string Wk that is useful for the user, unlike a conventional arrangement in which the annotation character string Wk having existed previously is appropriately deleted. With the map information generating device 100, a creator of the annotation list data 160 is only required to input settings of various information other than the character string shape information 194 in the annotation data 170, and is not required to appropriately set the locatable position of the annotation character string Wk. Therefore, the map information generating device 100 can appropriately update the annotation list data 160.

When recognizing that that all of the annotations Qi cannot be located so as not to overlap with each other only by adjusting the locatable position of the location-adjusting-annotation character string Wk, the location adjusting processor 152 sets a locatable position of the location-adjusting-annotation character string Wk at a predetermined position, while performing the location adjusting processing of the overlapped-existing-annotation character string Wj that overlaps with the location-adjusting-annotation character string Wk to be located at the predetermined position. Thus, even when the plurality of overlapped-existing-annotation character strings Wj exist around the true position Pk of the location-adjusting-annotation character string Wk, the map information generating device 100 can locate all of the annotations Qi so as not to overlap with each other by the location adjusting processing of the overlapped-existing-annotation character string Wj having existed previously. Therefore, unlike a conventional arrangement in which the location adjusting processing of the overlapped-existing-annotation character string Wj is not performed, the map information generating device 100 does not have a problem in which all of the annotations cannot be located so as not to overlap with each other, thereby updating the annotation list data 160 more properly.

The location adjusting processor 152 sets the locatable position of the annotation character string Wi in the movable regions EAi, EBi and ECi that are set relative to the true position Pi by the movable region setting section 151. Thus, the map information generating device 100 can set the locatable position of the annotation character string Wi at a position within a predetermined distance area from the true position Pi, so that it can update the annotation list data 160 more appropriately unlike an arrangement in which, for instance, the movable regions EAi, EBi and ECi are not set and thus a distance from an annotation character string Wi to the true position Pi is greatly different for each feature.

The location adjusting processor 152 locates the location-adjusting-annotation character string Wk at, for instance, the center of the lower sides of the movable regions EAk, EBk and ECk. The location adjusting processor 152 sets the locatable position when recognizing that the overlapped existing annotation Qj does not exist, while adjusting the locatable position of the location-adjusting-annotation character string Wk in the right-left direction when recognizing that the overlapped existing annotation Qj exists. Since the map information generating device 100 locates the location-adjusting-annotation character string Wk at a predetermined position regardless of whether or not the existing annotation Qj exists in, for instance, the movable region EBk, processing load in the location adjusting processing can be reduced as compared to an arrangement that first recognizes the existing annotation Qj existing in the movable region EBk and then recognizes an overlapping states with the existing annotation Qj to set the locatable position of the location-adjusting-annotation character string Wk.

When the location adjusting annotation Qk is the character display type, the location adjusting processor 152 locates the location-adjusting-annotation character string Wk so that the true position Pk is positioned at the center of the adjustment character area Hk. The location adjusting processor 152 sets the locatable position when recognizing that the overlapped existing annotation Qj does not exist, while performing the location adjusting processing of the location-adjusting-annotation character string Wk when recognizing that the overlapped existing annotation Qj exists. Thus, the map information generating device 100 first locates the location-adjusting-annotation character string Wk at a position corresponding to the position of the feature, namely at a position that allows the user to easily recognize the position of the feature, so that the map information generating device 100 can update the annotation list data 160 in shorter time, which allows the user to recognize the position of the feature more easily as compared to an arrangement in which the locatable position of the location-adjusting-annotation character string Wk is first set at a position close to the position of the feature.

When the location adjusting processor 152 locates the location-adjusting-annotation character string Wk at, for instance, the center of the lower side of the movable region EBk and recognizes that the overlapped existing annotation Qj exists, the location adjusting processor 152 adjusts the locatable position of the location-adjusting-annotation character string Wk in the right-left direction based on the overlapping state with the overlapped existing annotation Qj. Thus, since the map information generating device 100 reflects the overlapping state with the overlapped existing annotation Qj in adjustment of the locatable position of the location-adjusting-annotation character string Wk, it can determine the locatable position in shorter time as compared to an arrangement that determines whether or not the location-adjusting-annotation character string Wk can be located at a position by moving it, for instance, rightward by a predetermined distance from the center of the lower side without reflecting the overlapping state.

The location adjusting processor 152 recognizes an overlapping amount between the location-adjusting-annotation character string Wk and the overlapped existing annotation Qj, and sets a position to which the location-adjusting-annotation character string Wk is moved by the overlapping amount as the locatable position. Thus, since the map information generating device 100 sets the locatable position of the location-adjusting-annotation character string Wk based on the overlapping amount with the overlapped existing annotation Qj, it can set the locatable position at a position that does not overlap with the overlapped existing annotation Qj more securely as compared to an arrangement in which the locatable position is set without recognizing the overlapping amount.

The location adjusting processor 152 recognizes the position of the overlapped existing annotation Qj relative to the location-adjusting-annotation character string Wk, namely the positional relationship between the location-adjusting-annotation character string Wk and the overlapped existing annotation Qj to set the locatable position of the location-adjusting-annotation character string Wk based on the recognized positional relationship. Thus, the map information generating device 100 reflects the positional relationship with the overlapped existing annotation Qj in adjusting the locatable position of the location-adjusting-annotation character string Wk, it always updates the annotation list data 160 by reflecting the positional relationship of the features, unlike an arrangement that sets the locatable position of the location-adjusting-annotation character string Wk always at, for instance, the right of the overlapped existing annotation Qj without reflecting the positional relationship. Therefore, the map information generating device 100 can update the annotation list data 160 more appropriately.

When there are the plurality of overlapped existing annotations Qj, the location adjusting processor 152 sets the locatable position of the location-adjusting-annotation character string Wk based on the overlapping state with the closest overlapped existing annotation Qj. Thus, for instance, when two overlapped existing annotations Q91 and Q92, which are adjacent to each other in the right-left direction, exist in the right position states relative to the locatable position of the location-adjusting-annotation character string Wk, the map information generating device 100 performs the first location processing on the overlapped existing annotation Q91 that is located more closely to the location-adjusting-annotation character string Wk, namely the overlapped existing annotation Q91 that is the left one of the overlapped existing annotations Q91 and Q92, so that the locatable position of the location-adjusting-annotation character string Wk can be set so as not to overlap with the overlapped existing annotations Q91 and Q92. On the other hand, if the first location adjusting processing is performed on the overlapped existing annotation Q92 that is located farther from the location-adjusting-annotation character string Wk, namely the overlapped existing annotation Q92 that is the right one of the overlapped existing annotations Q91 and Q92, the locatable position of the location-adjusting-annotation character string Wk will not overlap with the overlapped existing annotation Q92 but might overlap with the overlapped existing annotation Q91. Therefore, the map information generating device 100 can update the annotation list data 160 more appropriately.

When the location adjusting annotation Qk is the symbol-character display type, the location adjusting processor 152 sets the locatable position of the location-adjusting-annotation character string Wk at a position that does not overlap with the symbol Kk that is arranged on the true position Pk and the existing annotation Qj. Thus, the map information generating device 100 can set the locatable position of the location-adjusting-annotation character string Wk so as not to overlap with the symbol Kk corresponding to this location-adjusting-annotation character string Wk as well as the overlapped existing annotation Qj. Therefore, the map information generating device 100 can perform the location adjusting processing of the location-adjusting-annotation character string Wk more appropriately in the case with the location adjusting annotation Qk being symbol-character display type.

When the location adjusting annotation Qk is the leader-character display type, the location adjusting processor 152 sets the locatable positions of the location-adjusting-annotation character string Wk and the leader line Uk at positions that do not overlap with the existing annotation Qj. Thus, even in the case with the location adjusting annotation Qk being the leader-character display type, the map information generating device 100 can locate the location-adjusting-annotation character string Wk and the leader line Uk so as not to overlap with the overlapped existing annotation Qj, thereby performing the location adjusting processing of the location-adjusting-annotation character string Wk more appropriately.

The map information generating device 100 performs update processing of the annotation list data 160 for displaying the position of the feature in the scales 1 to 4 each having different scales. Thus, the map information generating device 100 can realize improved user-friendliness as compared to an arrangement that can perform update processing of the annotation list data 160 that only corresponds to one scale.

The information updating device of the present invention is applied to the map information generating device 100 for updating the annotation list data 160 for displaying the position of the feature in a superimposing manner on the map. Thus, the map information generating device 100 can update the annotation list data 160 so that the annotations Qi of the features do not overlap with each other on the map, thereby allowing the user to easily recognize addresses or the like of the features in addition to the positional relationship of the features.

The information updating device of the present invention is applied to the map information generating device 100 for updating the annotation list data 160 for displaying the position of the feature on the display unit in a superimposing manner on the map. Thus, the map information generating device 100 can update the annotation list data 160 so that the annotations Qi of the features are displayed on the map without overlapping with each other when being displayed on the display unit.

The information updating device of the present invention is applied to the map information generating device 100 for updating the annotation list data 160 for displaying the position of the feature on the display unit that is installed in the vehicle. Therefore, in the display unit installed in the mobile body and having a display area smaller than that of a display unit installed at home or the like, the annotation list data 160 can be updated so that the annotations Qi do not overlap with each other, thereby realizing more improved user-friendliness of the map information generating device 100.

Second Embodiment

Figure 24:
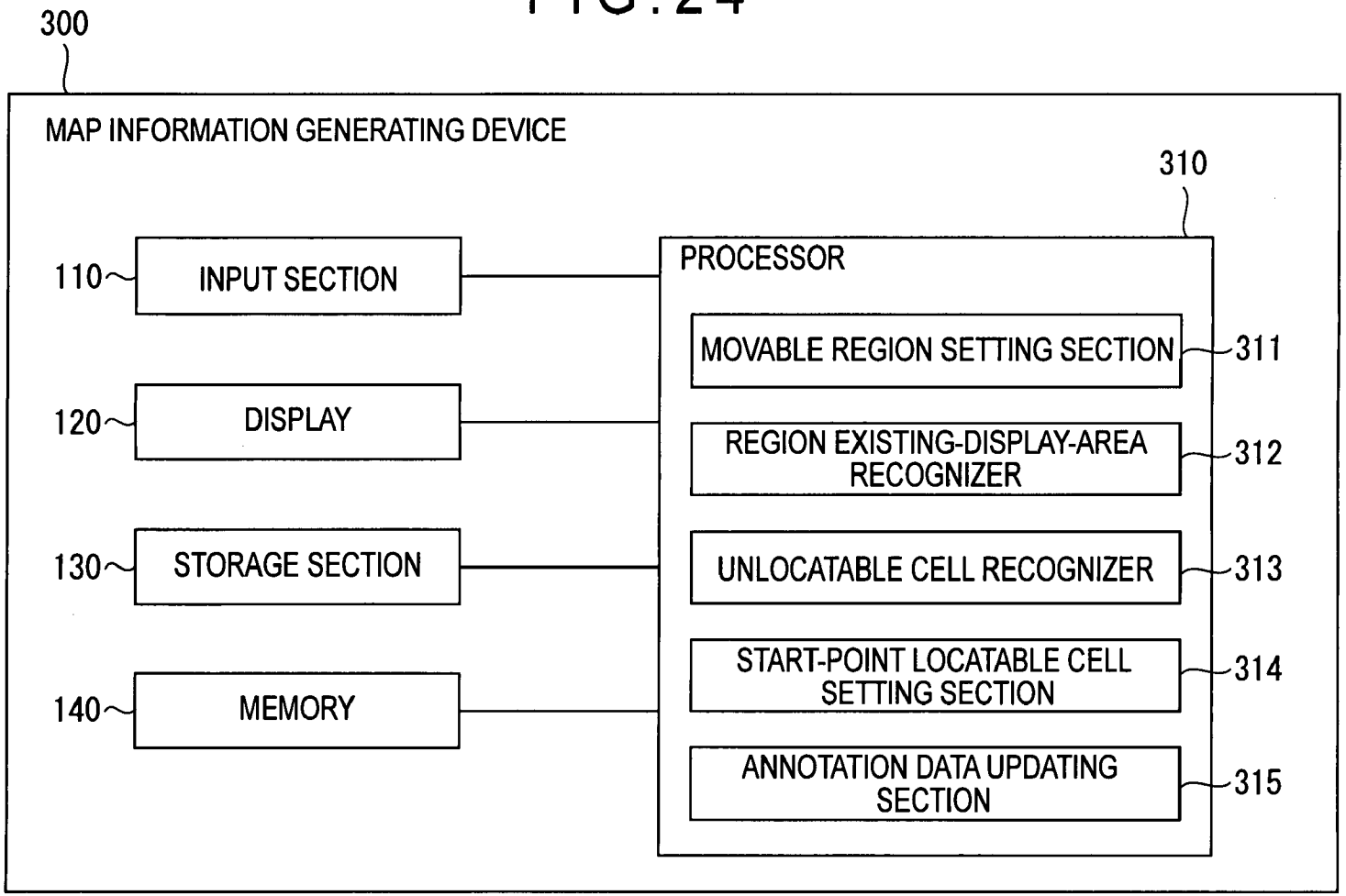
FIG. 24 is a block diagram showing a brief arrangement of a map information generating device according to a second embodiment of the present invention.
Figure 25:
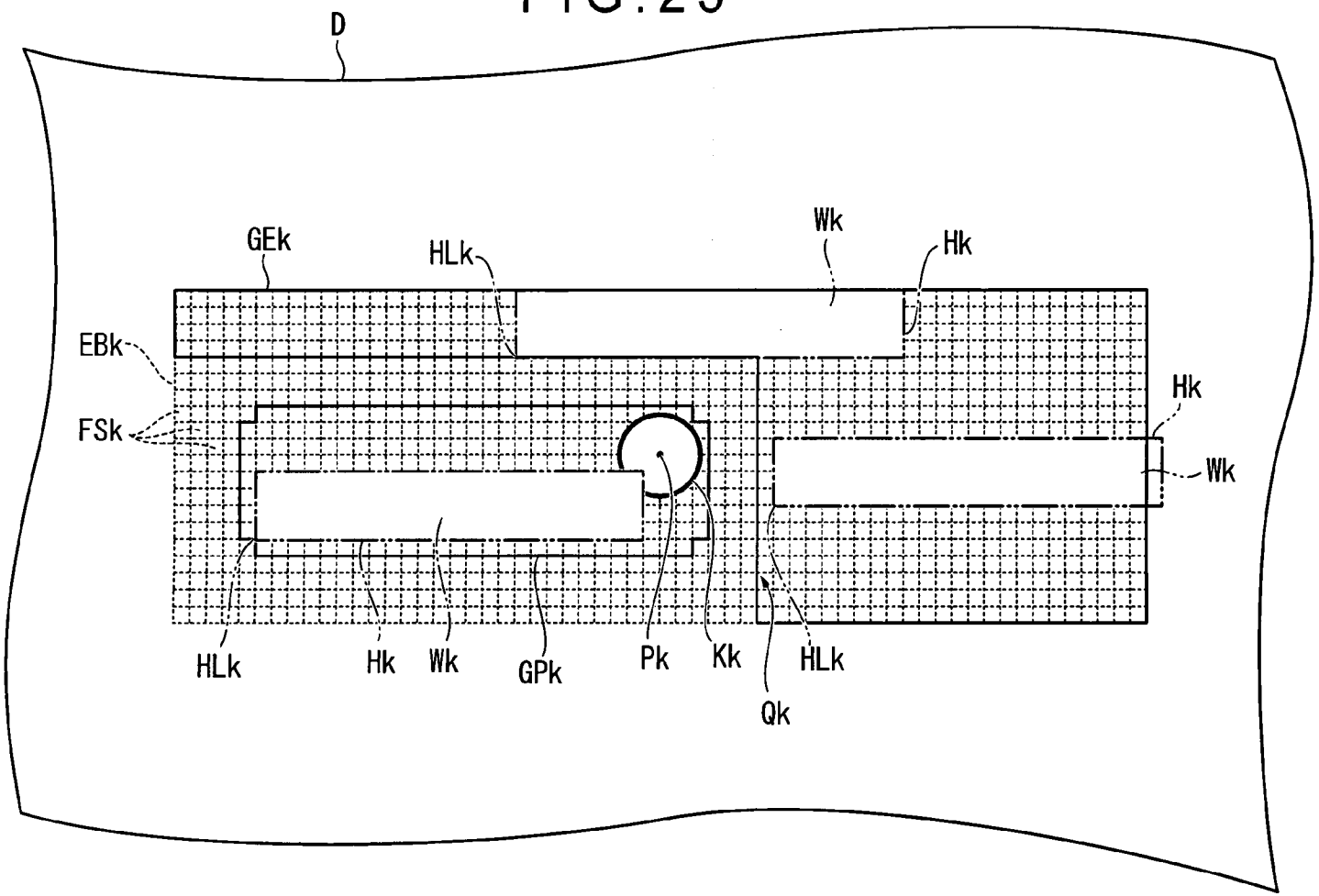
FIG. 25 is a schematic diagram showing an unlocatable area set in a movable region in the second embodiment.
Figure 26:
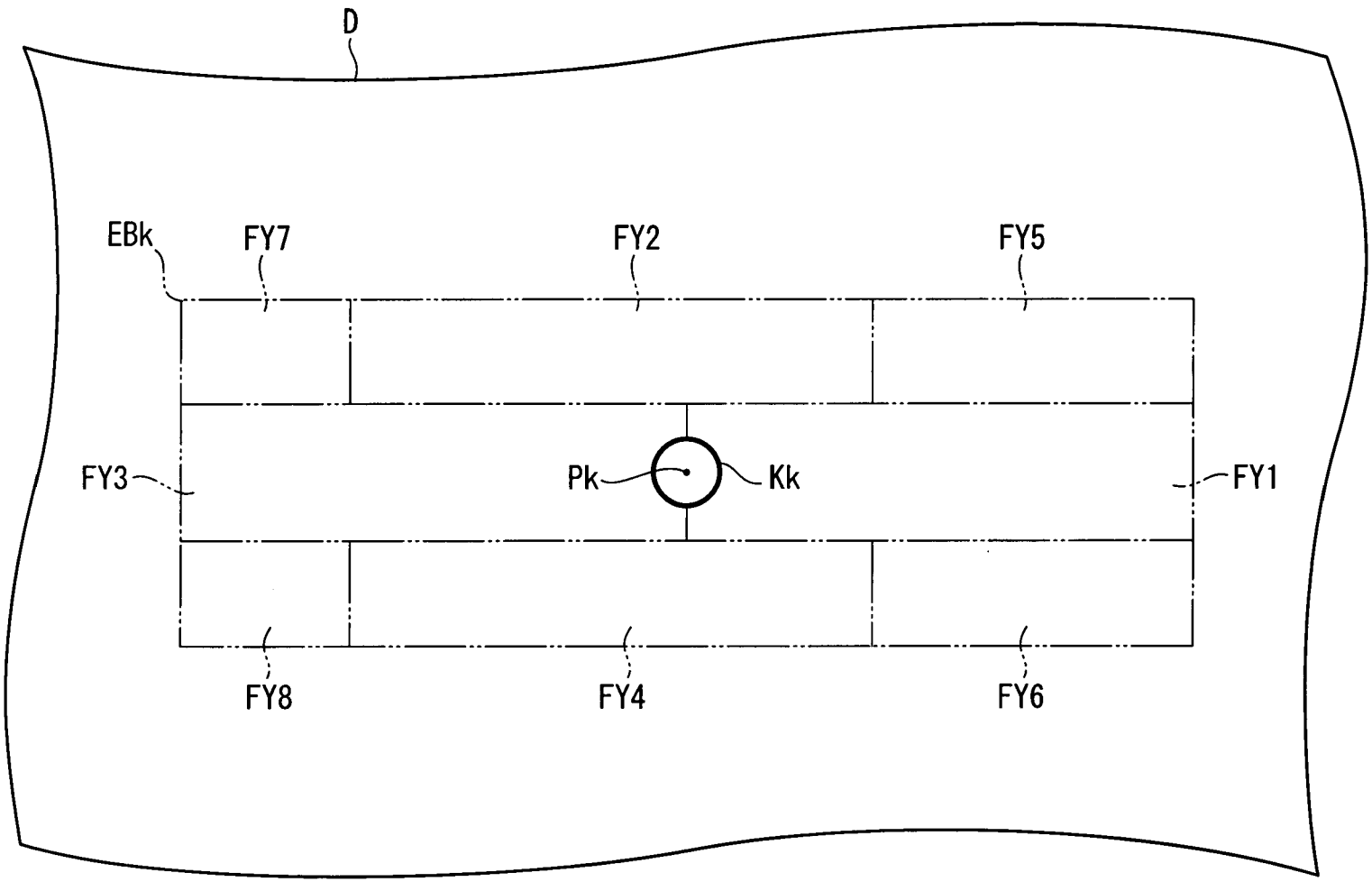
FIG. 26 is a schematic diagram showing a priority setting area set in the movable region in the second embodiment.
Figure 27:
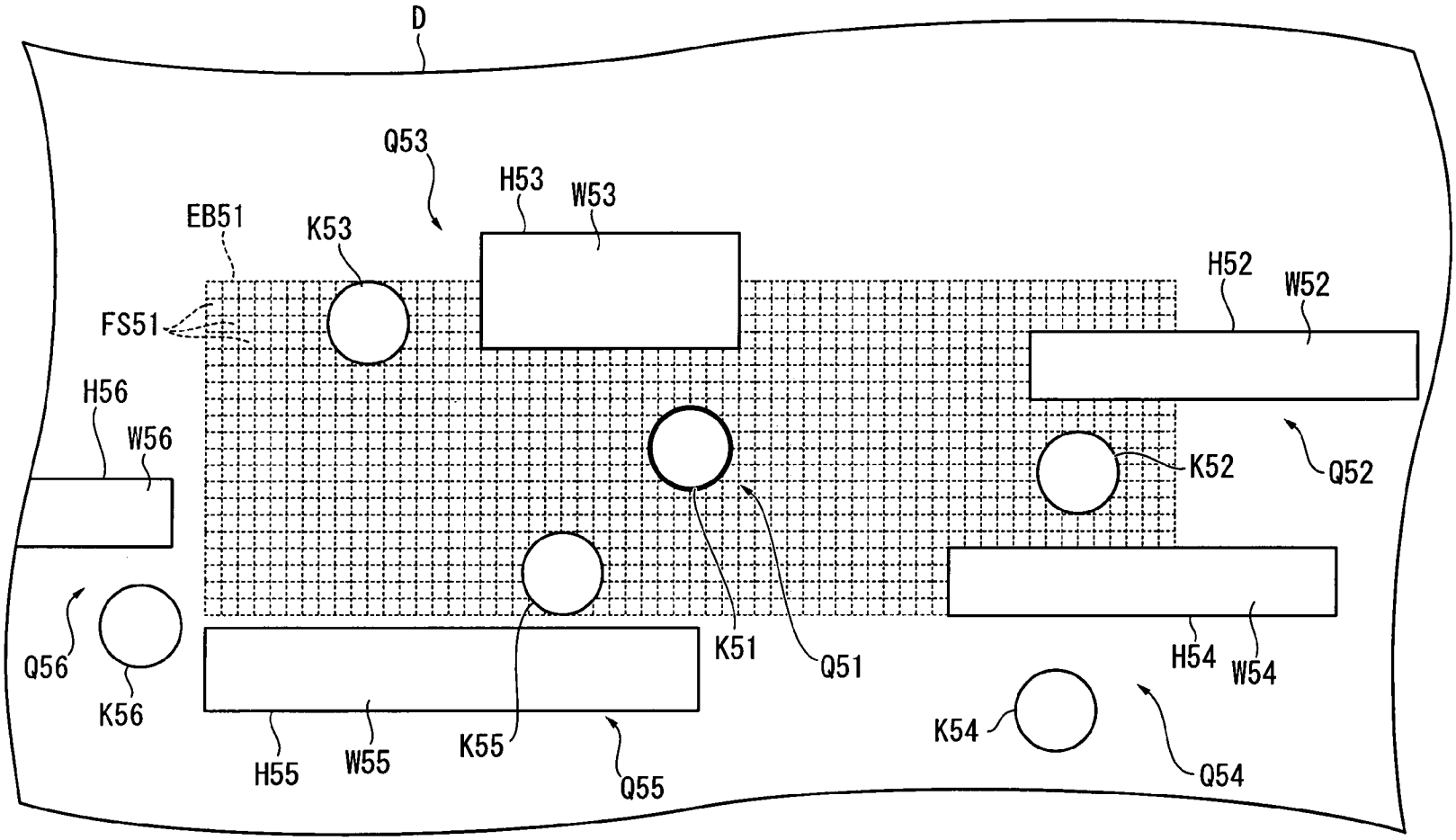
FIG. 27 is a schematic diagram showing a location state of a location adjusting annotation and an existing annotation in the second embodiment.
Figure 28:
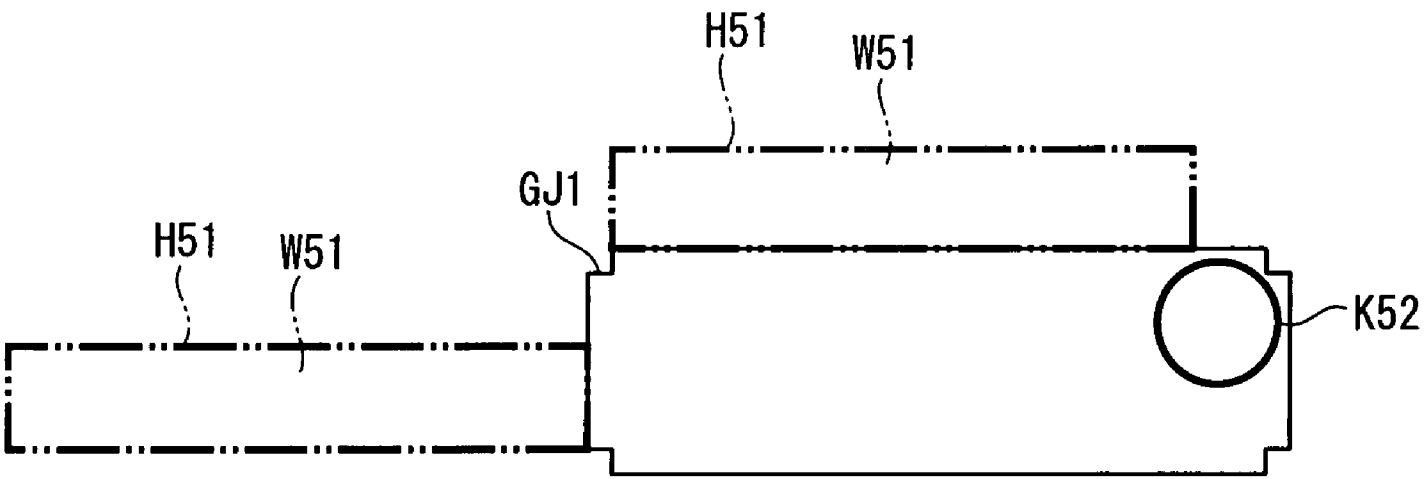
FIG. 28 is a schematic diagram showing an unlocatable area in a case with a region existing-display-area is a symbol in the second embodiment.
Figure 29:
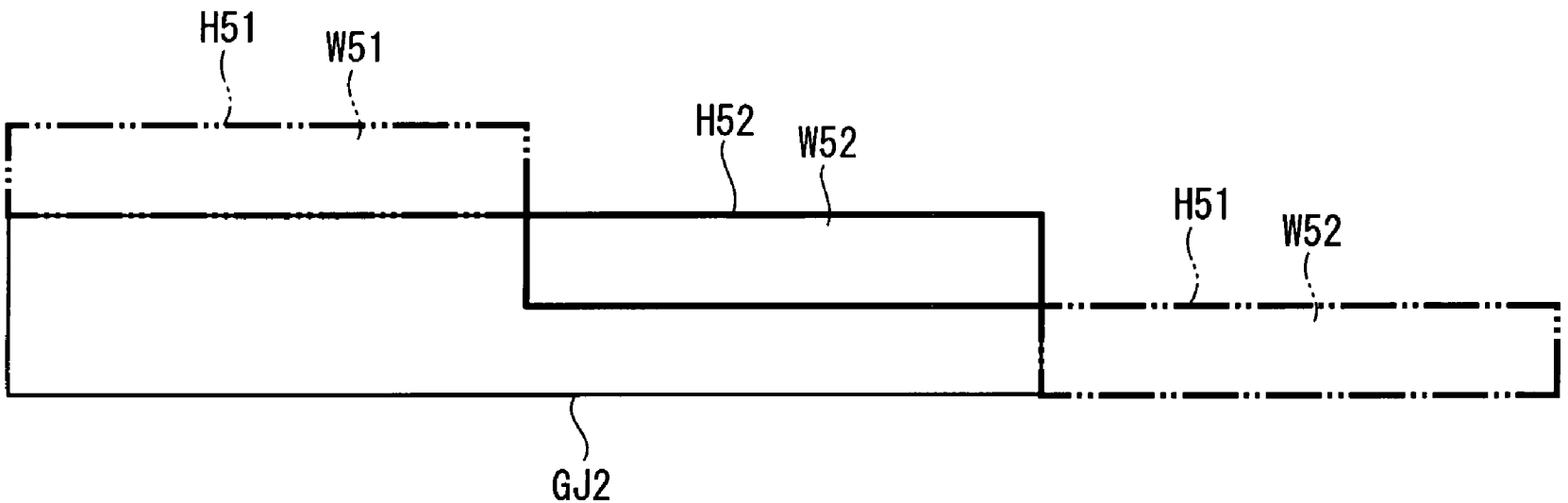
FIG. 29 is a schematic diagram showing an unlocatable area in a case where a region existing-display-area is a character area in the second embodiment.

Now, a second embodiment of the present invention will be described with reference to the attached drawings. In the present embodiment, a map information generating device similar to the map information generating device 100 of the first embodiment will be exemplified as the information updating device. FIG. 24 is a block diagram showing a brief arrangement of the map information generating device. FIG. 25 is a schematic illustration showing an unlocatable area set in a movable region. FIG. 26 is a schematic illustration showing the priority setting area set in a movable region. FIG. 27 is a schematic illustration showing a location state of a location adjusting annotation and an existing annotation. FIG. 28 is a schematic illustration showing an unlocatable area in a case where a region existing-display-area is a symbol. FIG. 29 is a schematic illustration showing an unlocatable area in a case where a region existing-display-area is a character area.

[Arrangement of Map Information Generating Device]

In FIG. 24, a reference numeral 300 denotes a map information generating device. The map information generating device 300 includes the input section 110, the display 120, the storage section 130, the memory 140, a processor 310 as a computing unit and so on. The storage section 130 readably stores map information as shown in, for instance, FIGS. 2 and 3. The processor 310 includes, as various programs, a movable region setting section (a region setting section) 311 also functioning as a new detail information acquirer and a new target object position recognizer, a region existing-display-area recognizer (an existing detail position recognizer) 312 also functioning as a target object map information acquirer, an unlocatable cell recognizer 313 also functioning as a detail position setting section, a start-point locatable cell setting section (a detail position setting section) 314, an annotation data updating section (an update processor) 315 also functioning as a detail position information generator, and the like. Note that in the description below, processing for a location adjusting annotation Qk with its display type being the symbol-character display type will be exemplified, but the similar processing is also performed for location adjusting annotations Qk of the character display type and the leader-character display type.

The movable region setting section 311, as with the movable region setting section 151 of the first embodiment, sets the movable regions EAk, EBk and ECk as shown in FIGS. 5 to 7. Incidentally, the movable regions may have different shapes from those of the movable regions EAk, EBk and ECk shown in FIGS. 5 to 7. As shown in, for instance, FIG. 25, the movable region setting section 311 divides the movable region EBk into a plurality of cells FSk. Also, the movable region setting section 311 similarly divides the movable regions EAk and ECk into a plurality of cells (not shown) that are similar to the cells FSk.

Specifically, for instance, based on annotation data 170 about a newly-built feature, the movable region setting section 311 sets the movable region EBk corresponding to the location adjusting annotation Qk of the symbol-character display type as shown in FIG. 25. Then, the movable region setting section 311 divides the movable region EBk into the cells FSk each being a predetermined square. Here, as the size of the cell FSk, there may be exemplified an arrangement for dividing a character of the location-adjusting-annotation character string Wk into five cells respectively in the right-left direction and the up-down direction of the movable region EBk, but the character may be divided into other numbers of cells such as ten. The shape of the cell FSk may be triangle, rectangle or the like without limiting to the square.

Further, the movable region setting section 311 divides the movable region EBk into rectangular priority setting areas FYm (m represents natural numbers of 1 to 8), each of which is assigned with a priority for setting a later-described start-point locatable cell FQ. Specifically, the priority is so set that the highest priority is given to a priority setting area FY1 on the right of the true position Pk, and priorities are given, in descending order, to a priority setting area FY2 above the true position Pk, a priority setting area FY3 on the left of the true position Pk, a priority setting area FY4 below the true position Pk, a priority setting area FY5 on the upper right of the true position Pk, a priority setting area FY6 on the lower right of the true position Pk, a priority setting area FY7 on the upper left of the true position Pk and a priority setting area FY8 on the lower left of the true position Pk. Note that the priority may be set by any orders without limiting to the order above. The shape of the priority setting area FY1 may be triangle, square or the like without limiting to the rectangle. The movable region EBk may be divided into three, sixteen or other numbers of the priority setting areas without limiting to eight.

The region existing-display-area recognizer 312 recognizes the display area of the character area Hj, the symbol Kj, the instruction point Tj or the leader line Uj of the existing annotation Qj existing in the movable regions EAk, EBk and ECk (hereinafter, referred to as a region existing display area), while recognizing the number of the region existing display areas (hereinafter, referred to as the number of region existing display areas S). Specifically, the region existing-display-area recognizer 312 acquires the annotation data 170 about the feature located in, for instance, the area D and recognizes the display area such as the character area Hj based on the annotation data 170. When determining that at least a part of the recognized display area is located in the movable region EBk, the region existing-display-area recognizer 312 recognizes that the display area is the region existing-display-area.

When determining that the region existing display area exists, the region existing-display-area recognizer 312 outputs area number information showing the number of region existing display areas S to the unlocatable cell recognizer 313 together with existing specifying information for specifying the region existing detail area. As shown in FIG. 27, for instance, when a location adjusting annotation Q51 and existing annotations Q52 to Q56 are located in the area D, the region existing-display-area recognizer 312 recognizes display areas of symbols K52, K53 and K55 and character areas H52, H53 and H54, at least parts of which are located in a movable region EB51 of the location adjusting annotation Q51, as the region existing display areas S. Then, region existing-display-area recognizer 312 outputs to the unlocatable cell recognizer 313 the existing specifying information about these region existing display area and the area number information indicating that the number of region existing display areas S is 6. Further, the region existing-display-area recognizer 312 outputs to the start-point locatable cell setting section 314 existence information indicating that the region existing display area exists. Here, the true-position shape information 189 or the character string shape information 194 of the region existing display area may be output in place of the existing specifying information. When determining that the region existing display area does not exist, the region existing-display-area recognizer 312 outputs nonexistence information to the start-point locatable cell setting section 314.

If an entire adjustment character area Hk is not located within the movable regions EAk, ABk and ECk at the time when a start point position HLk (k represents a natural number), which is, for instance, a lower left point of the adjustment character area Hk of the location-adjusting-annotation character string Wk, is located in a cell FSk, the unlocatable cell recognizer 313 recognizes this cell FSk as an unlocatable cell FSk against the movable regions EAk, EBk and ECk. The start point position HLk may be an upper right apex, a lower right apex or any specific point on each side without limiting to the lower left apex of the adjustment character area Hk. If the adjustment character area Hk overlaps with a symbol Kk or an instruction point Tk at the time when the start position point HLk is located in a cell FSk, the unlocatable cell recognizer 313 recognizes this cell FSk as an unlocatable cell FSk against the symbol Kk or the instruction point Tk. If the adjustment character area Hk overlaps with the region existing display area when the start point position HLk is located in a cell FSk, the unlocatable cell recognizer 313 recognizes this cell FSK as unlocatable cell FSk against the region existing display area.

Specifically, when, for instance, the movable region EBk is divided into the cells FSk, the unlocatable cell recognizer 313 determines whether or not the entire adjustment character area Hk is located in the movable region EBk at the time when the start point position HLk is located in a cell FSk. Here, when a side of the adjustment character area Hk contacts with a side of the movable region EBk, the unlocatable cell recognizer 313 determines that the adjustment character area Hk is not located in the movable region EBk. When determining that a part of the adjustment character area Hk is not located in the movable region EBk, the unlocatable cell recognizer 313 recognizes the cell FSk with the start point position HLk located therein as an unlocatable cell FSk against the movable region EBk. Further, the unlocatable cell recognizer 313 associates unlocatable information indicating that the start point position HLk cannot be located therein with the unlocatable cells FSk. For example, when the movable region EBk and the cells FSk are set as shown in FIG. 25, cells FSk located within an unlocatable area GEk are recognized as the unlocatable cells FSk against the movable region EBk.

The unlocatable cell recognizer 313 determines whether or not at least a part of the adjustment character area Hk overlaps with the symbol Kk when the start point position HLk is located in a cell FSk. When determining that adjustment character area Hk overlaps with the symbol Kk, the unlocatable cell recognizer 313 recognizes the cell FSk as an unlocatable cell FSk against the symbol Kk and associates the unlocatable information with this unlocatable cells FSk. For example, in the state as shown in FIG. 25, the cells FSk in an unlocatable area GPk are recognized as the unlocatable cells FSk against the symbol Kk.

When acquiring the existing specifying information and the area number information from the region existing-display-area recognizer 312, the unlocatable cell recognizer 313 determines whether or not at least a part of the adjustment character area Hk overlaps with a Yth region existing display area (Y represents a natural number equal to or smaller than the number of region existing display areas S) that is specified by the existing specifying information at the time the start point position HLk is located in a cell FSk. When determining that adjustment character area Hk overlaps with the Yth region existing display area, the unlocatable cell recognizer 313 recognizes the cell FSk as an unlocatable cell FSk against the region existing display area and associates the unlocatable information with this unlocatable cell FS. For example, when a first region existing display area is a circular symbol K52 shown in FIG. 27, cells FSk located in an unlocatable area GJ1 as shown in FIG. 28 are recognized as unlocatable cells FSk against the first region existing display area. As another example, when a second region existing display area is a rectangular character area H52, cells FSk located in an unlocatable area GJ2 as shown in FIG. 29 are recognized as unlocatable cells FSk against the second region existing display area.

The start-point locatable cell setting section 314 locates the location-adjusting-annotation character string Wk of the character display type such that the true position Pk is positioned at the center of the adjustment character area Hk and that the overlapped existing annotation Qj overlapping with the adjustment character area Hk does not exist. Based on recognitions of the region existing-display-area recognizer 312 and the unlocatable cell recognizer 313, the start-point locatable cell setting section 314 sets a start-point locatable cell FQ for finally locating the start point position HLk to a cell FSk which, in the state where the start point position HLk is located therein, allows the entire adjustment character area Hk to be located in the movable regions EAk, EBk and ECk and allows the adjustment character area Hk not to overlap with the symbol Kk, the instruction point Tk, the region existing display area or the like.

Specifically, when recognizing that there is not an overlapped existing annotation Qj when the location-adjusting-annotation character string Wk of the character display type is located with the true position Pk being at the center of the adjustment character area Hk, the start-point locatable cell setting section 314 sets a cell FSk in which the start point position HLk is located at this time as the start-point locatable cell FG.

Upon acquisition of the nonexistence information from the region existing-display-area recognizer 312, which means there is no region existing display area, the start-point locatable cell setting section 314 recognizes cells FSk other than the unlocatable cells FSk against the movable regions EAk, EBk and ECk, the symbol Kk and the instruction point Tk as final locatable cells FSk in which the start point position HLk can be finally located. Then, in the final locatable cells FSk, the start-point locatable cell setting section 314 specifies final locatable cells FSk that are located in a priority setting area FYm with the highest priority. Further, in the specified final locatable cells FSk, the start-point locatable cell setting section 314 recognizes one cell FSk which, in a state with the start point position HLk being located therein, allows the center of the location-adjusting-annotation character string to be positioned closest to the true position Pk, and sets this one cell FSk as the start-point locatable cell FQ. Incidentally, a setting method of the start-point locatable cell FQ may not be limited to the above-described method but may be other methods such as, for instance, the one in which a final locatable cell FSk that allows a periphery of the location-adjusting-annotation character string Wk to be positioned most closest to a periphery of the true position Pk or the priority setting area FYm is set as the start-point locatable cell FQ and the one in which a final locatable cell FSk that is selected at random is set as the start-point locatable cell FQ.

Upon acquisition of the existence information from the region existing-display-area recognizer 312, which means there is a region existing display area, the start-point locatable cell setting section 314 determines whether or not there are cells FSk other than the unlocatable cells FSk against the movable regions EAk, EBk and ECk, the symbol Kk and the instruction point Tk and the region existing display area. When determining that there are those cells FSk other than the unlocatable cells FSk, the start-point locatable cell setting section 314 recognizes those cells as the final locatable cells FSk. When there is only one final locatable cell FSk recognized, this final locatable cell FSk is set as the start-point locatable cell FQ. When there are the plurality of final locatable cells FSk, the processing same as in the case with acquiring the nonexistence information is performed to set one start-point locatable cell FQ.

When determining that there is no cell FSk other than the unlocatable cells FSk against the movable region EAk, EBk and ECk, the symbol Kk, the instruction point Tk and the region existing display area, the start-point locatable cell setting section 314 determines that all of the annotations Qi cannot be located so as not to overlap with each other only by adjusting location of the location-adjusting-annotation character string Wk. Then, the start-point locatable cell setting section 314 recognizes, in annotation character strings (hereinafter, referred to a region-existing-annotation character string) Wj that correspond to the character areas Hj recognized as the region existing display areas, a region-existing-annotation character string Wj that is located in the priority setting area FYm with the highest priority. The start-point locatable cell setting section 314 then locates the location-adjusting-annotation character string Wk such that the location-adjusting-annotation character string Wk overlaps only with this region-existing-annotation character string and that all of the adjustment character areas Hk are located in the movable regions EAk, EBk and ECk, and sets a cell FSk in which the start point position HLk is located at this time as the start-point locatable cell FQ. Then, the start-point locatable cell setting section 314 performs the processing as described above to set the start-point locatable cell FQ against the region-existing-annotation character string Wj. The start-point locatable cell setting section 314 repeats the above-described processing until all of the annotations Qj are located so as not to overlap with each other. Incidentally, since the symbol Kj and the instruction point Tj of the overlapped existing annotation Qj represent a position of the feature, the start-point locatable cell FQ is not set for them.

The annotation data updating section 315 updates the annotation data 170 so that the start point position HLk is located in the start-point locatable cell FQ. In other words, the annotation data updating section 315 updates the annotation data 170 so as to display the map in which all of the annotations Qi are not overlapped with each other. Specifically, the annotation data updating section 315 recognizes a coordinate of the adjustment character area Hk at the time when the location-adjusting-annotation character string Wk is located so that the start point position HLk is located in the start-point locatable cell FQ. Then, by recognizing a scale for displaying the location-adjusting-annotation character string Wk, the annotation data updating section 315 associates information about the scale with the coordinate of the adjustment character area Hk, which is then stored in the character string shape information 194. When recognizing that location of the start-point locatable cell FQ against the region-existing-annotation character string Wj is completed, the annotation data updating section 315 records the information about the scale and the coordinate of the character area Hj in the character string shape information 194 of this region-existing-annotation character string Wj. Then, the annotation data updating section 315 recognizes coordinates of the leader lines Uk and Uj corresponding to the location states of the adjustment character area Hk and the character area Hj to record the coordinates in the character string shape information 194. The annotation data 170 with the character string shape information 194 having been updated is stored in the storage section 130.

[Operation of Map Information Generating Device]

Figure 30:
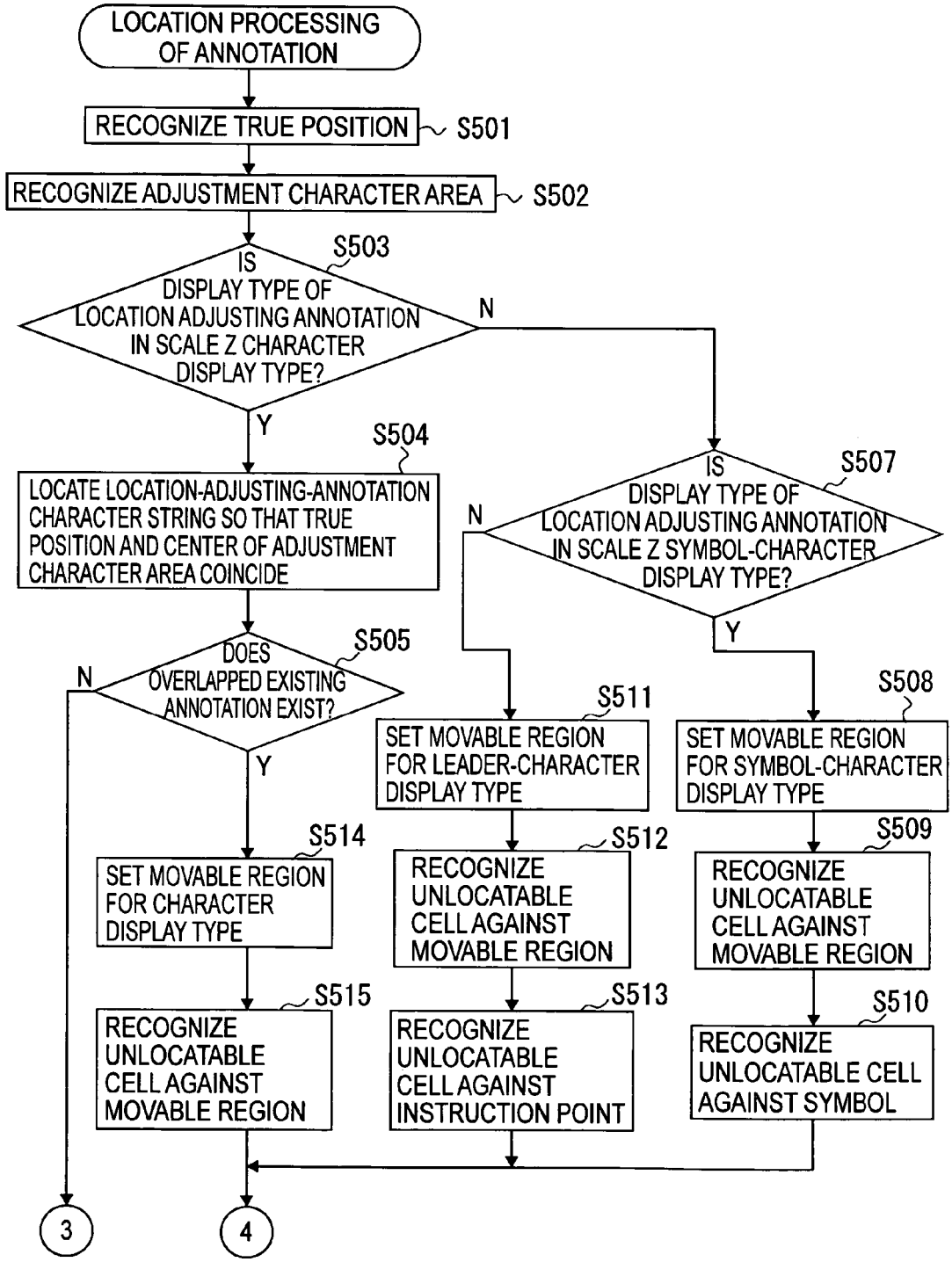
FIG. 30 is a flowchart showing location processing in the second embodiment.
Figure 31:
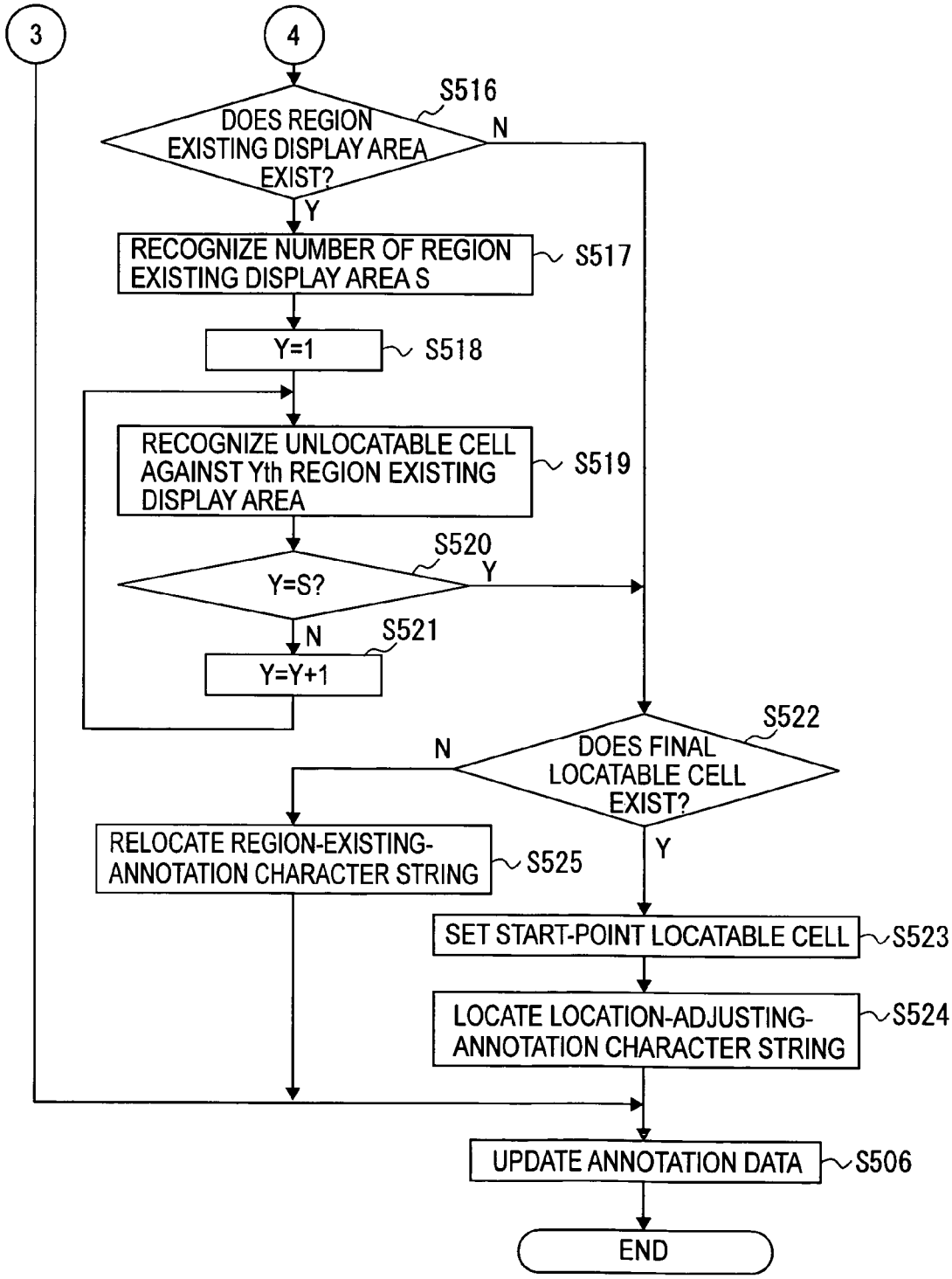
FIG. 31 is another flowchart showing the location processing of an annotation in the second embodiment.
Figure 32:
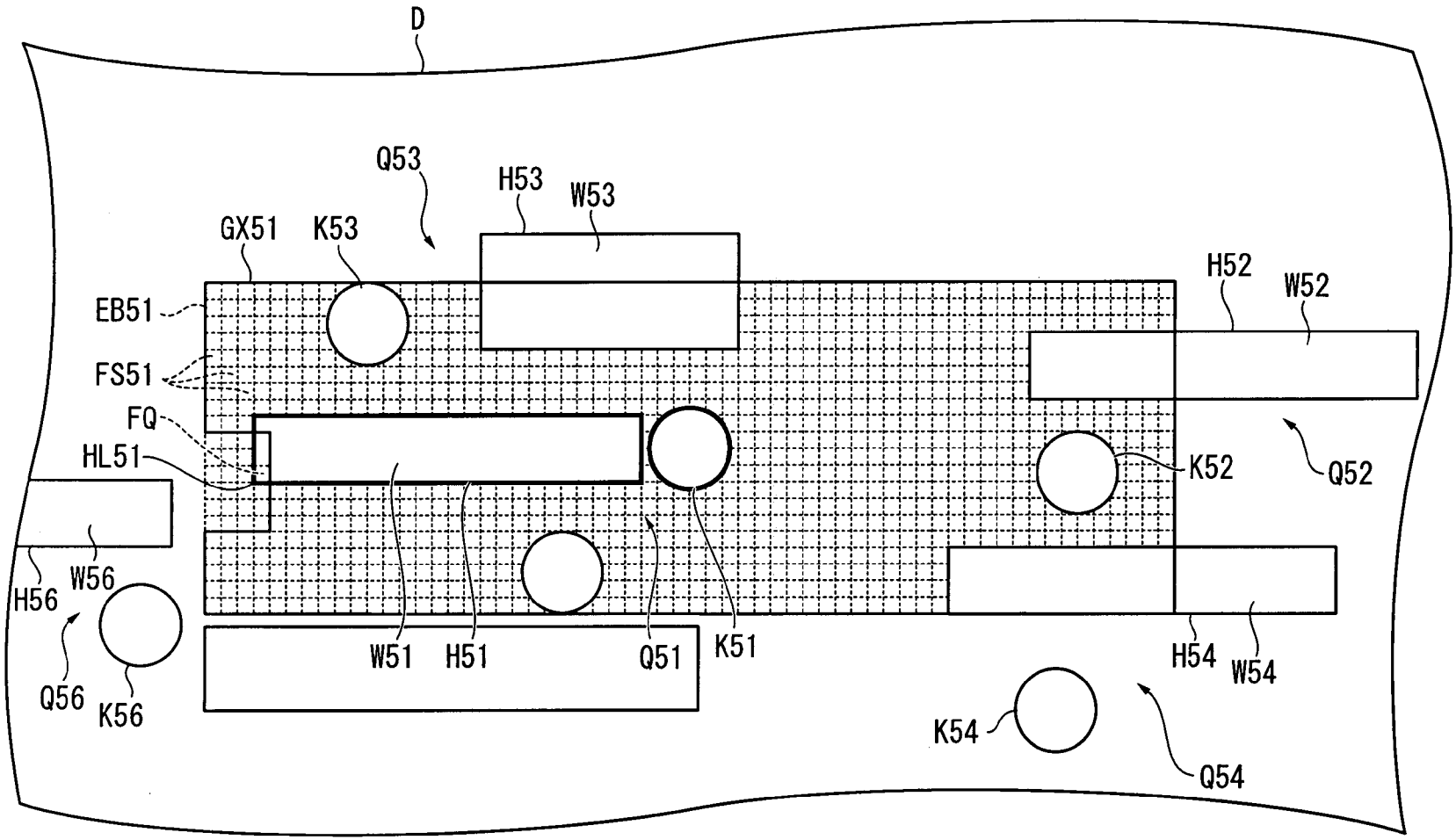
FIG. 32 is a schematic diagram showing a state where the location processing of a location adjusting annotation is completed in the second embodiment.
Figure 33:
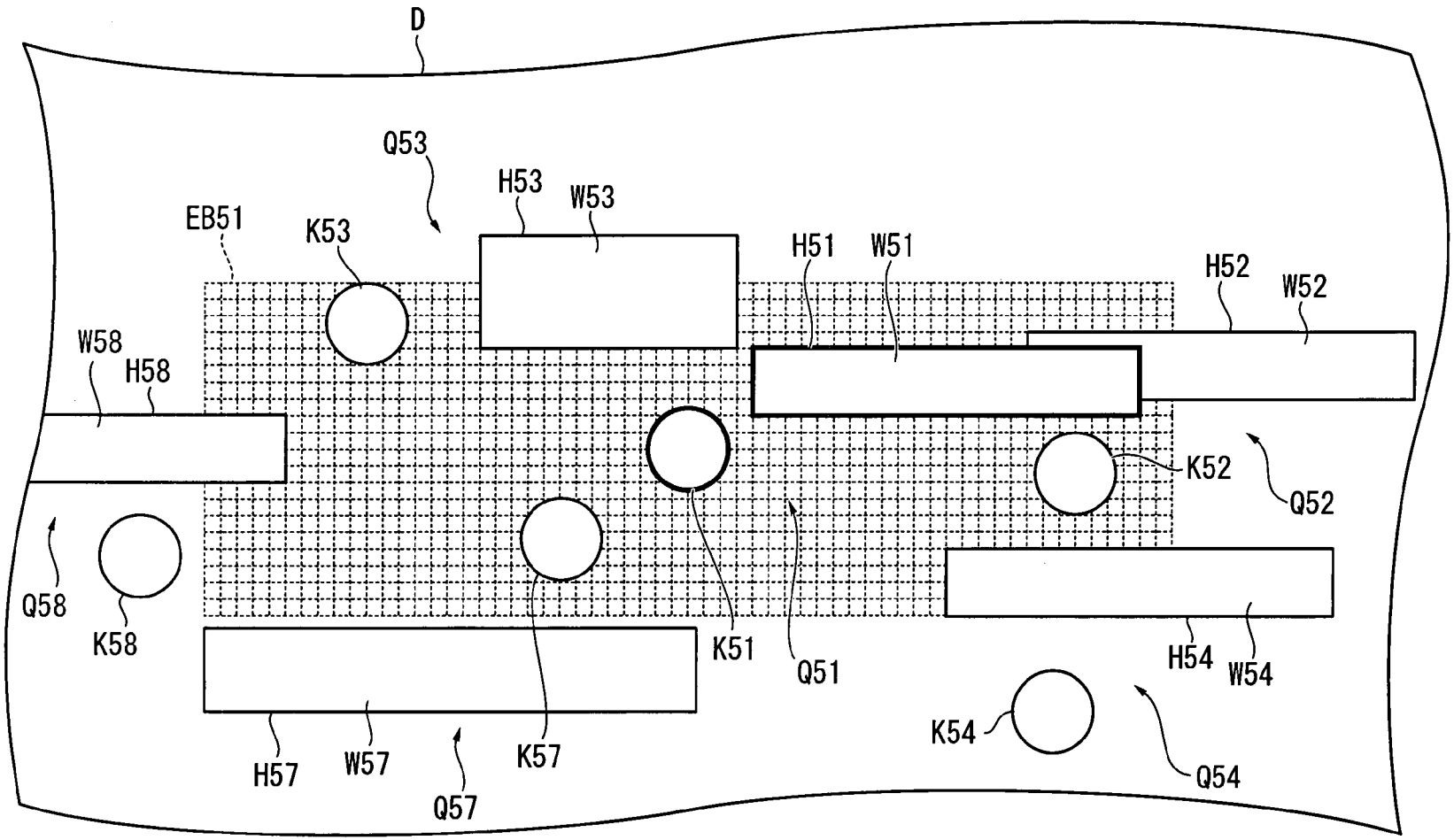
FIG. 33 is a schematic diagram showing a state before a region-existing-annotation character string is relocated in the second embodiment.
Figure 34:
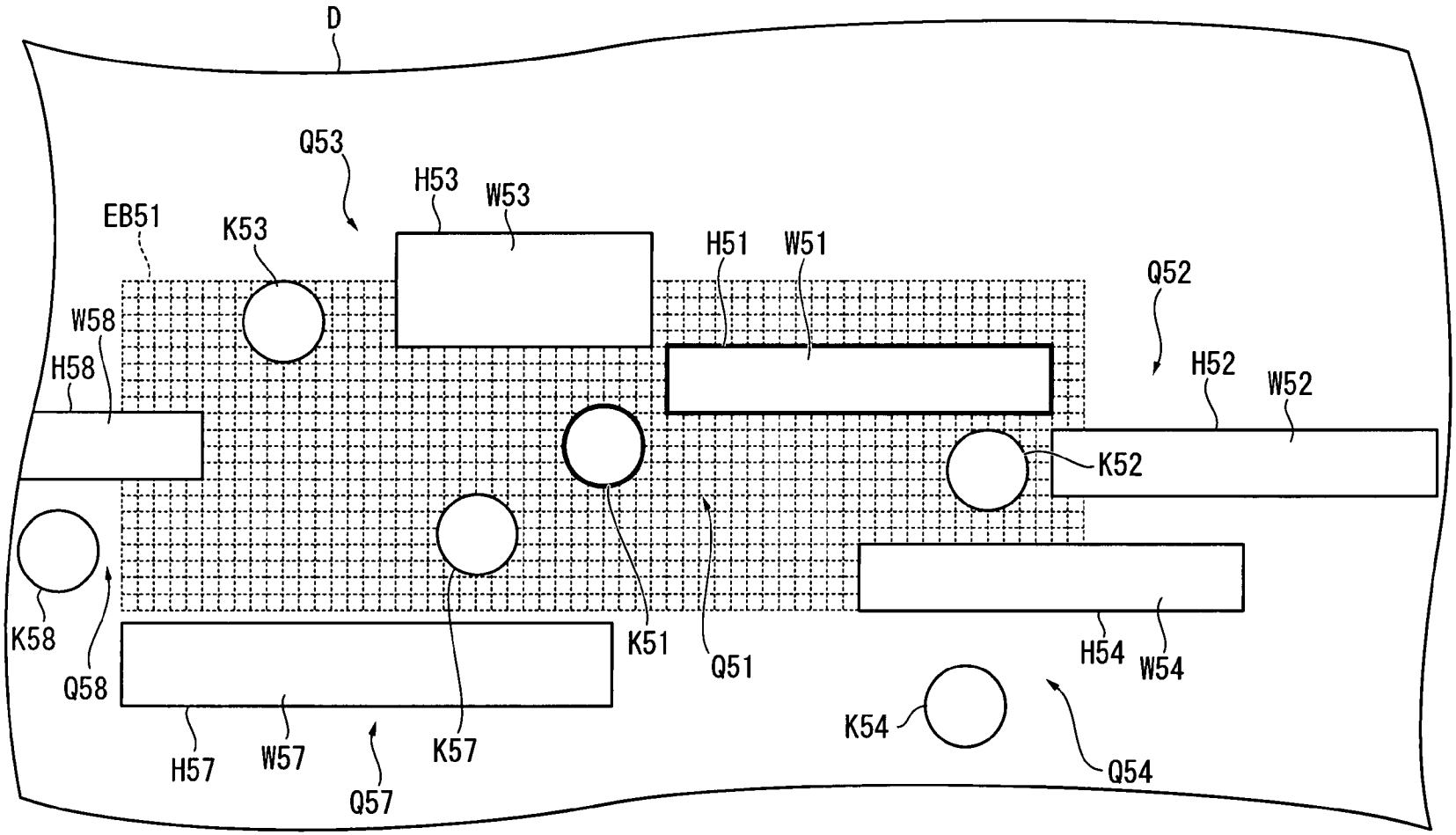
FIG. 34 is a schematic diagram showing a state where the region existing-annotation character string is relocated from the state shown in FIG. 33 in the second embodiment.

Next, as an operation of the map information generating device 300, update processing of annotation data in accordance with an additional location of a location adjusting annotation Qk will be described with reference to the drawing. Note that since the update processing for the annotation data 170 in accordance with the additional location of the location adjusting annotation Qk is performed similarly to that in the first embodiment, namely the processing as shown in FIG. 8, the description thereof will be omitted. FIGS. 30 and 31 are flowcharts each showing the location processing for the annotation. FIG. 32 is a schematic diagram showing a state where the location processing of the location adjusting annotation is completed. FIG. 33 is a schematic diagram showing a state before the region-existing-annotation character string is relocated. FIG. 34 is a schematic diagram showing a state where the region-existing-annotation character string is relocated from the state shown in FIG. 33.

The processor 310 of the map information generating device 300 performs the following processing as location processing of the annotation Qi in the Step S105 in the update processing of the annotation data 170 as shown in FIG. 8. The processor 310 recognizes the true position Pk of the location adjusting annotation Qk with the movable region setting section 151 as shown in FIG. 30 (Step S501), and recognizes the shape of the adjustment character area Hk (Step S502). Thereafter, the movable region setting section 151 determines whether or not the display type of the location adjusting annotation Qk in the scale Z is the non-display type (Step S503). In Step S503, when it is determined that the display type is the character display type, the start-point locatable cell setting section 314 locates the location-adjusting-annotation character string Wk in a state where the true position Pk coincides with the center of the adjustment character area Hk (Step S504), and determines whether or not the overlapped existing annotation Qj exists (Step S505). In Step S505, when it is determined that the overlapped existing annotation Qj does not exist, the annotation data updating section 153 performs update processing of the annotation data 170 with the location state of the location-adjusting-annotation character string Wk reflected as shown in FIG. 31 (Step S506), and the location processing of the annotation Qi is terminated.

In Step S503, when determining that the display type is not the character display type, the movable region setting section 311 determines whether or not the display type in the scale Z is the symbol-character display type (Step S507). In Step S507, when determining that the display type is the symbol-character display type, the movable region setting section 311 sets the movable region EBk for the symbol-character display type on the area D (Step S508). For instance, a movable region EB51 for the location adjusting annotation Q51 is set as shown in FIG. 27. Then, the unlocatable cell recognizer 313 recognizes the unlocatable cell FSk against the movable region EBk (Step S509), while recognizing the unlocatable cell FSk against the symbol Kk (Step S510).

In Step S507, when determining that the display type is not the symbol-character display type but the leader-character display type, the movable region setting section 311 sets the movable region ECk for the leader-character display type (Step S511). Then, the unlocatable cell recognizer 313 recognizes the unlocatable cell FSk against the movable region ECk (Step S512), while recognizing the unlocatable cell FSk against the instruction point Tk (Step S513). In Step S505, when determining that the overlapped existing annotation Qj does not exist, the movable region setting section 311 sets the movable region EAk for the character display type (Step S514) and recognizes the unlocatable cell FSk against the movable region EAk (Step S515).

Then, after the processor 310 recognizes the unlocatable cells FSk in Steps S510, S513 and S515, the region existing-display-area recognizer 312 determines whether or not the region existing display area exists (Step S516). In Step S516, when determining that the region existing display area exists, the region existing-display-area recognizer 312 recognizes the number of region existing display areas S (Step S517) and outputs the existing specifying information and the area number information to the unlocatable cell recognizer 313, while outputting the existence information to the start-point locatable cell setting section 314. Upon recognition of the existing specifying information and the area number information, the unlocatable cell recognizer 313 sets a variable Y to 1 (Step S518), and sets an order of the region existing display areas which is referred to in recognizing the unlocatable cell FSk. Here, the order may be set based on a distance from the true position Pk, may be set in the descending order of the priority of the priority setting area FYm, or may be any other method. The unlocatable cell recognizer 313 recognizes the unlocatable cell FSk against the Yth region existing display area (Step S519), and determines whether or not the value of the variable Y is equal to the number of region existing display areas S (Step S520).

In Step S520, when determining that the value of the variable Y is smaller than the number of region existing display areas S, the unlocatable cell recognizer 313 adds 1 to the variable Y (Step S521), and performs the processing of Step S519. On the other hand, when the unlocatable cell recognizer 313 determines that the value of the variable Y is equal to the number of region existing display areas S, namely determines that the unlocatable cells FSk against all of the region existing display areas are recognized, the processor 310 operates the start-point locatable cell setting section 314 to determine whether or not the final locatable cells FSk exist (Step S522). Even when it is determined that region existing display area does not exist in Step S516, the processing of Step S522 is also performed. In Step S522, when it is determined that the final locatable cells FSk exist, the start-point locatable cell setting section 314 sets one of the final locatable cells FSk as the start-point locatable cell FQ (Step S523). The processor 310 operates the annotation data updating section 315 to locate the location-adjusting-annotation character string Wk so that the start point position HLk is located in the start-point locatable cell FQ (Step S524), and performs the processing of Step S506 based on this location state.

For instance, in the state shown in FIG. 27, the start-point locatable cell setting section 314 recognizes the cells FSk that are not located in an unlocatable area GX 51 in FIG. 32 as the final locatable cells FSk by the processing of Steps S516 through S522, and sets the start-point locatable cell FQ. Then, the start-point locatable cell setting section 314 locates a location-adjusting-annotation character string W51 so that a start point position HL51 of an adjustment character area H51 is located in a start-point locatable cell FQ.

On the other hand, in Step S522, when it is determined that the final locatable cells FSk do not exist, the start-point locatable cell setting section 314 performs relocation processing of the region-existing-annotation character string Wj (Step S525), and performs the processing of Step S506 based on the relocation state. For instance, in the state as shown in FIG. 33, the start-point locatable cell setting section 314 determines that the final locatable cells FS51 of the location-adjusting-annotation character string W51 do not exist, and locates the location-adjusting-annotation character string W51 so that the location-adjusting-annotation character string W51 overlaps only with the region existing display area W52 corresponding to the character area H52 recognized as the region existing display area and that the entire adjustment character area H51 is located in the movable region EB51. Then, the setting processing same as that of the start-point locatable cell FQ for the location-adjusting-annotation character string W51, the region-existing-annotation character string W52 is relocated as shown in FIG. 34.

[Advantages of Second Embodiment]

As described above, the second embodiment can provide the following advantages in addition to those provided by the first embodiment.

The processor 310 of the map information generating device 300 operates the movable region setting section 311 to acquire annotation data 170 of a location adjusting annotation Qk about a new feature. The start-point locatable cell setting section 314 of the processor 310 sets the locatable position of the start point position HLk of the adjustment character area HK of the location adjusting annotation Qk so that the location-adjusting-annotation character string Wk is positioned near the true position Pk and does not overlap with the existing annotation Qj. Then, the annotation data updating section 315 of the processor 310 updates, based on the location state of the location-adjusting-annotation character string Wk set by the start-point locatable cell setting section 314, the annotation data 170 of the location-adjusting-annotation character string Wk and stores it in the storage section 130. Thus, the map information generating device 300 can provides the same advantage as those in the first embodiment, thereby appropriately updating the annotation list data 160.

The start-point locatable cell setting section 314, when recognizing that all of the annotations Qi cannot be located so as not to overlap with each other only by adjusting location of the location-adjusting-annotation character string Wk, sets a predetermined cell FSk as the a start-point locatable cell FQ of the location-adjusting-annotation character string Wk, while setting the start point locatable cell FQ of the region-existing-annotation character string Wj that overlaps with the location-adjusting-annotation character string Wk. Therefore, unlike a conventional arrangement in which the location adjusting processing of the region-existing-annotation character string Wj is not performed, the map information generating device 300 does not have a problem in which all of the annotations cannot be located so as not to overlap with each other, thereby updating the annotation list data 160 more properly.

The unlocatable cell recognizer 313 recognizes cells FSk constituting the adjustment character area Hk that overlaps with the region existing display area when the start point position HLk is located as unlocatable cells FSk against the region existing display area. Then, the start-point locatable cell setting section 314 sets cells FSk other than the unlocatable cells FSk against the region existing display area as the start-point locatable cells FQ. Thus, unlike the first embodiment, it is only necessary for the map information generating device 300 to determine whether or not the adjustment character area Hk overlaps with the region existing display area, but not necessary to perform complicated processing for computing the overlapping amount with the region existing display area. Therefore, the map information generating device 300 can set the locatable position of the location-adjusting-annotation character string Wk more easily and in shorter time as compared to the arrangement of the first embodiment.

Further, the start-point locatable cell setting section 314 sets the start-point locatable cell FQ based on the priority of the priority setting area FYm. Thus, by setting the priority of the priority setting area FYm such that, a priority setting area that allows the user to easily recognize association between the annotation character string Wi and the true position Pi has higher propriety, the map information generating device 300 can update the annotation list data 160 so that the user can easily recognize the position of the feature.

[Modification of Embodiment]

The present invention is not limited to the above specific embodiments, but includes modifications and improvements as long as the objects of the present invention can be attained.

Specifically, in the first and second embodiments, the location adjusting processing for the overlapped-existing-annotation character string Wj or the region-existing-annotation character string Wj may not be performed. With such arrangement, a function for performing the above-described processing does not have to be provided to the location adjusting processor 152 or the start-point locatable cell setting section 314, thus simplifying the arrangements of the location adjusting processor 152 or the start-point locatable cell setting section 314.

Further, in the first and second embodiments, when the location adjusting annotation Qk is the character display type, the location-adjusting-annotation character string Wk may not be located so that the true position Pk is positioned at the center of the adjustment character area Hk. With such arrangement, a function for performing the above-described processing does not have to be provided to the location adjusting processor 152 or the start-point locatable cell setting section 314, thus simplifying the arrangements of the location adjusting processor 152 or the start-point locatable cell setting section 314. In addition, the locatable position of the location-adjusting-annotation character string Wk can be set in shorter time.

In the first embodiment, the movable regions EAk, EBk and ECk may not be set. Instead, the locatable position of the location-adjusting-annotation character string Wk may be set by determining whether or not it can be located at a specific position, e.g., above and below the true position Pk as well as on the right and left of the true position Pk. With the arrangement, the movable region setting section 151 does not have to be provided to the processor 150, thus simplifying the arrangement of the processor 150. In addition, the locatable position of the location-adjusting-annotation character string Wk can be set in shorter time.

In the first embodiment, without recognizing the overlapping amount of the location-adjusting-annotation character string Wk and the overlapped existing annotation Qj, it may be so arranged to determine whether or not the location-adjusting-annotation character string Wk can be located at a position to which it is moved in a direction corresponding to the positional relationship between them and by a predetermined distance. Contrary, without recognizing the positional relationship between the location-adjusting-annotation character string Wk and the overlapped existing annotation Qj, it may be so arranged to determine whether or not the location-adjusting-annotation character string Wk can be located at a position to which it is moved in a predetermined direction and by the overlapping amount. With the arrangement, the location adjusting processor 152 does not have to be provided with a function for recognizing the overlapping amount or a function for recognizing the positional relationship, thus simplifying the arrangement of the location adjusting processor 152. In addition, the locatable position of the location-adjusting-annotation character string Wk can be set in shorter time.

In the first embodiment, when there are a plurality of the overlapped existing annotations Qj, the locatable position of the location-adjusting-annotation character string Wk may be set based on the overlapping state with an overlapped existing annotation Qj that exists in a predetermined direction from the location-adjusting-annotation character string Wk, regardless of the distance between the overlapped existing annotation Qj and the location-adjusting-annotation character string Wk. With the arrangement, the location adjusting processor 152 does not have to be provided with a function for computing the distance to the overlapped existing annotation Q1, thus simplifying the arrangement of the location adjusting processor 152.

In the first embodiment, when the overlapped-existing-annotation character string W2 exists only on the lower side of the movable region EB1 of the location-adjusting-annotation character string W1 as shown in FIG. 11, the locatable position of the location-adjusting-annotation character string W1 may be set at a position along the right side, the upper side or the left side of the movable region EB1, on which the overlapped-existing-annotation character string W2 does not exist. Further, as shown in FIG. 11, when the locatable position of the location-adjusting-annotation character string Wk can be set along the lower side of the movable region EB1 and at a position remote from the overlapped-existing-annotation character string W2 by a predetermined distance, the location-adjusting-annotation character string Wk may be located at a position on the left of the position shown by the solid line in FIG. 11. With these arrangements, as compared to the first embodiment, the location-adjusting-annotation character string Wk may be located at a position even remoter from the overlapped-existing-annotation character string W2, thus allowing the user to recognize the location-adjusting-annotation character string Wk and the overlapped-existing-annotation character string W2 more easily.

In the first embodiment, determination on whether or not the location-adjusting-annotation character string Wk can be located at a predetermined position in the movable regions EAk, EBk and ECk may not be made in the order of the lower side, the right side, the upper side and the left side, but other orders may be employed. Further, the determination on whether or not the location-adjusting-annotation character string Wk can be located on any one of the sides may not be made.

In the second embodiment, the start-point locatable cell FQ may not be set based on the priority of the priority setting area FYm, by may be set by selecting a cell FSk at random from cells FSk other than the unlocatable cells FSk. With the arrangement, the movable region setting section 311 does not have to be provided with a function for setting the priority setting area FYm, thus simplifying the arrangement of the movable region setting section 311.

Figure 35:
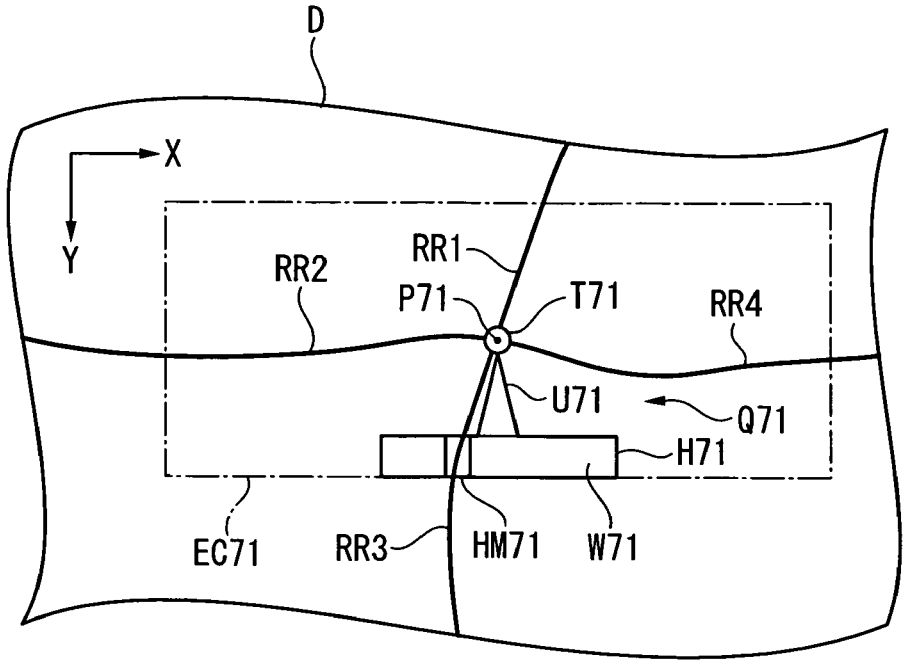
FIG. 35 is a schematic diagram showing a state before the location adjusting processing of a location-adjusting-annotation character string is performed in a modification of the present invention.
Figure 36:
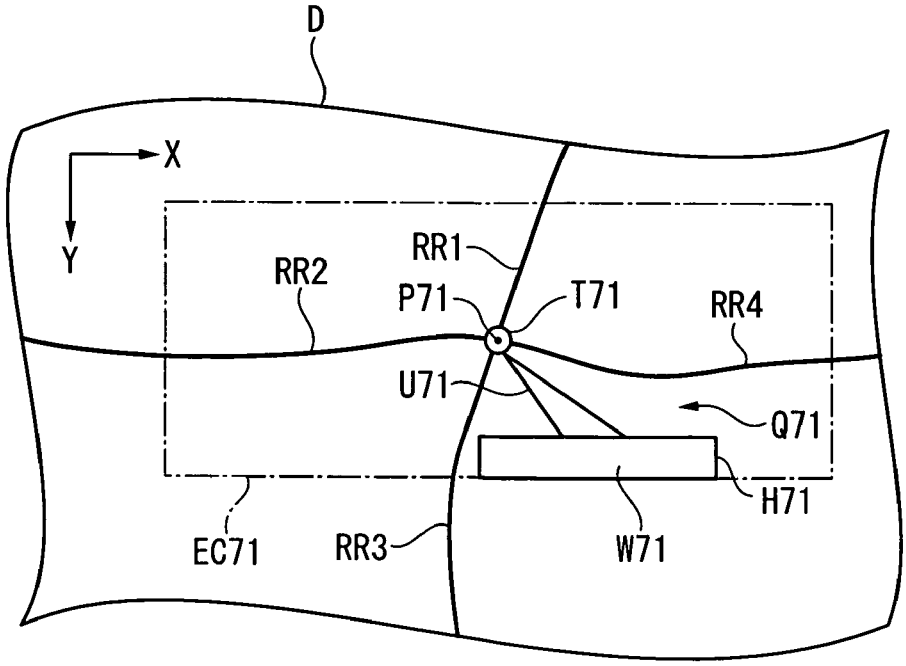
FIG. 36 is a schematic diagram showing a state where the location adjusting processing of the location-adjusting-annotation character string is completed from the state shown in FIG. 35 in the modification.

In the map information generating device 100, when there is existing a road PR3 that overlaps with a location-adjusting-annotation character string W71 of a location adjusting annotation Q71 of the leader-character display type for indicating an intersection in the area D as shown in FIG. 35, the locatable position of the location-adjusting-annotation character string W71 may be set at, for instance, a position that does not overlap with a road RRt (t represent a natural number) as shown in FIG. 36. Specifically, the location adjusting processor 152 functions as a road information acquirer, and locates the location-adjusting-annotation character string W71 at the center of the lower side of a movable region EC71, while acquiring a node N located around a true position P71. Further, the location adjusting processor 152 acquires a link L having the same attribute from links L connected to the node N, and repeats the acquisition until a tip of the link L is located out of the movable region EC71. Then, the location adjusting processor 152 acquires road information VMxB for displaying the road PRt corresponding to the acquired link L. The location adjusting processor 152 then sets a rectangular area HM71 including an overlapping portion of the location-adjusting-annotation character string W71 and the road PR3, while recognizing an X-coordinate and a Y-coordinate of the rectangular area HM71, and performs the above-described processing to set the locatable position of the location-adjusting-annotation character string W71 as shown in FIG. 36. With the arrangement, the annotation list data 160 can be updated so that the annotation character string Wk can be displayed so as not to overlap with the road t, thus further improving the user-friendliness of the map information generating device 100. Incidentally, in the case with the leader-character display type, the locatable position may be set so that the location-adjusting-annotation character string W71 is located out of the movable region EC71. The above-described processing may be performed by the map information generating device 300.

As an example, the information updating device of the present invention may be applied to an arrangement for updating annotation list data 160 about an annotation Qi of one or two display types selected from the character display type, the symbol-character display type and the leader-character display type. As another example, the information updating device may be applied to annotation list data 160 for showing a positional relationship of features in one scale. As still another example, the information updating device may be applied to any arrangement for updating target object map information for showing various information about a predetermined target object, the target object map information being, for instance: layout drawing information for displaying as a layout drawing various information about various appliances and facilities (target object) located in facilities such as a house and a plant in a manner substantially corresponding to a positional relationship of the various appliances and the like; circuit diagram information for displaying as a circuit diagram various information about parts (target object) included in a circuit in a manner corresponding to a positional relationship of the parts. As further example, the information updating device may be applied to an arrangement for updating the above-described information for printing out the map, the layout drawing or the circuit diagram. The display unit for displaying the map may be applied to an arrangement installed at home or in a plant, without limiting to the one installed in a mobile body. The processors 150 and 310 in the information updating device of the present invention may be independent units.

While the functions described above are realized in the form of programs in the above description, the functions may be realized in any form including hardware such as a circuit board or elements like IC (Integrated Circuit). In view of easy handling and promotion of the use, the functions are preferably stored and read from programs or storing media.

The arrangements and the operating procedures for the present invention may be appropriately modified as long as the scope of the present invention can be attained.

[Advantages of Embodiments]

As described above, in the embodiments above, the processor 150 of the map information generating device 100 acquires the annotation data 170 for displaying the location adjusting annotation Qk about, for instance, a feature that is newly built, and sets the locatable position of the location-adjusting-annotation character string Wk of the location adjusting annotation Qk at a position substantially corresponding to a position of the feature of the location-adjusting-annotation character string Wk but not overlapping with the existing annotation Qj. Then, the processor 150 updates the annotation data 170 based on the location state of the location-adjusting-annotation character string Wk and store it in the storage section 130. Thus, when adding a location-adjusting-annotation character string Wk of a new feature to the annotation list data 160 and updating the annotation list data 160, the map information generating device 100 updates the annotation list data 160 so that annotation character strings Wk of features respectively correspond to the positional relationships of the features, but do not overlap with each other. Accordingly, the display unit that displays the positional relationships of the features using the annotation list data 160 can display the annotation character strings Wk in a manner not overlapping with each other without providing a function for adjusting the locatable position of the annotation character strings Wk on the display unit. Since the size of characters constituting the annotation character string Wk is not adjusted, the user can recognize the details of the features more accurately as compared to a conventional arrangement in which the size of the characters is adjusted depending on the number of characters constituting the annotation character string Wk. Since the map information generating device 100 does not delete an annotation character string Wk having existed previously, it dose not generate the annotation list data 160 that does not contain an annotation character string Wk that is useful for the user, unlike conventional arrangement in which the annotation character string Wk having existed previously is deleted. Therefore, the map information generating device 100 can appropriately update the annotation list data 160.

The priority application Number JP2005-150173 upon which this patent application is based is hereby incorporated by reference.

What is claimed is:

1. An information updating device for updating target object map information for displaying detail information about details of a plurality of target objects located in a predetermined position such that the detail information corresponds to a positional relationship of the plurality of the target objects, the device comprising:

a new detail information acquirer for acquiring the detail information about the new target object;

a new target object position recognizer for recognizing a position where the new target object exists;

a target object map information acquirer for acquiring the target object map information;

an existing detail position recognizer for recognizing, based on the target object map information acquired by the target object map information acquirer, a display position for detail information of an existing target object that is different from the new target object, the detail information of the existing target object possibly visually interfering with the detail information of the new target object;

a detail position setting section for setting a display position for the detail information of the new target object at a position corresponding to the position of the new target object but not overlapping with the detail information of the existing target object; and an update processor for updating the target object map information such that the detail information of the new target object is displayed at the display position that is set by the detail position setting section.

2. The information updating device according to claim 1, wherein the target object map information has target object association information in which target object existing position information about a position where a target object exists, the detail information and detail position information about a display position for the detail information are mutually associated, the information updating device further includes a detail position information generator for generating the detail position information about the display position for the detail information of the new target object, the display position set by the detail position setting section, the new target object position recognizer acquires the target object existing position information about the new target object and recognizes the position where the new target object exists based on the target object existing position information, and the updating processor adds the target object association information having the target object existing position information of the new target object, the detail information and the detail position information to the target object map information as updating processing of the target object map information.

3. The information updating device according to claim 1, wherein when determining that the display position for the detail information of the new target object cannot be set at the position corresponding to the position of the new target object but not overlapping with the detail information of the existing target object, the detail position setting section sets the display position for the detail information of the new target objects at a predetermined position corresponding to the position of the new target object and overlapping with the detail information of the existing target object, the detail position setting section further setting the display position for the detail information of the existing target object that overlaps with the detail information of the new target object at a position corresponding to the position of the existing target object, but not overlapping with the detail information of other target objects than the existing target object, and an update processor updates the target object map information so that the detail information of the new target object and the detail information of the existing target object are displayed at the display positions set by the detail position setting section.

4. The information updating device according to claim 3, wherein the target object map information has target object association information in which target object existing position information about a position where a target object exists, the detail information and detail position information about a display position for the detail information are mutually associated, the information updating device further includes a detail position information generator for generating the detail position information about the display positions for the detail information of the new target object and the detail information of the existing target object, the display positions set by the detail position setting section, the new target object position recognizer acquires the target object existing position information about the new target object and recognizes the position where the new target object exists based on the target object existing position information, and the updating processor adds the target object association information having the target object existing position information of the new target object, the detail information and the detail position information to the target object map information as updating processing of the target object map information, while updating the detail position information of the existing target object contained in the target object map information to the detail position information generated by the detail position information generator.

5. The information updating device according to claim 1, further comprising:

a region setting section for setting a predetermined region at a position corresponding to the position of the new target object, wherein the detail information setting section sets the display position for the detail information of the new target object at a predetermined position in the predetermined region corresponding to the new target object.

6. The information updating device according to claim 5, wherein the region setting section divides the predetermined region into a plurality of cells, and the detail position setting section recognizes, when setting cells corresponding to the display position for the detail information of the new target object in the plurality of cells, a cell that overlaps with the detail information of other target objects than the new target object, the detail position setting section setting a position corresponding to the cells other than the recognized overlapping cell as the display position for the detail position of the new target object.

7. The information updating device according to claim 6, wherein the region setting section sets priorities of the plurality of cells, the cells with the priorities corresponding to the display position for the detail information of the new target object, and the detail information setting section sets, based on the priorities, a position corresponding to a predetermined cell as the display position for the detail information of the new target object.

8. The information updating device according to claim 1, wherein the detail position setting section determines, when setting the display position for the detail information of the new target object at a specific position corresponding to the position of the new target object, whether or not the display position overlaps with the detail information of other target objects than the new target object, the detail position setting section setting the display position for the detail information of the new target object at the specific position when determining that the display position does not overlap, while setting the display position for the detail information of the new target object at another position different from the specific position when determining that the display position overlaps.

9. The information updating device according to claim 8, wherein the detail information setting section recognizes, when determining that the display position overlaps, an overlapping state and sets the display position for the detail information of the new target object based on the recognized overlapping state.

10. The information updating device according to claim 9, wherein the detail information setting section recognizes an overlapping amount of the detail information of the new target object and the detail information of other target objects than the new target object, the overlapping amount being recognized as the overlapping state.

11. The information updating device according to claim 9, wherein the detail information setting section recognizes a positional relationship of the detail information of the new target object and the detail information of other target objects than this new target object, the positional relationship being recognized as the overlapping state.

12. The information updating device according to claim 1, wherein the detail information includes: symbol information for expressing by a symbol a detail of a target object at a position corresponding to the position of the target object; and character information for expressing by a character the detail of the target object at a position corresponding to the position of the target object, and the detail information setting section sets a display position for the character information of the new target object at a position corresponding to the position of the new target object but not overlapping with the symbol information of the new target object.

13. The information updating device according to claim 1, wherein the detail information includes: symbol information for expressing by a symbol a detail of a target object at a position corresponding to the position of the target object; character information for expressing by a character the detail of the target object at a position corresponding to the position of the target object; and graphic information for expressing by a graphic an association of the symbol and the character at a position between the symbol and the character, and the detail information setting section sets the display position for the character information of the new target object at a position corresponding to the position of the new target object and remote from the symbol information of the new target object by a predetermined distance, while setting a display position for the graphic information at a position between the symbol information and the character information.

14. The information updating device according to claim 1, wherein the target object map information is information for displaying the detail information in a manner corresponding to the positional relationship of the plurality of the target objects in a plurality of scales different from each other.

15. The information updating device according to claim 1, wherein the target object is a feature, the information updating device includes a road information acquirer for acquiring road information for displaying a road, when superimposing the detail information on the road information in such a manner that the display position for the detail information corresponds to positions where the feature and the road exist, the detail position setting section sets the display position for the detail information at a position not overlapping with the road information.

16. The information updating device according to claim 15, wherein the target object map information is information for displaying the detail information on a display unit installed in a mobile body such that the detail information superimposes on the road information.

17. An information updating method for updating target object map information for displaying detail information about details of a plurality of target objects located in a predetermined position such that the detail information corresponds to a positional relationship of the plurality of the target objects, the method being performed by a computing unit and comprising:

acquiring the detail information about the new target object;

recognizing a position where the new target object exists;

acquiring the target object map information;

recognizing a display position for detail information of a target object that is different from the new target object based on the acquired target object map information;

setting a display position for the detail information of the new target object at a position corresponding to the position of the new target object but not overlapping with the detail information of the existing target object; and updating the target object map information for displaying the detail information of the new target object at the set display position.

18. An information updating program for operating a computing unit as an information updating device for updating target object map information for displaying detail information about details of a plurality of target objects located in a predetermined position such that the detail information corresponds to a positional relationship of the plurality of the target objects, the program recorded in a storing medium in a manner readable by the computing unit, wherein the information updating device includes:

a new detail information acquirer for acquiring the detail information about the new target object;

a new target object position recognizer for recognizing a position where the new target object exists;

a target object map information acquirer for acquiring the target object map information;

an existing detail position recognizer for recognizing a display position detail information of a target object that is different from the new target object based on the target object map information acquired by the target object map information acquirer;

a detail position setting section for setting a display position for the detail information of the new target object at a position corresponding to the position of the new target object but not overlapping with the detail information of the existing target object; and an update processor for updating the target object map information for displaying the detail information of the new target object at the display position that is set by the detail position setting section.

19. An information updating program for operating a computing unit to perform an information updating method for updating target object map information for displaying detail information about details of a plurality of target objects located in a predetermined position such that the detail information corresponds to a positional relationship of the plurality of the target objects, the program recorded in a storing medium in a manner readable by the computing unit, wherein the information updating method includes:

acquiring the detail information about the new target object;

recognizing a position where the new target object exists;

acquiring the target object map information;

recognizing a display position for detail information of a target object that is different from the new target object based on the acquired target object map information;

setting a display position for the detail information of the new target object at a position corresponding to the position of the new target object but not overlapping with the detail information of the existing target object; and updating the target object map information for displaying the detail information of the new target object at the set display position.

20. A storing medium that records an information updating program in a manner readable by a computing unit, the program operating a computing unit as an information updating device for updating target object map information for displaying detail information about details of a plurality of target objects located in a predetermined position such that the detail information corresponds to a positional relationship of the plurality of the target objects, the program recorded in a storing medium in a manner readable by the computing unit, wherein the information updating device includes:

a new detail information acquirer for acquiring the detail information about the new target object;

a new target object position recognizer for recognizing a position where the new target object exists;

a target object map information acquirer for acquiring the target object map information;

an existing detail position recognizer for recognizing a display position detail information of a target object that is different from the new target object based on the target object map information acquired by the target object map information acquirer;

a detail position setting section for setting a display position for the detail information of the new target object at a position corresponding to the position of the new target object but not overlapping with the detail information of the existing target object; and an update processor for updating the target object map information for displaying the detail information of the new target object at the display position that is set by the detail position setting section.

21. A storing medium that records an information updating program in a manner readable by a computing unit, the program operating a computing unit to perform an information updating method for updating target object map information for displaying detail information about details of a plurality of target objects located in a predetermined position such that the detail information corresponds to a positional relationship of the plurality of the target objects, the program recorded in a storing medium in a manner readable by the computing unit, wherein the information updating method includes:

acquiring the detail information about the new target object;

recognizing a position where the new target object exists;

acquiring the target object map information;

recognizing a display position for detail information of a target object that is different from the new target object based on the acquired target object map information;

setting a display position for the detail information of the new target object at a position corresponding to the position of the new target object but not overlapping with the detail information of the existing target object; and updating the target object map information for displaying the detail information of the new target object at the set display position.

* * * * *